US010869809B2

(12) United States Patent
Lenke

(10) Patent No.: US 10,869,809 B2
(45) Date of Patent: Dec. 22, 2020

(54) PIN-SHAPED STIMULATION DEVICE

(71) Applicant: NOVOLUTO GMBH, Berlin (DE)

(72) Inventor: Michael Lenke, Metten (DE)

(73) Assignee: NOVOLUTO GMBH, Berlin (DE)

( * ) Notice: Subject to any disclaimer, the term of this patent is extended or adjusted under 35 U.S.C. 154(b) by 0 days.

(21) Appl. No.: 15/719,085

(22) Filed: Sep. 28, 2017

(65) Prior Publication Data

US 2018/0092799 A1 Apr. 5, 2018

(30) Foreign Application Priority Data

Oct. 5, 2016 (DE) ..... 10 2016 118 911

(51) Int. Cl.
*A61H 19/00* (2006.01)
*A61H 9/00* (2006.01)

(52) U.S. Cl.
CPC ..... *A61H 19/34* (2013.01); *A61H 9/0007* (2013.01); *A61H 9/0057* (2013.01); *A61H 9/0071* (2013.01); *A61H 2009/0064* (2013.01); *A61H 2201/0111* (2013.01); *A61H 2201/0153* (2013.01); *A61H 2201/0157* (2013.01); *A61H 2201/0165* (2013.01); *A61H 2201/1207* (2013.01); *A61H 2201/1215* (2013.01); *A61H 2201/1246* (2013.01); *A61H 2201/1409* (2013.01); *A61H 2201/149* (2013.01); *A61H 2201/1418* (2013.01); *A61H 2201/1664* (2013.01); *A61H 2201/5015* (2013.01);
(Continued)

(58) Field of Classification Search
CPC ..... A61H 19/30; A61H 19/34; A61H 23/00; A61H 2201/0157; A61H 9/0071; A61H 19/00; A61H 19/44; A61H 2005/412; A61F 5/41
See application file for complete search history.

(56) References Cited

U.S. PATENT DOCUMENTS 15,626 A 8/1856 Tillotson
787,443 A 4/1905 Godman et al.
(Continued)

FOREIGN PATENT DOCUMENTS

AU 2011351297 7/2013
AU 2014323661 3/2016
(Continued)

OTHER PUBLICATIONS

Document submitted in opposition of German Patent No. 102013110501.7 on Jan. 24, 2018; 34 pages.
(Continued)

*Primary Examiner* — Christine H Matthews
(74) *Attorney, Agent, or Firm* — Hanley, Flight & Zimmerman, LLC

(57) ABSTRACT

The invention relates to a stimulation device for the clitoris, having the following: a housing which is formed to be substantially pin-shaped; a pressure field generation device having a drive unit that generates a pressure field in a hollow space made of temporally alternating negative and positive pressures, and a control device which controls the drive unit; wherein the housing has a longitudinal axis which extends from a front end of the housing up to a back end of the housing, and wherein an opening is provided in the front end of the housing for placing over the clitoris, and wherein the hollow chamber is arranged inside the housing and is connected to the opening of the housing.

30 Claims, 23 Drawing Sheets

(52) U.S. Cl.
CPC ..... *A61H 2201/5043* (2013.01); *A61H 2201/5097* (2013.01)

(56) References Cited

U.S. PATENT DOCUMENTS

| | | | |
|---|---|---|---|
| 809,810 | A | 1/1906 | Jost |
| 847,360 | A | 3/1907 | Osius |
| 1,042,058 | A | 10/1912 | Van Hook |
| 1,378,922 | A | 5/1921 | Ward |
| 1,502,440 | A | 7/1924 | Robert |
| 1,730,535 | A | 10/1929 | Rudolph |
| 1,732,310 | A | 10/1929 | Naibert |
| 1,805,675 | A | 5/1931 | Rudolph |
| 1,882,040 | A | 10/1932 | Roehm |
| 1,898,652 | A | 2/1933 | Williams |
| 1,914,290 | A | 6/1933 | Popkin |
| 1,941,665 | A | 1/1934 | De Walt |
| 1,964,590 | A | 6/1934 | Friederich |
| 1,998,696 | A | 4/1935 | Andis |
| 2,017,284 | A | 10/1935 | Lembright |
| 2,052,098 | A | 8/1936 | Lockett |
| 2,064,418 | A | 12/1936 | Derringer |
| 2,076,410 | A | 4/1937 | McGerry |
| 2,112,646 | A | 3/1938 | Bear Biederman |
| 2,154,427 | A | 4/1939 | Andres |
| 2,189,116 | A | 2/1940 | Niemiec |
| 2,218,081 | A | 10/1940 | Brichieri-Colombi et al. |
| 2,218,443 | A | 10/1940 | Tweddle |
| 2,234,102 | A | 3/1941 | Andres |
| 2,314,590 | A | 3/1943 | McCarty |
| 2,470,660 | A | 5/1949 | Snyder |
| 2,519,790 | A | 8/1950 | Quinn |
| 2,561,034 | A | 7/1951 | Phillips |
| 2,661,736 | A | 12/1953 | Schwartz |
| 2,674,994 | A | 4/1954 | Murphy |
| 3,396,720 | A | 8/1968 | Shigeyuki |
| 3,818,904 | A | 6/1974 | Kawada |
| 3,906,940 | A | 9/1975 | Kawada |
| 3,910,262 | A | 10/1975 | Stoughton |
| 4,088,128 | A | 5/1978 | Mabuchi |
| 4,203,431 | A | 5/1980 | Abura et al. |
| 4,312,350 | A | 1/1982 | Doan |
| 4,428,368 | A | 1/1984 | Torii |
| 4,900,316 | A | 2/1990 | Yamamoto |
| 5,003,966 | A | 4/1991 | Saka et al. |
| D323,034 | S | 1/1992 | Reinstein |
| D329,563 | S | 9/1992 | Rasmussen |
| D351,236 | S | 10/1994 | Held |
| 5,377,701 | A | 1/1995 | Fang |
| 5,377,702 | A | 1/1995 | Sakurai |
| D359,563 | S | 6/1995 | Chi |
| 5,501,650 | A | 3/1996 | Gellert |
| 5,593,381 | A | 1/1997 | Tannenbaum et al. |
| 5,647,837 | A | 7/1997 | McCarty |
| 5,662,593 | A | 9/1997 | Tillman et al. |
| 5,690,603 | A | 11/1997 | Kain |
| 5,693,002 | A | 12/1997 | Tucker et al. |
| 5,725,473 | A | 3/1998 | Taylor |
| 5,813,973 | A | 9/1998 | Gloth |
| D402,905 | S | 12/1998 | Kanza et al. |
| D414,582 | S | 9/1999 | Hwang |
| D419,893 | S | 2/2000 | Cheng |
| 6,099,463 | A | 8/2000 | Hockhalter |
| 6,319,211 | B1 | 11/2001 | Ito et al. |
| D463,862 | S | 10/2002 | Lau |
| 6,464,653 | B1 | 10/2002 | Hovland et al. |
| 6,517,511 | B2 | 2/2003 | Yao |
| D478,385 | S | 8/2003 | Dirks et al. |
| 6,723,060 | B2 | 4/2004 | Miller |
| 6,758,826 | B2 | 7/2004 | Luettgen et al. |
| 6,733,438 | B1 | 11/2004 | Dann et al. |
| D509,301 | S | 9/2005 | Talbot et al. |
| 6,949,067 | B1 | 9/2005 | Dann et al. |
| D510,441 | S | 10/2005 | Harris, Jr. et al. |
| 6,964,643 | B2 | 11/2005 | Hovland et al. |
| D523,561 | S | 6/2006 | Telford |
| D523,562 | S | 6/2006 | Telford |
| D523,963 | S | 6/2006 | Telford |
| 7,079,898 | B2 | 7/2006 | Cohn |
| D545,446 | S | 6/2007 | Wu |
| 7,318,811 | B1 | 1/2008 | Corbishley |
| 7,534,203 | B2 | 5/2009 | Gil |
| D609,361 | S | 2/2010 | McGarry et al. |
| D612,510 | S | 3/2010 | Byle |
| 7,682,321 | B2 | 3/2010 | Naldoni |
| D613,417 | S | 4/2010 | Imboden et al. |
| D621,950 | S | 8/2010 | Seki et al. |
| 7,828,717 | B2 | 11/2010 | Lee |
| D637,308 | S | 5/2011 | Imboden et al. |
| D637,309 | S | 5/2011 | Park |
| 7,967,740 | B2 | 6/2011 | Mertens et al. |
| D649,657 | S | 11/2011 | Petersen et al. |
| D652,523 | S | 1/2012 | Bradley et al. |
| 8,147,399 | B2 | 4/2012 | Gloth |
| D665,091 | S | 8/2012 | Mistry et al. |
| D666,303 | S | 8/2012 | Ding et al. |
| D671,226 | S | 11/2012 | Aulwes et al. |
| 8,382,656 | B1 | 2/2013 | Brown |
| D681,225 | S | 4/2013 | Chen |
| D681,842 | S | 5/2013 | Chang |
| D689,382 | S | 9/2013 | Juhng et al. |
| D692,570 | S | 10/2013 | Luzon et al. |
| 8,568,342 | B2 | 10/2013 | Shaviv |
| D693,247 | S | 11/2013 | Juhng et al. |
| 8,579,837 | B1 | 11/2013 | Makower et al. |
| D704,345 | S | 5/2014 | Tai |
| D706,440 | S | 6/2014 | Hahr et al. |
| D706,441 | S | 6/2014 | Hahr et al. |
| D706,444 | S | 6/2014 | Hahr et al. |
| D708,440 | S | 7/2014 | Owen et al. |
| 8,821,421 | B2 | 9/2014 | Imboden et al. |
| D723,707 | S | 3/2015 | Matsuura |
| D723,711 | S | 3/2015 | Elliott |
| 9,022,925 | B2 | 5/2015 | Nan |
| RE45,585 | E | 6/2015 | Peddicord |
| D739,951 | S | 9/2015 | Tai |
| 9,132,058 | B2 | 9/2015 | Imboden et al. |
| D759,256 | S | 6/2016 | Chen |
| D759,261 | S | 6/2016 | Son et al. |
| RE46,163 | E | 9/2016 | Peddicord |
| D768,309 | S | 10/2016 | Hetzel |
| D768,310 | S | 10/2016 | Hetzel |
| D771,389 | S | 11/2016 | Since |
| D771,828 | S | 11/2016 | Sedic |
| D772,419 | S | 11/2016 | Courtion et al. |
| D773,061 | S | 11/2016 | Loebel et al. |
| D773,065 | S | 11/2016 | Driscoll et al. |
| 9,486,388 | B2 | 11/2016 | Wright, Jr. |
| 9,498,404 | B2 | 11/2016 | Murison |
| D773,160 | S | 12/2016 | Mokos et al. |
| D773,823 | S | 12/2016 | Wong |
| D793,571 | S | 8/2017 | Iurchenko |
| D794,854 | S | 8/2017 | Zepter |
| D796,054 | S | 8/2017 | Chen |
| D796,055 | S | 8/2017 | Chen |
| 9,737,457 | B2 | 8/2017 | Allen |
| 9,737,458 | B1 | 8/2017 | Olivares et al. |
| D797,302 | S | 9/2017 | Vahlensieck et al. |
| 9,763,851 | B2 | 9/2017 | Lenke |
| D802,784 | S | 11/2017 | Lee |
| D804,332 | S | 12/2017 | Lim et al. |
| D805,781 | S | 12/2017 | Szymanski et al. |
| 9,849,061 | B2 | 12/2017 | Lenke |
| D809,150 | S | 1/2018 | Nolasco et al. |
| D809,170 | S | 1/2018 | Marzynski |
| 9,855,186 | B2 | 1/2018 | Goldenberg et al. |
| D809,945 | S | 2/2018 | Prommel et al. |
| 9,937,097 | B2 | 4/2018 | Lenke |
| D822,843 | S | 7/2018 | Lenke |
| D825,073 | S | 8/2018 | Lenke |
| 2001/0041848 | A1 | 11/2001 | Ito et al. |
| 2002/0120219 | A1 | 8/2002 | Hovland et al. |
| 2002/0198488 | A1 | 12/2002 | Yao |
| 2003/0114804 | A1 | 6/2003 | Putzer |

(56) References Cited

U.S. PATENT DOCUMENTS

| | | | |
|---|---|---|---|
| 2003/0176817 | A1 | 9/2003 | Chang |
| 2004/0102822 | A1 | 5/2004 | Cohn |
| 2004/0193079 | A1 | 9/2004 | Siddhartha |
| 2004/0236254 | A1 | 11/2004 | Nichols |
| 2004/0260209 | A1 | 12/2004 | Ella et al. |
| 2004/0260212 | A1 | 12/2004 | Cho |
| 2005/0159684 | A1 | 7/2005 | Ikadai |
| 2005/0159760 | A1 | 7/2005 | Ikadai et al. |
| 2006/0089572 | A1 | 4/2006 | Byon |
| 2006/0116612 | A1 | 6/2006 | Drysdale |
| 2007/0100259 | A1 | 5/2007 | Nan |
| 2008/0071138 | A1 | 3/2008 | Mertens et al. |
| 2008/0091060 | A1 | 4/2008 | Heilman |
| 2008/0106896 | A1 | 5/2008 | Liu et al. |
| 2008/0275386 | A1 | 11/2008 | Myers |
| 2008/0304984 | A1 | 12/2008 | Chan |
| 2008/0312674 | A1 | 12/2008 | Chen et al. |
| 2009/0038069 | A1 | 2/2009 | Heilman |
| 2009/0048581 | A1 | 2/2009 | Sebban |
| 2009/0099413 | A1 | 4/2009 | Kobashikawa et al. |
| 2009/0118573 | A1 | 5/2009 | Tsao |
| 2009/0275796 | A1 | 11/2009 | Gil |
| 2010/0056963 | A1 | 3/2010 | Shaviv |
| 2010/0298745 | A1 | 11/2010 | Liu et al. |
| 2011/0034837 | A1 | 2/2011 | Lee |
| 2011/0098613 | A1 | 4/2011 | Thomas et al. |
| 2011/0230802 | A1 | 9/2011 | Nan |
| 2011/0295162 | A1 | 12/2011 | Chang |
| 2012/0330097 | A1 | 12/2012 | Lee |
| 2013/0012769 | A1 | 1/2013 | Carlson |
| 2013/0116503 | A1 | 5/2013 | Mertens et al. |
| 2013/0226050 | A1 | 8/2013 | Lee |
| 2013/0237751 | A1 | 9/2013 | Alexander |
| 2013/0261385 | A1 | 10/2013 | Zipper |
| 2014/0046127 | A1 | 2/2014 | Topolovac et al. |
| 2014/0088351 | A1 | 3/2014 | Murison |
| 2014/0088468 | A1 | 3/2014 | Murison |
| 2014/0088470 | A1 | 3/2014 | Topolovac et al. |
| 2014/0142374 | A1 | 5/2014 | Makower et al. |
| 2014/0179994 | A1 | 6/2014 | Topolovac et al. |
| 2014/0236151 | A1 | 8/2014 | Lee |
| 2014/0309565 | A1 | 10/2014 | Allen |
| 2014/0350333 | A1 | 11/2014 | Stout |
| 2015/0105609 | A1 | 4/2015 | Jochum |
| 2015/0133832 | A1 | 5/2015 | Courtion ..... A61F 7/00 601/18 |
| 2015/0133833 | A1 | 5/2015 | Bradley et al. |
| 2015/0164678 | A1 | 6/2015 | Lee et al. |
| 2015/0196455 | A1 | 7/2015 | Mertens et al. |
| 2015/0328081 | A1 | 11/2015 | Goldenberg et al. |
| 2015/0351999 | A1 | 12/2015 | Brouse |
| 2015/0366751 | A1 | 12/2015 | Stemple |
| 2016/0022533 | A1 | 1/2016 | Makower et al. |
| 2016/0045392 | A1 | 2/2016 | Massey et al. |
| 2016/0058509 | A1 | 3/2016 | Van De Wouw et al. |
| 2016/0074276 | A1 | 3/2016 | Scheuring et al. |
| 2016/0120375 | A1 | 5/2016 | Philips |
| 2016/0120737 | A1 | 5/2016 | Sedic |
| 2016/0136036 | A1 | 5/2016 | Cai |
| 2016/0151236 | A1 | 6/2016 | Makower et al. |
| 2016/0175186 | A1 | 6/2016 | Shadduck |
| 2016/0213557 | A1 | 7/2016 | Lenke |
| 2016/0235621 | A1 | 8/2016 | Choe |
| 2016/0296417 | A1 | 10/2016 | Topolovac et al. |
| 2017/0027809 | A1 | 2/2017 | Lenke |
| 2017/0027810 | A1 | 2/2017 | Murison |
| 2017/0065483 | A1 | 3/2017 | Lenke |
| 2017/0095399 | A1 | 4/2017 | Lee |
| 2017/0135895 | A1 | 5/2017 | Jafri |
| 2017/0156971 | A1 | 6/2017 | Topolovac et al. |
| 2017/0196801 | A1 | 7/2017 | Ghazvini et al. |
| 2017/0202731 | A1 | 7/2017 | Goldfarb et al. |
| 2017/0216135 | A1 | 8/2017 | Lenke |
| 2017/0281457 | A1 | 10/2017 | Witt |
| 2017/0319430 | A1 | 11/2017 | Shadduck |
| 2018/0031089 | A1 | 2/2018 | Wong et al. |
| 2018/0031090 | A1 | 2/2018 | Wong et al. |
| 2018/0071167 | A1 | 3/2018 | Lee |
| 2018/0092799 | A1 | 4/2018 | Lenke |
| 2018/0125748 | A1 | 5/2018 | Goldenberg et al. |
| 2018/0153764 | A1 | 6/2018 | Lenke |
| 2018/0243161 | A1 | 8/2018 | Lenke |
| 2018/0243162 | A1 | 8/2018 | Lenke |
| 2019/0083354 | A1 | 3/2019 | Pahl |
| 2020/0046599 | A1 | 2/2020 | Sedic |
| 2020/0188221 | A1 | 6/2020 | Lenke |
| 2020/0237609 | A1 | 7/2020 | Kirsten et al. |
| 2020/0281808 | A1 | 9/2020 | Kirsten et al. |

FOREIGN PATENT DOCUMENTS

| | | | |
|---|---|---|---|
| AU | 2015386680 | | 9/2017 |
| AU | 2018200317 | | 2/2018 |
| CA | 2923526 | | 3/2015 |
| CA | 2978495 | A1 | 9/2016 |
| CA | 2943097 | | 10/2017 |
| CH | 329193 | | 4/1958 |
| CN | 2153351 | | 1/1994 |
| CN | 2153351 | Y | 1/1994 |
| CN | 2198900 | Y | 5/1995 |
| CN | 2765609 | | 3/2006 |
| CN | 201119979 | | 9/2008 |
| CN | 101848688 | A | 9/2010 |
| CN | 102151219 | A | 8/2011 |
| CN | 202154785 | U | 3/2012 |
| CN | 102600034 | A | 7/2012 |
| CN | 102743275 | A | 10/2012 |
| CN | 102743276 | A | 10/2012 |
| CN | 103517697 | A | 1/2014 |
| CN | 103961246 | A | 8/2014 |
| CN | 104248500 | A | 12/2014 |
| CN | 104284648 | | 1/2015 |
| CN | 204931954 | U | 1/2016 |
| CN | 105616124 | | 6/2016 |
| CN | 205494128 | U | 8/2016 |
| CN | 107137218 | | 9/2017 |
| CN | 108599516 | | 9/2018 |
| DE | 582196 | | 8/1933 |
| DE | 1463673 | U | 4/1939 |
| DE | 1703184 | U | 7/1955 |
| DE | 7237890 | | 3/1973 |
| DE | 3222467 | A1 | 12/1983 |
| DE | 3515691 | A1 | 2/1986 |
| DE | 3515691 | C2 | 8/1990 |
| DE | 9309994.0 | | 11/1993 |
| DE | 4243876 | A1 | 6/1994 |
| DE | 4304091 | | 8/1994 |
| DE | 69108892 | | 12/1995 |
| DE | 29809041 | | 11/1998 |
| DE | 10011289 | A1 | 9/2001 |
| DE | 20112384 | U1 | 10/2001 |
| DE | 20106065 | | 11/2001 |
| DE | 19853353 | C2 | 5/2002 |
| DE | 202005004843 | U1 | 7/2005 |
| DE | 102004017702 | A1 | 10/2005 |
| DE | 102006016401 | | 8/2007 |
| DE | 102005042092 | | 10/2007 |
| DE | 202012005414 | U1 | 8/2012 |
| DE | 102013100943 | | 7/2014 |
| DE | 212013000027 | U1 | 9/2014 |
| DE | 102013110501 | A1 | 3/2015 |
| DE | 202015005041 | | 10/2015 |
| DE | 202015105689 | U1 | 11/2015 |
| DE | 102016105019 | | 7/2017 |
| EP | 0365230 | A2 | 4/1990 |
| EP | 0472965 | | 3/1992 |
| EP | 0503027 | | 4/1995 |
| EP | 1477149 | | 11/2004 |
| EP | 1554947 | B1 | 7/2005 |
| EP | 1143909 | | 6/2008 |
| EP | 2042147 | A1 | 4/2009 |
| EP | 2645979 | | 10/2013 |
| EP | 2712601 | A1 | 4/2014 |
| EP | 2777680 | A1 | 9/2014 |

(56) References Cited

FOREIGN PATENT DOCUMENTS

| | | | |
|---|---|---|---|
| EP | 2895135 | | 7/2015 |
| EP | 3031438 | | 6/2016 |
| EP | 3260106 | | 12/2017 |
| EP | 3305266 | | 4/2018 |
| EP | 3357383 | | 8/2018 |
| EP | 2976057 | | 12/2018 |
| GB | 191018973 | | 11/1910 |
| GB | 1049972 | | 11/1966 |
| GB | 1060507 | | 3/1967 |
| JP | 53135768 | | 11/1978 |
| JP | 53149442 | | 12/1978 |
| JP | 54115952 | B2 | 9/1979 |
| JP | 57099986 | A | 6/1982 |
| JP | H05037234 | U | 5/1993 |
| JP | 2555943 | | 11/1997 |
| JP | 2000197518 | A | 7/2000 |
| JP | 2005288079 | A | 10/2005 |
| JP | 2008-125577 | | 6/2008 |
| KR | 20-2000-0002800 | | 2/2000 |
| KR | 10-2001-0093088 | | 10/2001 |
| RU | 2014059 | | 6/1994 |
| RU | 2005134513 | | 4/2006 |
| TW | 201507719 | A | 3/2015 |
| TW | 201542190 | A | 11/2015 |
| TW | 201603797 | A | 2/2016 |
| WO | 9205758 | A1 | 4/1992 |
| WO | 2000/28939 | A2 | 5/2000 |
| WO | 2004004610 | A1 | 1/2004 |
| WO | 2004058134 | | 7/2004 |
| WO | 2005061042 | | 7/2005 |
| WO | 2005099366 | | 10/2005 |
| WO | 2005110331 | | 11/2005 |
| WO | 2006058291 | A2 | 6/2006 |
| WO | 2006063461 | A1 | 6/2006 |
| WO | 2007119034 | | 10/2007 |
| WO | 2007121107 | | 10/2007 |
| WO | 2008028076 | A2 | 3/2008 |
| WO | 2008107902 | | 9/2008 |
| WO | 2009012172 | | 1/2009 |
| WO | 2009087627 | | 7/2009 |
| WO | 2011146948 | | 11/2011 |
| WO | 2012152297 | | 11/2012 |
| WO | 2013003954 | | 1/2013 |
| WO | 2013067367 | | 5/2013 |
| WO | 2013134388 | | 9/2013 |
| WO | 2013138658 | | 9/2013 |
| WO | 2013178223 | A2 | 12/2013 |
| WO | 2014047718 | A1 | 4/2014 |
| WO | 2014048884 | | 4/2014 |
| WO | 2014081600 | | 5/2014 |
| WO | 2014085736 | A1 | 6/2014 |
| WO | 2014127531 | | 8/2014 |
| WO | 2014131110 | A1 | 9/2014 |
| WO | 2015039787 | A1 | 3/2015 |
| WO | 2015060717 | | 4/2015 |
| WO | 2015096179 | | 7/2015 |
| WO | 2015101790 | | 7/2015 |
| WO | 2016146206 | | 9/2016 |
| WO | 2016172653 | | 10/2016 |
| WO | 2017141037 | | 8/2017 |
| WO | 2017158107 | | 9/2017 |
| WO | 2018065540 | | 4/2018 |
| WO | 2019158240 | | 8/2019 |
| WO | 2019192660 | | 10/2019 |
| WO | 2019192661 | | 10/2019 |

OTHER PUBLICATIONS

Examination Report dated Dec. 20, 2017 from Australian Patent Application No. 2017228536; 5 pages.
Search Report dated Mar. 5, 2018 from European Patent Appln. No. EP17202394.7, 4 pgs.
Search report dated Mar. 8, 2018 from European Patent Appln. No. EP14741640.8, 6 pgs.
Office Action dated Jan. 25, 2018 from Canadian Patent Appln. No. 2,978,739, 5 pgs.
Office Action dated Mar. 1, 2018 from New Zealand Patent Appln. No. 735370, 5 pgs.
Partial International Search report dated Mar. 6, 2018 from PCT Patent Appln. No. PCT/EP2017/075400, 21 pgs.
Partial International Search Report dated Mar. 1, 2018 from PCT Patent Appln. No. PCT/EP2017/075399, 16 pgs.
Maria M. Kettenring, "Erotische Partnermassage", Grafe und User Publishers, 2004, 4 pgs.
"Sex hilft gegen Erkaltung," Focus Online, Dec. 5, 2004; 2 pgs.
"Gesundheitsminister. Mehr Sex gegen Bluthochdrucl," http://www.heilpraxisnet.delnaturheilpraxis/sex-gegen-bluthochdruck-665.php, Apr. 2010, 2 pgs.
International Search report dated Sep. 25, 2014, in connection with International Patent Application No. PCT/EP2014/065734, 13 pgs.
International Search Report and Written Opinion dated Jul. 22, 2016, in connection with International Patent Application No. PCT/EP2015/067017, 22 pgs.
Nonfinal Office Action dated Feb. 24, 2017, in connection with U.S. Appl. No. 15/354,599, 38 pgs.
Nonfinal Office Action dated Aug. 26, 2016, in connection with U.S. Appl. No. 15/023,471, 25 pgs.
Final Office Action dated Jan. 6, 2017, in connection with U.S. Appl. No. 15/023,471, 28 pgs.
"Pump.", Merriam-Webster.com, Merriam-Webster, 2016, Dec. 26, 2016, 1 pg.
"Can.", Thefreedoctionary.com, The free dictionary by Farlex, 2016, Dec. 26, 2016, 1 pg.
"Valve.", Merriam-Webster.com, Merriam-Webster, 2016, Dec. 26, 2016, 1 pg.
Office Action dated Jun. 12, 2018, in connection with Canadian Patent Application No. 2,978,739; 4 pgs.
Search Report dated Apr. 27, 2018, in connection with European Patent Application No. 17190856, 4 pgs., An English translation of this document, or portion thereof, is not within the possession, custody, or control of, or is not readily available to any individual designated in § 1.56(c).
Search Report and Written Opinion dated May 18, 2018, in connection with Singapore Patent Application No. 10201707736X; 8 pgs.
International Search Report dated May 7, 2018, in connection with PCT Patent Application No. PCT/EP2017/075400; 11 pgs.
International Search Report dated Apr. 17, 2018, in connection with PCT Patent Application No. PCT/EP2017/075399; 9 pgs.
Non-Final Office Action dated Jun. 29, 2018, in connection with U.S. Appl. No. 15/965,208; 31 pgs.
Final Office Action dated Jun. 28, 2018, in connection with U.S. Appl. No. 15/354,599; 39 pgs.
Non-Final Office Action dated Nov. 13, 2018, in connection with U.S. Appl. No. 15/354,599; 34 pgs.
New Zealand Further Examination Report dated Aug. 23, 2018, in connection with New Zealand Patent Application No. 735229; 4 pgs.
Singapore Written Opinion dated Jul. 24, 2018, in connection with Singapore Patent Application No. 11201707395T; 8 pgs.
Australian Statement of Grounds and Particulars of Opposition dated Sep. 21, 2018, in connection with an opposition against Australian Patent Application No. 2015386680; 11 pgs.
Taiwan Office Action dated Aug. 9, 2018, in connection with Taiwan Patent Application No. 106132654, 3 pgs.
Final Office Action dated Dec. 6, 2018, in connection with U.S. Appl. No. 15/965,117, 15 pgs.
Final Office Action dated Dec. 10, 2018, in connection with U.S. Appl. No. 15/965,208, 19 pgs.
Australian Patent Office, "Examination Report," issued in connection with Australian Application No. 2018200852, dated Dec. 19, 2018, 4 pages.
United States Patent and Trademark Office, "Non-Final Office action," issued in connection with U.S. Appl. No. 15/888,568, dated Jan. 10, 2019, 18 pages.
International Searching Authority, "International Search Report and Written Opinion," issued in connection with International Applica-

(56) References Cited

OTHER PUBLICATIONS tion No. PCT/EP20181082681, dated Jan. 30, 2019, 21 pages. (includes English machine translation of pp. 13 to 17).
United States Patent and Trademark Office, "Notice of Allowance and Fee(s) Due," issued in connection with U.S. Appl. No. 15/023,471, dated May 12, 2017, 48 pages.
United States Patent and Trademark Office, "Non-Final Office action," issued in connection with U.S. Appl. No. 15/302,981, dated Jun. 2, 2017, 38 pages.
United States Patent and Trademark Office, "Non-Final Office action," issued in connection with U.S. Appl. No. 15/487,123, dated Jun. 2, 2017, 16 pages.
United States Patent and Trademark Office, "Final Office action," issued in connection with U.S. Appl. No. 15/354,599, dated Sep. 12, 2017, 47 pages.
United States Patent and Trademark Office, "Final Office action," issued in connection with U.S. Appl. No. 15/487,123, dated Sep. 29, 2017, 9 pages.
United States Patent and Trademark Office, "Notice of Allowance and Fee(s) Due," issued in connection with U.S. Appl. No. 15/302,981, dated Oct. 12, 2017, 12 pages.
United States Patent and Trademark Office, "Notice of Allowance and Fee(s) Due," issued in connection with U.S. Appl. No. 15/487,123, dated Dec. 11, 2017, 18 pages.
United States Patent and Trademark Office, "Non-Final Office action," issued in connection with U.S. Appl. No. 15/354,599 dated Dec. 29, 2017, 46 pages.
United States Patent and Trademark Office, "Corrected Notice of Allowability," issued in connection with U.S. Appl. No. 15/487,123, dated Mar. 13, 2018, 6 pages.
United States Patent Trademark Office, "Non-Final Office action," issued in connection with U.S. Appl. No. 15/965,117, dated Jun. 29, 2018, 36 pages.
United States Patent and Trademark Office, "Supplemental Notice of Allowability," issued in connection with U.S. Appl. No. 15/302,981, dated Nov. 17, 2017, 7 pages.
Zimmerman et al., "The Gentle Touch Receptors of Mammalian Skin," Special Section: Skin, Science, Nov. 21, 2014, vol. 346, Issue 6212, 6 pages.
Verkauf, MD. et al., "Clitoral Size in Normal Women," Obstetrics & Gynecology, vol. 80, No. 1, Jul. 1992, 4 pages.
IP Australia, "Notice of Acceptance for Patent Application," issued in connection with Australian Application No. 2017228536, dated Jun. 21, 2018, 3 pages.
China National Intellectual Property Administration, "First Office Action," issued in connection with Chinese Application No. 201710927530.4, dated Mar. 25, 2019, 5 pages. (English Translation Included.).
IP Australia, "Examination Report No. 1 for Standard Patent Application," issued in connection with Australian Application No. 2015386680, dated Nov. 15, 2017, 3 pages.
IP Australia, "Examination Report No. 1 for Standard Patent Application," issued in connection with Australian Application No. 2015203659, dated Dec. 14, 2018, 2 pages.
Canadian Patent Office, "Office Action," issued in connection with Canadian Application No. 2,978,495, dated Nov. 20, 2017, 4 pages.
Canadian Patent Office, "Office Action," issued in connection with Canadian Application No. 2,978,495, dated Apr. 11, 2018, 4 pages.
China National Intellectual Property Administration, "First Office Action," issued in connection with Chinese Application No. 201580077725.3, dated Feb. 3, 2019, 5 pages (includes English translation).
New Zealand Intellectual Property Office, "First Examination Report," issued in connection with NZ Application No. 735229, dated May 2, 2018, 4 pages.
United States Patent and Trademark Office, "Notice of Allowance and Fee(s) Due," issued in connection with Design U.S. Appl. No. 35/502,986, dated May 1, 2018, 19 pages. (Copy not provided as this is a USPTO document. Copy will be provided upon request by Examiner.).
New Zealand Intellectual Property Office, "Further Examination Report," issued in connection with NZ Application No. 735229, dated Dec. 17, 2018, 3 pages.
IP Australia, "Examination Report No. 1 for Standard Patent Application," issued in connection with Australian Patent Application No. 2014323661, dated Mar. 2, 2017, 4 pages.
IP Australia, "Examination Report No. 1 for Standard Patent Application," issued in connection with Australian Application No. 2018200852, dated Feb. 15, 2018, 5 pages.
Canadian Patent Office, "Office Action," issued in connection with Candian Patent Application No. 2,923,526, dated May 24, 2018, 5 pages.
Canadian Patent Office, "Office Action," issued in connection with Candian Patent Application No. 2,923,526, dated Oct. 16, 2018, 3 pages.
China National Intellectual Property Administration, "First Office Action," issued in connection with Chinese Patent Application No. 201480052194.8, dated Sep. 28, 2016, 7 pages. (English Translation Included.).
China National Intellectual Property Administration, "Second Office Action," issued in connection with Chinese Patent Application No. 201480052194.8, dated Mar. 3, 2017, 10 pages. (English Translation Included.).
China National Intellectual Property Administration, "Third Office Action," issued in connection with Chinese Patent Application No. 201480052194.8, dated Jul. 4, 2017, 11 pages. (English Translation Included.).
China National Intellectual Property Administration, "First Office Action," issued in connection with Chinese Patent Application No. 201710709587.7, dated Feb. 28, 2019, 5 pages. (English Translation Included.).
United States Patent and Trademark Office, "Notice of Allowance and Fee(s) Due," issued in connection with Design U.S. Appl. No. 29/590,450, dated May 8, 2018, 24 pages. (Copy not provided as this is a USPTO document. Copy will be provided upon request by Examiner.).
International Searching Authority, "Written Opinion," issued in connection with International Application No. PCT/EP2017/075400, dated May 18, 2018, 10 pages.
International Searching Authority, "International Search Report," issued in connection with International Application No. PCT/EP2017/075400, dated May 18, 2018, 6 pages.
German Patent and Trademark Office, "Examination Report," issued in connection with German Application No. 10 2016 118 911.1, dated Nov. 4, 2016, 10 pages. (English translation included.).
European Patent Office, "European Search Report," issued in connection with European Application No. 17190856.9, dated May 14, 2018, 30 pages. (English translation included.).
European Patent Office, "European Search Report," issued in connection with European Application No. 17190856.9, dated Feb. 2, 2018, 34 pages. (English translation included.).
The International Bureau of WIPO, "International Report on Patentability," issued in connection with International Application No. PCT/EP2017/075399, dated Apr. 9, 2019, 15 pages.
International Searching Authority, "Written Opinion," issued in connection with International Application No. PCT/EP2017/075399, dated Apr. 25, 2018, 14 pages.
International Searching Authority, "International Search Report," issued in connection with International Application No. PCT/EP2017/075399, dated Apr. 25, 2018, 9 pages.
German Pateent and Trademark Office, "Examination Report," issued in connection with German Application No. 10 2015 103 694.0, dated Mar. 24, 2015, 8 pages. (English translation included.).
German Pateent and Trademark Office, "Examination Report," issued in connection with German Application No. 10 2015 103 694.0, dated Dec. 7, 2016, 12 pages. (English translation included.).
European Patent Office, "European Search Report," issued in connection with European Patent Application No. 18175171.0, dated Sep. 14, 2018, 28 pages. (English translation included.).
European Patent Office, "Notification under Article 94 (3) EPC," issued in connection with European Application No. 18175171.0, dated Jun. 14, 2019, 8 pages. (English translation included.).

(56) References Cited

OTHER PUBLICATIONS

The International Bureau of WIPO, "International Report on Patentability," issued in connection with International Application No. PCT/EP2015/067017, dated Sep. 19, 2017, 13 pages (corresponds to English translation of Written Opinion for International Application No. PCT/EP2015/067017 dated Jul. 22, 2016, cited herein as NPL33).
German Patent and Trademark Office, "Office Action," issued in connection with German Patent Application No. 10 2013 110 501.7, dated Oct. 1, 2013, 8 pages. (English translation included.).
German Patent and Trademark Office, "Office Action," issued in connection with German Patent Application No. 10 2013 110 501.7, dated Apr. 15. 2014, 8 pages. (English translation included.).
German Patent and Trademark Office, "Office Action," issued in connection with German Patent Application No. 10 2013 110 501.7, dated Feb. 6, 2015, 10 pages. (English translation included.).
German Patent and Trademark Office, "Office Action," issued in connection with German Patent Application No. 10 2013 110 501.7, dated Nov. 18, 2015, 8 pages. (English translation included.).
German Patent and Trademark Office, "Office Action," issued in connection with German Patent Application No. 10 2013 022 511.6, dated May 9, 2019, 16 pages. (English translation included.).
German Patent and Trademark Office, "Office Action," issued in connection with German Patent Application No. 10 2013 022 512.4, dated May 3, 2019, 14 pages. (English translation included.).
German Patent and Trademark Office, "Office Action," issued in connection with German Patent Application No. 10 2013 022 520.5, dated May 9, 2019, 14 pages. (English translation included.).
European Patent Office, "Notification under Article 94 (3) EPC," issued in connection with European Application No. 14741640.8, dated Aug. 23, 2016, 8 pages. (English translation included.).
European Patent Office, "Notification under Article 94 (3) EPC," issued in connection with European Application No. 14741640.8, dated Mar. 8, 2018, 12 pages. (English translation included.).
European Patent Office, "Notification under Article 94 (3) EPC," issued in connection with European Application No. 17202385.5, dated May 18, 2018, 12 pages. (English translation included.).
European Patent Office, "Results of the Consultation" issued in connection with European Application No. 17202385.5, dated Jul. 18, 2018, 6 pages. (English translation included.).
European Patent Office, "Search Report," issued in connection with European Application No. 17202385.5, dated Mar. 8, 2018, 6 pages. (English translation included.).
European Patent Office, "Notification under Article 94 (3) EPC," issued in connection with European Application No. 17202394.7, dated May 18, 2018, 12 pages. (English translation included.).
European Patent Office, "Result of the Consultation," issued in connection with European Application No. 17202394.7, dated Jul. 18, 2018, 6 pages. (English translation included.).
European Patent Office, "Search Report," issued in connection with European Application No. 17202394.7, dated Mar. 8, 2018, 8 pages. (English translation included.).
European Patent Office, "Notification under Article 94 (3) EPC," issued in connection with European Application No. 18206800.7, dated Apr. 8, 2019, 10 pages. (English translation included.).
European Patent Office, "Search Report," issued in connection with European Application No. 18206800.7, dated Feb. 27, 2019, 8 pages. (English translation included.).
International Searching Authority, "International Search Report and Written Opinion of the International Searching Authority," issued in connection with International Application No. PCT/EP2014/065734, dated Sep. 25, 2014, 19 pages. (English Translation Included.).
The International Bureau of WIPO, "International Preliminary Report on Patentability," issued in connection with International Application No. PCT/EP2014/065734, dated Mar. 26, 2016, 7 pages (corresponds to English translation of Written Opinion for International Application No. PCT/EP2014/065734 dated Sep. 25, 2014, cited herein as NPL31).
The International Bureau of WIPO, "International Search Report and Written Opinion," issued in connection with International Application No. PCT/EP2015/067017, dated Jul. 22, 2016, 34 pages (English translation included).
European Patent Office, "Examination Report," issued in connection with application No. 15748202.7 dated Jun. 24, 2019, 8 pages. (English translation included.).
"Petition for Inter Partes Review of U.S. Pat. No. 9,937,097," filed with the United States Patent and Trademark Office dated Jul. 3, 2019, 95 pages.
"Petition for Inter Partes Review of U.S. Pat. No. 9,937,097," Exhibit 1001, filed with the United States Patent and Trademark Office dated Jul. 3, 2019, 18 pages.
"Petition for Inter Partes Review of U.S. Pat. No. 9,937,097," Exhibit 1002, filed with the United States Patent and Trademark Office dated Jul. 3, 2019, 215 pages.
"Petition for Inter Partes Review of U.S. Pat. No. 9,937,097," Exhibit 1003, filed with the United States Patent and Trademark Office dated Jul. 3, 2019, 360 pages.
"Petition for Inter Partes Review of U.S. Pat. No. 9,937,097," Exhibit 1004, filed with the United States Patent and Trademark Office dated Jul. 3, 2019, 9 pages.
"Petition for Inter Partes Review of U.S. Pat. No. 9,937,097," Exhibit 1005, filed with the United States Patent and Trademark Office dated Jul. 3, 2019, 34 pages.
"Petition for Inter Partes Review of U.S. Pat. No. 9,937,097," Exhibit 1006, filed with the United States Patent and Trademark Office dated Jul. 3, 2019, 13 pages.
"Petition for Inter Partes Review of U.S. Pat. No. 9,937,097," Exhibit 1007, filed with the United States Patent and Trademark Office dated Jul. 3, 2019, 11 pages.
"Petition for Inter Partes Review of U.S. Pat. No. 9,937,097," Exhibit 1008, filed with the United States Patent and Trademark Office dated Jul. 3, 2019, 46 pages.
"Petition for Inter Partes Review of U.S. Pat. No. 9,937,097," Exhibit 1009, filed with the United States Patent and Trademark Office dated Jul. 3, 2019, 1837 pages. (Uploaded in 4 parts.).
"Petition for Inter Partes Review of U.S. Pat. No. 9,937,097," Exhibit 1010, filed with the United States Patent and Trademark Office dated Jul. 3, 2019, 17 pages.
"Petition for Inter Partes Review of U.S. Pat. No. 9,937,097," Exhibit 1011, filed with the United States Patent and Trademark Office dated Jul. 3, 2019, 6 pages.
"Petition for Inter Partes Review of U.S. Pat. No. 9,937,097," Exhibit 1012, filed with the United States Patent and Trademark Office dated Jul. 3, 2019, 47 pages.
"Petition for Inter Partes Review of U.S. Pat. No. 9,937,097," Exhibit 1013, filed with the United States Patent and Trademark Office dated Jul. 3, 2019, 61 pages.
"Petition for Inter Partes Review of U.S. Pat. No. 9,937,097," Exhibit 1014, filed with the United States Patent and Trademark Office dated Jul. 3, 2019, 5 pages.
"Petition for Inter Partes Review of U.S. Pat. No. 9,937,097," Exhibit 1015, filed with the United States Patent and Trademark Office dated Jul. 3, 2019, 1049 pages.
"Minutes of the Public Hearing in Opposition Proceedings Before the Patent Division 44 of the German Patent and Trademark Office," issued in connection with opposition of German Patent No. 10 2013 110 501.7, dated Apr. 17, 2018, 6 pages (includes English translation).
United Stapes Patent and Trademark Office, "Non-Final Office Action," issued in connection with U.S. Appl. No. 15/965,117, dated Jun. 27, 2019, 15 pages.
"Petition for Inter Partes Review of U.S. Pat. No. 9,763,851," filed with the United States Patent and Trademark Office dated Jul. 31, 2019, 87 pages.
"Petition for Inter Partes Review of U.S. Pat. No. 9,763,851," Exhibit 1001, filed with the United States Patent and Trademark Office dated Jul. 3, 2019, 17 pages.
"Petition for Inter Partes Review of U.S. Pat. No. 9,763,851," Exhibit 1002, filed with the United States Patent and Trademark Office dated Jul. 31, 2019, 109 pages.

(56) References Cited

OTHER PUBLICATIONS

"Petition for Inter Partes Review of U.S. Pat. No. 9,763,851," Exhibit 1003 Part 1, filed with the United States Patent and Trademark Office dated Jul. 31, 2019, 649 pages.
"Petition for Inter Partes Review of U.S. Pat. No. 9,763,851," Exhibit 1003 Part 2, filed with the United States Patent and Trademark Office dated Jul. 31, 2019, 663 pages.
"Petition for Inter Partes Review of U.S. Pat. No. 9,763,851," Exhibit 1004, filed with the United States Patent and Trademark Office dated Jul. 31, 2019, 11 pages.
"Petition for Inter Partes Review of U.S. Pat. No. 9,763,851," Exhibit 1005, filed with the United States Patent and Trademark Office dated Jul. 31, 2019, 34 pages.
"Petition for Inter Partes Review of U.S. Pat. No. 9,763,851," Exhibit 1006, filed with the United States Patent and Trademark Office dated Jul. 31, 2019, 46 pages.
"Petition for Inter Partes Review of U.S. Pat. No. 9,763,851," Exhibit 1007, filed with the United States Patent and Trademark Office dated Jul. 31, 2019, 36 pages.
"Petition for Inter Partes Review of U.S. Pat. No. 9,763,851," Exhibit 1008, filed with the United States Patent and Trademark Office dated Jul. 31, 2019, 46 pages.
"Petition for Inter Partes Review of U.S. Pat. No. 9,763,851," Exhibit 1009, filed with the United States Patent and Trademark Office dated Jul. 31, 2019, 5 pages.
"Petition for Inter Partes Review of U.S. Pat. No. 9,763,851," Exhibit 1010, filed with the United States Patent and Trademark Office dated Jul. 31, 2019, 61 pages.
"Petition for Inter Partes Review of U.S. Pat. No. 9,763,851," Exhibit 1011, filed with the United States Patent and Trademark Office dated Jul. 31, 2019, 6 pages.
"Petition for Inter Partes Review of U.S. Pat. No. 9,763,851," Exhibit 1012, filed with the United States Patent and Trademark Office dated Jul. 31, 2019, 1049 pages. (Uploaded in 3 parts.).
United States Patent and Trademark Office, "Non-Final Office Action," issued in connection with U.S. Appl. No. 15/965,208, dated Aug. 22, 2019, 17 pages.
United States Patent and Trademark Office, "Notice of Allowance," issued in connection with U.S. Appl. No. 15/354,599, dated Aug. 29, 2019, 19 pages.
United States Patent and Trademark Office, "Notice of Allowance and Fee(s) Due," issued in connection with Design U.S. Appl. No. 35/502,986, dated May 1, 2018, 19 pages.
United States Patent and Trademark Office, "Notice of Allowance and Fee(s) Due," issued in connection with Design U.S. Appl. No. 29/590,450, dated May 8, 2018, 24 pages.
IP Australia, "Notice of Opposition," issued in connection with Australian Patent Application No. 2015386680 dated Jun. 21, 2018, 4 pages.
"Opponent's Letter," filed with IP Australia in connection with Australian Patent Application No. 2015386680 dated Jun. 28, 2019, 10 pages.
IP Australia, "General Correspondence," issued in connection with Australian Patent Application No. 2015386680 dated Jul. 24, 2019, 2 pages.
"Opponent's Letter," filed with IP Australia in connection with Australian Patent Application No. 2015386680 dated Aug. 7, 2019, 2 pages.
IP Australia, "Reg, 5.23," issued in connection with Australian Patent Application No. 2015386680 dated Aug. 16, 2019, 4 pages.
"Statement of Grounds and Particulars of Opposition," filed with IP Australia in connection with Australian Patent Application No. 201803659 dated Aug. 14, 2019, 15 pages.
"Exhibit D1," filed with IP Australia in connection with Australian Patent Application No. 201803659 dated Aug. 14, 2019, 9 pages.
"Exhibit D2," filed with IP Australia in connection with Australian Patent Application No. 201803659 dated Aug. 14, 2019, 9 pages.
"Exhibit D3," filed with IP Australia in connection with Australian Patent Application No. 201803659 dated Aug. 14, 2019, 51 pages.
"Exhibit D4," filed with IP Australia in connection with Australian Patent Application No. 201803659 dated Aug. 14, 2019, 6 pages.
"Exhibit D5," filed with IP Australia in connection with Australian Patent Application No. 201803659 dated Aug. 14, 2019, 5 pages.
"Exhibit D6," filed with IP Australia in connection with Australian Patent Application No. 201803659 dated Aug. 14, 2019, 3 pages.
"Exhibit D7," filed with IP Australia in connection with Australian Patent Application No. 201803659 dated Aug. 14, 2019, 28 pages.
"Exhibit D8," filed with IP Australia in connection with Australian Patent Application No. 201803659 dated Aug. 14, 2019, 8 pages.
"Exhibit D9," filed with IP Australia in connection with Australian Patent Application No. 201803659 dated Aug. 14, 2019, 11 pages.
"Exhibit D10," filed with IP Australia in connection with Australian Patent Application No. 201803659 dated Aug. 14, 2019, 33 pages.
"Exhibit D11," filed with IP Australia in connection with Australian Patent Application No. 201803659 dated Aug. 14, 2019, 2 pages.
"Exhibit D12," filed with IP Australia in connection with Australian Patent Application No. 201803659 dated Aug. 14, 2019, 9 pages.
IP Australia, "Opposition—Statement or Grounds and Particulars," issued in connection with Australian Patent Application No. 2018203659 dated Aug. 15, 2019, 1 page.
*Eis, Inc.* v. *Wow Tech International GmbH*, "First Amended Complaint," filed with the United States District Court for the District of Delware, case No. 1:19-cv-01227-LPS, Sep. 9, 2019, 40 pages.
*Eis, Inc.* v. *Wow Tech International GmbH*, "First Amended Complaint—Exhibits 1-31," filed with the United States District Court for the District of Delware, case No. 1:19-cv-01227-LPS, Sep. 9, 2019, 527 pages.
"Notification of an Opposition," issued by the European Patent Office in connection with European Patent No. EP2976057 dated Sep. 12, 2019, opposition filed by EIS GmbH, 132 pages (includes English translation).
"Notification of an Opposition," issued by the European Patent Office in connection with European Patent No. EP2970657 dated Sep. 10, 2019, opposition filed by Fun Factory Ltd., 117 pages (includes English translation).
"Notification of an Opposition," issued by the European Patent Office in connection with European Patent No. EP2970657 dated Sep. 12, 2019, opposition filed by Hu Xiaorong, 35 pages (includes English translation).
"Opposition to a European Patent," filed with the European Patent Office by EIS GmbH in connection with European Patent No. EP3308762 dated Sep. 11, 2019, 95 pages (includes English translation).
"Opposition to a European Patent," filed with the European Patent Office by Fun Factory Ltd. in connection with European Patent No. EP3308762 dated Sep. 11, 2019, 124 pages (includes English translation).
"Petition for Inter Partes Review of U.S. Pat. No. 9,849,061," filed with the United States Patent and Trademark Office dated Oct. 2, 2019, 97 pages.
"Petition for Inter Partes Review of U.S. Pat. No. 9,849,061," Exhibit 1001, filed with the United States Patent and Trademark Office dated Oct. 2, 2019, 18 pages.
"Petition for Inter Partes Review of U.S. Pat. No. 9,849,061," Exhibit 1002, filed with the United States Patent and Trademark Office dated Oct. 2, 2019, 137 pages. (Uploaded in 5 parts).
"Petition for Inter Partes Review of U.S. Pat. No. 9,849,061," Exhibit 1003, filed with the United States Patent and Trademark Office dated Oct. 2, 2019, 1,367 pages. (Uploaded in 5 parts).
"Petition for Inter Partes Review of U.S. Pat. No. 9,849,061," Exhibit 1004, filed with the United States Patent and Trademark Office dated Oct. 2, 2019, 9 pages.
"Petition for Inter Partes Review of U.S. Pat. No. 9,849,061," Exhibit 1006, filed with the United States Patent and Trademark Office dated Oct. 2, 2019, 34 pages.
"Petition for Inter Partes Review of U.S. Pat. No. 9,849,061," Exhibit 1007, filed with the United States Patent and Trademark Office dated Oct. 2, 2019, 22 pages.
"Petition for Inter Partes Review of U.S. Pat. No. 9,849,061," Exhibit 1008, filed with the United States Patent and Trademark Office dated Oct. 2, 2019, 40 pages.

(56) References Cited

OTHER PUBLICATIONS

"Petition for Inter Partes Review of U.S. Pat. No. 9,849,061," Exhibit 1010, filed with the United States Patent and Trademark Office dated Oct. 2, 2019, 5 pages.
"Petition for Inter Partes Review of U.S. Pat. No. 9,849,061," Exhibit 1011, filed with the United States Patent and Trademark Office dated Oct. 2, 2019, 17 pages.
"Petition for Inter Partes Review of U.S. Pat. No. 9,849,061," Exhibit 1012, filed with the United States Patent and Trademark Office dated Oct. 2, 2019, 61 pages.
"Petition for Inter Partes Review of U.S. Pat. No. 9,849,061," Exhibit 1013, filed with the United States Patent and Trademark Office dated Oct. 2, 2019, 46 pages.
IP Australia, "Examination Report," issued in connection with Australian Application No. 2018222907 dated Sep. 3, 2019, 4 pages.
IP Australia, "Examination Report," issued in connection with Australian Application No. 2019201070 dated Jul. 9, 2019, 4 pages.
Korean Patent Office, "Office Action," issued in connection with Korean Application No. 10-2017-0129112 dated Aug. 29, 2019, 9 pages, (includes English summary of Office action).
Korean Patent Office, "Office Action," issued in connection with Korean Application No. 10-2017-7028845 dated Sep. 18, 2019, 7 pages, (includes English summary of Office action).
European Patent Office, "Notice of Submission of Third Party Observation," issued in connection with European Application No. EP170202394.7 dated Jul. 9, 2019, 5 pages (copy of submission in English).
"Opposition Document," filed with the German Patent and Trademark Office in connection with opposition of German Patent No. 102013110501.7 dated Jan. 24, 2018, 69 pages (includes English translation).
"English Translation of Grounds of Appeal," filed with the German Patent and Trademark Office in connection with opposition of German Patent No. 102013110501.7 dated Dec. 21, 2018, 44 pages (includes English translation of Exhibit B1).
"English Translation of Exhibit B2 of Grounds of Appeal," filed with the German Patent and Trademark in connection with opposition of German Patent No. 102013110501.7 dated Dec. 21, 2018, 11 pages.
United States Patent and Trademark Office, "Final Office Action," issued in connection with U.S. Appl. No. 15/888,568 dated Oct. 29, 2019, 7 pages.
United States Patent and Trademark Office, "Corrected Notice of Allowability," issued in connection with U.S. Appl. No. 15/354,599 dated Nov. 12, 2019, 2 pages.
German Patent and Trademark Office, "English Translation of Invitation to Speak," issued in connection with opposition of German Patent No. 102013110501.7 dated Nov. 17, 2016, 20 pages.
"English Translation of Patentee Submission," filed with the German Patent and Trademark Office in connection with opposition of German Patent No. 102013110501.7 dated Sep. 18, 2017, 38 pages.
"English Translation of Submission of Opponent," filed with the German Patent and Trademark Office in connection with opposition of German Patent No. 102013110501.7 dated Oct. 5, 2017, 6 pages.
"English Translation of Submission of Opponent," filed with the German Patent and Trademark Office in connection with opposition of German Patent No. 102013110501.7 dated Nov. 13, 2017, 8 pages.
German Patent and Trademark Office, "English Translation of Summons to Attend Oral Proceedings," issued in connection with opposition of German Patent No. 102013110501.7 dated Nov. 28, 2017, 3 pages.
"English Translation of Patentee Submission," filed with the German Patent and Trademark Office in connection with opposition of German Patent No. 102013110501.7 dated Jan. 30, 2018, 5 pages.
German Patent and Trademark Office, "English Translation of Additions to Summons," issued in connection with opposition of German Patent No. 102013110501.7 dated Nov. 24, 2017, 1 page.
German Patent and Trademark Office, "English Translation of Summons to Attend Oral Proceedings," issued in connection with opposition of German Patent No. 102013110501.7 dated Feb. 2, 2018, 3 pages.
"English Translation of Opponent Submission," filed with the German Patent and Trademark Office in connection with opposition of German Patent No. 102013110501.7 dated Mar. 14, 2018, 5 pages.
"English Translation of Patentee Submission," filed with the German Patent and Trademark Office in connection with opposition of German Patent No. 102013110501.7 dated Apr. 3, 2018, 2 pages.
"English Translation of Patentee Submission," filed with the German Patent and Trademark Office, in connection with opposition of German Patent No. 102013110501.7 dated Apr. 12, 2018, 45 pages.
"English Translation of Auxiliary Request 1," filed with the German Patent and Trademark Office in connection with opposition of German Patent No. 2013110501.7 dated Apr. 16, 2018, 5 pages.
"English Translation of Auxiliary Request 2," filed with the German Patent and Trademark Office in connection with opposition of German Patent No. 2013110501.7 dated Apr. 16, 2018, 6 pages.
"English Translation of Auxiliary Request 3," filed with the German Patent and Trademark Office in connection with opposition of German Patent No. 2013110501.7 dated Apr. 16, 2018, 5 pages.
*Novoluto GmbH* v. *EIS GmbH*, "Judgment," issued by the German Court in connection with German litigation proceeding on Dec. 14, 2017, 71 pages (includes English translation).
*Novoluto GmbH* v. *EIS GmbH*, "Transcript," filed with the German Court in connection German litigation proceeding on Jul. 20, 2017, 44 pages (includes English translation).
*Novoluto GmbH* v. *EIS GmbH*, "Complaint," filed the German Court in connection German litigation proceeding on Aug. 5, 2016, 75 pages (includes English translation).
United States Patent and Trademark Office, "Notice of Filing Date Accorded to Petition and Time for Filing Patent Owner Preliminary Response," issued in connection with Case IPR2019-01302 dated Jul.18, 2019, 5 pages.
"Patent Owner's Amended Mandatory Notices Pursuant to 37 C.F.R. 42.8," filed with the United States Patent and Trademark Office in connection with Case IPR2019-01302 dated Sep. 3, 2019, 6 pages.
"Patent Owner's Amended Mandatory Notices Pursuant to 37 C.F.R. 42.8," filed with the United States Patent and Trademark Office in connection with Case IPR2019-01302 dated Sep. 30, 2019, 6 pages.
"Patent Owner's Amended Mandatory Notices Pursuant to 37 C.F.R. 42.8," filed with the United States Patent and Trademark Office in connection with Case IPR2019-01302 dated Oct. 18, 2019, 6 pages.
"Patent Owner's Mandatory Notices," filed with the United States Patent and Trademark Office in connection with Case IPR2019-01302 dated Jul. 24, 2019, 4 pages.
"Patent Owner's Updated Mandatory Notices," filed with the United States Patent and Trademark Office in connection with Case IPR2019-01302 dated Aug. 21, 2019, 4 pages.
"Petitioner's Amended Mandatory Notices Pursuant to 37 C.F.R. 42.8," filed with the United States Patent and Trademark Office in connection with Case IPR2019-01302 dated Oct. 8, 2019, 5 pages.
"Patent Owner's Preliminary Response Pursuant to 37 C.F.R. § 42.107," filed with the United States Patent and Trademark Office in connection with Case IPR2019-01302 dated Oct. 18, 2019, 85 pages.
"Patent Owner's Preliminary Response Pursuant to 37 C.F.R. § 42.107," Exhibit 2001, filed with the United States Patent and Trademark Office in connection with Case IPR2019-01302 dated Oct. 18, 2019, 80 pages.
"Patent Owner's Preliminary Response Pursuant to 37 C.F.R. § 42.107," Exhibit 2002, filed with the United States Patent and Trademark Office in connection with Case IPR2019-01302 dated Oct. 18, 2019, 30 pages.
"Patent Owner's Preliminary Response Pursuant to 37 C.F.R. § 42.107," Exhibit 2003, filed with the United States Patent and Trademark Office in connection with Case IPR2019-01302 dated Oct. 18, 2019, 18 pages.

(56) References Cited

OTHER PUBLICATIONS

"Patent Owner's Preliminary Response Pursuant to 37 C.F.R. § 42.107," Exhibit 2004, filed with the United States Patent and Trademark Office in connection with Case IPR2019-01302 dated Oct. 18, 2019, 47 pages.
"Patent Owner's Preliminary Response Pursuant to 37 C.F.R. § 42.107," Exhibit 2005, filed with the United States Patent and Trademark Office in connection with Case IPR2019-01302 dated Oct. 18, 2019, 60 pages.
"Patent Owner's Preliminary Response Pursuant to 37 C.F.R. § 42.107," Exhibit 2006, filed with the United States Patent and Trademark Office in connection with Case IPR2019-01302 dated Oct. 18, 2019, 19 pages.
"Patent Owner's Preliminary Response Pursuant to 37 C.F.R. § 42.107," Exhibit 2007, filed with the United States Patent and Trademark Office in connection with Case IPR2019-01302 dated Oct. 18, 2019, 16 pages.
"Patent Owner's Preliminary Response Pursuant to 37 C.F.R. § 42.107," Exhibit 2008, filed with the United States Patent and Trademark Office in connection with Case IPR2019-01302 dated Oct. 18, 2019, 10 pages.
"Patent Owner's Preliminary Response Pursuant to 37 C.F.R. § 42.107," Exhibit 2009, filed with the United States Patent and Trademark Office in connection with Case IPR2019-01302 dated Oct. 18, 2019, 12 pages.
"Patent Owner's Preliminary Response Pursuant to 37 C.F.R. § 42.107," Exhibit 2010, filed with the United States Patent and Trademark Office in connection with Case IPR2019-01302 dated Oct. 18, 2019, 9 pages.
"Patent Owner's Preliminary Response Pursuant to 37 C.F.R. § 42.107," Exhibit 2011, filed with the United States Patent and Trademark Office in connection with Case IPR2019-01302 dated Oct. 18, 2019, 2 pages.
"Patent Owner's Preliminary Response Pursuant to 37 C.F.R. § 42.107," Exhibit 2012, filed with the United States Patent and Trademark Office in connection with Case IPR2019-01302 dated Oct. 18, 2019, 7 pages.
"Patent Owner's Preliminary Response Pursuant to 37 C.F.R. § 42.107," Exhibit 2013, filed with the United States Patent and Trademark Office in connection with Case IPR2019-01302 dated Oct. 18, 2019, 4 pages.
"Patent Owner's Preliminary Response Pursuant to 37 C.F.R. § 42.107," Exhibit 2014, filed with the United States Patent and Trademark Office in connection with Case IPR2019-01302 dated Oct. 18, 2019, 77 pages.
"Patent Owner's Preliminary Response Pursuant to 37 C.F.R. § 42.107," Exhibit 2015, filed with the United States Patent and Trademark Office in connection with Case IPR2019-01302 dated Oct. 18, 2019, 76 pages.
"Patent Owner's Preliminary Response Pursuant to 37 C.F.R. § 42.107," Exhibit 2016, filed with the United States Patent and Trademark Office in connection with Case 1PR2019-01302 dated Oct. 18, 2019, 169 pages.
"Patent Owner's Preliminary Response Pursuant to 37 C.F.R. § 42.107," Exhibit 2017, filed with the United States Patent and Trademark Office in connection with Case IPR2019-01302 dated Oct. 18, 2019, 40 pages.
"Patent Owner's Preliminary Response Pursuant to 37 C.F.R. § 42.107," Exhibit 2018, filed with the United States Patent and Trademark Office in connection with Case IPR2019-01302 dated Oct. 18, 2019, 15 pages.
"Patent Owner's Preliminary Response Pursuant to 37 C.F.R. § 42.107," Exhibit 2019, filed with the United States Patent and Trademark Office in connection with Case IPR2019-01302 dated Oct. 18, 2019, 8 pages.
"Patent Owner's Preliminary Response Pursuant to 37 C.F.R. § 42.107," Exhibit 2020, filed with the United States Patent and Trademark Office in connection with Case IPR2019-01302 dated Oct. 18, 2019, 11 pages.
"Patent Owner's Preliminary Response Pursuant to 37 C.F.R. § 42.107," Exhibit 2021, filed with the United States Patent and Trademark Office in connection with Case IPR2019-01302 dated Oct. 18, 2019, 25 pages.
"Patent Owner's Preliminary Response Pursuant to 37 C.F.R. § 42.107," Exhibit 2022, filed with the United States Patent and Trademark Office in connection with Case IPR2019-01302 dated Oct. 18, 2019, 97 pages.
"Patent Owner's Preliminary Response Pursuant to 37 C.F.R. § 42.107," Exhibit 2023, filed with the United States Patent and Trademark Office in connection with Case IPR2019-01302 dated Oct. 18, 2019, 4 pages.
"Patent Owner's Preliminary Response Pursuant to 37 C.F.R. § 42.107," Exhibit 2024, filed with the United States Patent and Trademark Office in connection with Case IPR2019-01302 dated Oct. 18, 2019, 7 pages.
"Patent Owner's Preliminary Response Pursuant to 37 C.F.R. § 42.107," Exhibit 2025, filed with the United States Patent and Trademark Office in connection with Case IPR2019-01302 dated Oct. 18, 2019, 1 page.
United States Patent and Trademark Office, "Notice of Filing Date Accorded to Petition and Time for Filing Patent Owner Preliminary Response," issued in connection with Case IPR2019-01444 dated Aug. 14, 2019, 6 pages.
"Patent Owner's Amended Mandatory Notices Pursuant to 37 C.F.R. 42.8," filed with the United States Patent and Trademark Office in connection with case IPR2019-01444 dated Aug. 26, 2019, 6 pages.
"Patent Owner's Amended Mandatory Notices Pursuant to 37 C.F.R. 42.8," filed with the United States Patent and Trademark Office in connection with case IPR2019-01444 dated Sep. 30, 2019, 6 pages.
"Patent Owner's Amended Mandatory Notices Pursuant to 37 C.F.R. 42.8," filed with the United States Patent and Trademark Office in connection with case IPR2019-01444 dated Oct. 23, 2019, 6 pages.
"Petitioner's Mandatory Notices," filed with the United States Patent and Trademark Office in connection with case IPR2019-01444 dated Aug. 21, 2019, 5 pages.
"Petitioner's Amended Mandatory Notices," filed with the United States Patent and Trademark Office in connection with case IPR2019-01444 dated Oct. 8, 2019, 5 pages.
"Patent Owner's Preliminary Response Pursuant to 37 C.F.R. § 42.107," filed with the United States Patent and Trademark Office in connection with case IPR2019-01444 dated Nov. 14, 2019, 88 pages.
"Patent Owner's Preliminary Response Pursuant to 37 C.F.R. § 42.107," Exhibit 2001, filed with the United States Patent and Trademark Office in connection with Case IPR2019-01444 dated Nov. 14, 2019, 81 pages.
"Patent Owner's Preliminary Response Pursuant to 37 C.F.R. § 42.107," Exhibit 2002, filed with the United States Patent and Trademark Office in connection with Case IPR2019-01444 dated Nov. 14, 2019, 36 pages.
"Patent Owner's Preliminary Response Pursuant to 37 C.F.R. § 42.107," Exhibit 2003, filed with the United States Patent and Trademark Office in connection with Case IPR2019-01444 dated Nov. 14, 2019, 18 pages.
"Patent Owner's Preliminary Response Pursuant to 37 C.F.R. § 42.107," Exhibit 2004, filed with the United States Patent and Trademark Office in connection with Case IPR2019-01444 dated Nov. 14, 2019, 97 pages.
"Patent Owner's Preliminary Response Pursuant to 37 C.F.R. § 42.107," Exhibit 2005, filed with the United States Patent and Trademark Office in connection with Case 1PR2019-01444 dated Nov. 14, 2019, 61 pages.
"Patent Owner's Preliminary Response Pursuant to 37 C.F.R. § 42.107," Exhibit 2006, filed with the United States Patent and Trademark Office in connection with Case IPR2019-01444 dated Nov. 14, 2019, 60 pages.

(56) References Cited

OTHER PUBLICATIONS

"Patent Owner's Preliminary Response Pursuant to 37 C.F.R. § 42.107," Exhibit 2007, filed with the United States Patent and Trademark Office in connection with Case 1PR2019-01444 dated Nov. 14, 2019, 22 pages.
"Patent Owner's Preliminary Response Pursuant to 37 C.F.R. § 42.107," Exhibit 2008, filed with the United.States Patent and Trademark Office in connection with Case IPR2019-01444 dated Nov. 14, 2019, 12 pages.
"Patent Owner's Preliminary Response Pursuant to 37 C.F.R. § 42.107," Exhibit 2009, filed with the United States Patent and Trademark Office in connection with Case 1PR2019-01444 dated Nov. 14, 2019, 7 pages.
"Patent Owner's Preliminary Response Pursuant to 37 C.F.R. § 42.107," Exhibit 2010, filed with the United States Patent and Trademark Office in connection with Case 1PR2019-01444 dated Nov. 14, 2019, 16 pages.
"Patent Owner's Preliminary Response Pursuant to 37 C.F.R. § 42.107," Exhibit 2011, filed with the United States Patent and Trademark Office in connection with Case IPR2019-01444 dated Nov. 14, 2019, 10 pages.
"Patent Owner's Preliminary Response Pursuant to 37 C.F.R. § 42.107," Exhibit 2012, filed with the United States Patent and Trademark Office in connection with Case 1PR2019-01444 dated Nov. 14, 2019, 12 pages.
"Patent Owner's Preliminary Response Pursuant to 37 C.F.R. § 42.107," Exhibit 2013, filed with the United States Patent and Trademark Office in connection with Case IPR2019-01444 dated Nov. 14, 2019, 9 pages.
"Patent Owner's Preliminary Response Pursuant to 37 C.F.R. § 42.107," Exhibit 2014, filed with the United States Patent and Trademark Office in connection with Case IPR2019-01444 dated Nov. 14, 2019, 2 pages.
"Patent Owner's Preliminary Response Pursuant to 37 C.F.R. § 42.107," Exhibit 2015, filed with the United States Patent and Trademark Office in connection with Case 1PR2019-01444 dated Nov. 14, 2019, 4 pages.
"Patent Owner's Preliminary Response Pursuant to 37 C.F.R. § 42.107," Exhibit 2016, filed with the United States Patent and Trademark Office in connection with Case IPR2019-01444 dated Nov. 14, 2019, 172 pages.
"Patent Owner's Preliminary Response Pursuant to 37 C.F.R. § 42.107," Exhibit 2017, filed with the United States Patent and Trademark Office in connection with Case IPR2019-01444 dated Nov. 14, 2019, 40 pages.
"Patent Owner's Preliminary Response Pursuant to 37 C.F.R. § 42.107," Exhibit 2018, filed with the United States Patent and Trademark Office in connection with Case IPR2019-01444 dated Nov. 14, 2019, 153 pages.
"Patent Owner's Preliminary Response Pursuant to 37 C.F.R. § 42.107," Exhibit 2019, filed with the United States Patent and Trademark Office in connection with Case IPR2019-01444 dated Nov. 14, 2019, 4 pages.
"Patent Owner's Preliminary Response Pursuant to 37 C.F.R. § 42.107," Exhibit 2020, filed with the United States Patent and Trademark Office in connection with Case IPR2019-01444 dated Nov. 14, 2019, 3 pages.
"Patent Owner's Preliminary Response Pursuant to 37 C.F.R. § 42.107," Exhibit 2021, filed with the United States Patent and Trademark Office in connection with Case IPR2019-01444 dated Nov. 14, 2019, 7 pages.
"Patent Owner's Preliminary Response Pursuant to 37 C.F.R. § 42.107," Exhibit 2022, filed with the United States Patent and Trademark Office in connection with Case IPR2019-01444 dated Nov. 14, 2019, 11 pages.
"Patent Owner's Preliminary Response Pursuant to 37 C.F.R. § 42.107," Exhibit 2023, filed with the United States Patent and Trademark Office in connection with Case IPR2019-01444 dated Nov. 14, 2019, 8 pages.
"Patent Owner's Preliminary Response Pursuant to 37 C.F.R. § 42.107," Exhibit 2024, filed with the United States Patent and Trademark Office in connection with Case IPR2019-01444 dated Nov. 14, 2019, 20 pages.
"Patent Owner's Preliminary Response Pursuant to 37 C.F.R. § 42.107," Exhibit 2025, filed with the United States Patent and Trademark Office in connection with Case IPR2019-01444 dated Nov. 14, 2019, 3 pages.
"Patent Owner's Preliminary Response Pursuant to 37 C.F.R. § 42.107," Exhibit 2026, filed with the United States Patent and Trademark Office in connection with Case IPR2019-01444 dated Nov. 14, 2019, 9 pages.
"Patent Owner's Preliminary Response Pursuant to 37 C.F.R. § 42.107," Exhibit 2027, filed with the United States Patent and Trademark Office in connection with Case 1PR2019-01444 dated Nov. 14, 2019, 4 pages.
"Patent Owner's Preliminary Response Pursuant to 37 C.F.R. § 42.107," Exhibit 2028, filed with the United States Patent and Trademark Office in connection with Case 1PR2019-01444 dated Nov. 14, 2019, 7 pages.
"Patent Owner's Preliminary Response Pursuant to 37 C.F.R. § 42.107," Exhibit 2029, filed with the United States Patent and Trademark Office in connection with Case IPR2019-01444 dated Nov. 14, 2019, 3 pages.
"Patent Owner's Preliminary Response Pursuant to 37 C.F.R. § 42.107," Exhibit 2030, filed with the United States Patent and Trademark Office in connection with Case IPR2019-01444 dated Nov. 14, 2019, 4 pages.
"Patent Owner's Preliminary Response Pursuant to 37 C.F.R. § 42.107," Exhibit 2031, filed with the United States Patent and Trademark Office in connection with Case IPR2019-01444 dated Nov. 14, 2019, 7 pages.
"Patent Owner's Preliminary Response Pursuant to 37 C.F.R. § 42.107," Exhibit 2032, filed with the United States Patent and Trademark Office in connection with Case IPR2019-01444 dated Nov. 14, 2019, 4 pages.
"Patent Owner's Preliminary Response Pursuant to 37 C.F.R. § 42.107," Exhibit 2033, filed with the United States Patent and Trademark Office in connection with Case IPR2019-01444 dated Nov. 14, 2019, 25 pages.
"Patent Owner's Preliminary Response Pursuant to 37 C.F.R. § 42.107," Exhibit 2034, filed with the United States Patent and Trademark Office in connection with Case IPR2019-01444 dated Nov. 14, 2019, 3 pages.
United States Patent and Trademark Office, "Notice of Filing Date Accorded to Petition and Time for Filing Patent Owner Preliminary Response," issued in connection with Case IPR2020-00007 dated Oct. 8, 2019, 5 pages.
"Patent Owner's Amended Mandatory Notices Pursuant to 37 C.F.R. 42.8," filed with the United States Patent and Trademark Office in connection with case IPR2020-00007 dated Oct. 23, 2019, 6 pages.
*EIS, Inc.* v. *Wow Tech International GmbH*, "Declaration of Frank Ferrari in Support of Defendants, Wow Tech International GmbH, Wow Tech Canada Ltd., and Novoluto GmbH's Consolidated Motion to Dismiss," filed with the United States District Court for the District of Delaware in connection with Case No. 1:19-cv-1277-LPS on Oct. 2, 2019, 3 pages.
*EIS, Inc.* v. *Wow Tech International GmbH*, "Declaration of Florian Holst in Support of Defendants, Wow Tech International GmbH, Wow Tech Canada Ltd., and Novoluto GmbH's Consolidated Motion to Dismiss," filed with the United States District Court for the District of Delaware in connection with Case No. 1:19-cv-1277-LPS on Oct. 2, 2019, 3 pages.
*EIS, Inc.* v. *Wow Tech International GmbH*, "Declaration of Johannes Plettenberg in Support of Defendants, Wow Tech International GmbH, Wow Tech Canada Ltd., and Novoluto GmbH's Consolidated Motion to Dismiss," filed with the United States District Court for the District of Delaware in connection with Case No. 1:19-cv-1277-LPS on Oct. 2, 2019, 3 pages.
*EIS, Inc.* v. *Wow Tech International GmbH*, "Defendants' Consolidated Motion to Dismiss Eis, Inc.'s Complaint Pursuant to Federal Rules of Civil Procedure 12(B)(2) and 12(b)(6)," filed with the

(56) References Cited

OTHER PUBLICATIONS

United States District Court for the District of Delaware in connection with Case No. 1:19-cv-1227-LPS on Oct. 2, 2019, 3 pages.
*EIS, Inc.* v. *Wow Tech International GmbH*, "Defendants' Opening Brief in Support of their Consolidated Motion to Dismiss Pursuant to Federal Rules of Civil Procedure 12(B)(2) and 12(B)(6)," filed with the United States District Court for the District of Delaware in connection with Case No. 1:19-cv-1227-LPS on Oct. 2, 2019, 42 pages.
The International Bureau, "English Translation of International Report on Patentability," issued in connection with application No. PCT/EP2017/075400, dated Apr. 9, 2019, 12 pages.
Israel Patent Office, " Office Action," issued in connection with Israeli Patent Application No. 254607, dated Dec. 1, 2019, 6 pages (includes English translation).
Canadian Patent Office, "Office Action," issued in connection with application No. 3,051,672, dated Oct. 3, 2019, 7 pages.
United States Patent and Trademark Office, "Notice of Allowance," issued in connection with U.S. Appl. No. 15/354,599, dated Dec. 16, 2019, 21 pages.
"Patent Owner's Preliminary Response Pursuant to 37 C.F.R. § 42.107," filed with the United States Patent and Trademark Office in connection with case IPR2020-00007 dated Jan. 8, 2020, 87 pages.
"Patent Owner's Preliminary Response Pursuant to 37 C.F.R. § 42.107," Exhibit 2001, filed with the United States Patent and Trademark Office in connection with Case IPR2020-00007 dated Jan. 8, 2020, 72 pages.
"Patent Owner's Preliminary Response Pursuant to 37 C.F.R. § 42.107," Exhibit 2002, filed with the United States Patent and Trademark Office in connection with Case IPR2020-00007 dated Jan. 8, 2020, 36 pages.
"Patent Owner's Preliminary Response Pursuant to 37 C.F.R. § 42.107," Exhibit 2003, filed with the United States Patent and Trademark Office in connection with Case IPR2020-00007 dated Jan. 8, 2020, 3 pages.
"Patent Owner's Preliminary Response Pursuant to 37 C.F.R. § 42.107," Exhibit 2004, filed with the United States Patent and Trademark Office in connection with Case IPR2020-00007 dated Jan. 8, 2020, 62 pages.
"Patent Owner's Preliminary Response Pursuant to 37 C.F.R. § 42.107," Exhibit 2005, filed with the United States Patent and Trademark Office in connection with Case IPR2020-00007 dated Jan. 8, 2020, 60 pages.
"Patent Owner's Preliminary Response Pursuant to 37 C.F.R. § 42.107," Exhibit 2006, filed with the United States Patent and Trademark Office in connection with Case IPR2020-00007 dated Jan. 8, 2020, 4 pages.
"Patent Owner's Preliminary Response Pursuant to 37 C.F.R. § 42.107," Exhibit 2007, filed with the United States Patent and Trademark Office in connection with Case IPR2020-00007 dated Jan. 8, 2020, 5 pages.
"Patent Owner's Preliminary Response Pursuant to 37 C.F.R. § 42.107," Exhibit 2008, filed with the United States Patent and Trademark Office in connection with Case IPR2020-00007 dated Jan. 8, 2020, 10 pages.
"Patent Owner's Preliminary Response Pursuant to 37 C.F.R. § 42.107," Exhibit 2009, filed with the United States Patent and Trademark Office in connection with Case IPR2020-00007 dated Jan. 8, 2020, 4 pages.
"Patent Owner's Preliminary Response Pursuant to 37 C.F.R. § 42.107," Exhibit 2010, filed with the United States Patent and Trademark Office in connection with Case IPR2020-00007 dated Jan. 8, 2020, 14 pages.
"Patent Owner's Preliminary Response Pursuant to 37 C.F.R. § 42.107," Exhibit 2011, filed with the United States Patent and Trademark Office in connection with Case IPR2020-00007 dated Jan. 8, 2020, 16 pages.
"Patent Owner's Preliminary Response Pursuant to 37 C.F.R. § 42.107," Exhibit 2012, filed with the United States Patent and Trademark Office in connection with Case IPR2020-00007 dated Jan. 8, 2020, 12 pages.
"Patent Owner's Preliminary Response Pursuant to 37 C.F.R. § 42.107," Exhibit 2013, filed with the United States Patent and Trademark Office in connection with Case IPR2020-00007 dated Jan. 8, 2020, 9 pages.
"Patent Owner's Preliminary Response Pursuant to 37 C.F.R. § 42.107," Exhibit 2014, filed with the United States Patent and Trademark Office in connection with Case IPR2020-00007 dated Jan. 8, 2020, 2 pages.
"Patent Owner's Preliminary Response Pursuant to 37 C.F.R. § 42.107," Exhibit 2015, filed with the United States Patent and Trademark Office in connection with Case IPR2020-00007 dated Jan. 8, 2020, 7 pages.
"Patent Owner's Preliminary Response Pursuant to 37 C.F.R. § 42.107," Exhibit 2016, filed with the United States Patent and Trademark Office in connection with Case IPR2020-00007 dated Jan. 8, 2020, 4 pages.
"Patent Owner's Preliminary Response Pursuant to 37 C.F.R. § 42.107," Exhibit 2017, filed with the United States Patent and Trademark Office in connection with Case IPR2020-00007 dated Jan. 8, 2020, 77 pages.
"Patent Owner's Preliminary Response Pursuant to 37 C.F.R. § 42.107," Exhibit 2018, filed with the United States Patent and Trademark Office in connection with Case IPR2020-00007 dated Jan. 8, 2020, 76 pages.
"Patent Owner's Preliminary Response Pursuant to 37 C.F.R. § 42.107," Exhibit 2019, filed with the United States Patent and Trademark Office in connection with Case IPR2020-00007 dated Jan. 8, 2020, 169 pages.
"Patent Owner's Preliminary Response Pursuant to 37 C.F.R. § 42.107," Exhibit 2020, filed with the United States Patent and Trademark Office in connection with Case IPR2020-00007 dated Jan. 8, 2020, 40 pages.
"Patent Owner's Preliminary Response Pursuant to 37 C.F.R. § 42.107," Exhibit 2021, filed with the United States Patent and Trademark Office in connection with Case IPR2020-00007 dated Jan. 8, 2020, 7 pages.
"Patent Owner's Preliminary Response Pursuant to 37 C.F.R. § 42.107," Exhibit 2022, filed with the United States Patent and Trademark Office in connection with Case IPR2020-00007 dated Jan. 8, 2020, 6 pages.
"Patent Owner's Preliminary Response Pursuant to 37 C.F.R. § 42.107," Exhibit 2024, filed with the United States Patent and Trademark Office in connection with Case IPR2020-00007 dated Jan. 8, 2020, 8 pages.
"Patent Owner's Preliminary Response Pursuant to 37 C.F.R. § 42.107," Exhibit 2023, filed with the United States Patent and Trademark Office in connection with Case IPR2020-00007 dated Jan. 8, 2020, 3 pages.
"Patent Owner's Preliminary Response Pursuant to 37 C.F.R. § 42.107," Exhibit 2025, filed with the United States Patent and Trademark Office in connection with Case IPR2020-00007 dated Jan. 8, 2020, 3 pages.
"Patent Owner's Preliminary Response Pursuant to 37 C.F.R. § 42.107," Exhibit 2026, filed with the United States Patent and Trademark Office in connection with Case IPR2020-00007 dated Jan. 8, 2020, 13 pages.
"Patent Owner's Preliminary Response Pursuant to 37 C.F.R. § 42.107," Exhibit 2027, filed with the United States Patent and Trademark Office in connection with Case IPR2020-00007 dated Jan. 8, 2020, 4 pages.
"Patent Owner's Preliminary Response Pursuant to 37 C.F.R. § 42.107," Exhibit 2028, filed with the United States Patent and Trademark Office in connection with Case IPR2019-01444 dated Nov. 14, 2019, 7 pages.
"Patent Owner's Preliminary Response Pursuant to 37 C.F.R. § 42.107," Exhibit 2029, filed with the United States Patent and Trademark Office in connection with Case IPR2020-00007 dated Jan. 8, 2020, 25 pages.

(56) References Cited

OTHER PUBLICATIONS

"Patent Owner's Preliminary Response Pursuant to 37 C.F.R. § 42.107," Exhibit 2030, filed with the United States Patent and Trademark Office in connection with Case IPR2020-00007 dated Jan. 8, 2020, 3 pages.
"Patent Owner's Preliminary Response Pursuant to 37 C.F.R. § 42.107," Exhibit 2031, filed with the United States Patent and Trademark Office in connection with Case IPR2020-00007 dated Jan. 8, 2020, 4 pages.
"Decision Denying Institution of Inter Partes Review," issued by the United States Patent and Trademark Office in connection with Case IPR2019-01302 dated Jan. 13, 2020, 21 pages.
*EIS, Inc.* v. *Wow Tech International GmbH*, "Letter to the Honorable Leonard P. Stark from Jack B. Blumenfeld regarding Discovery Dispute," filed with the United States District Court for the District of Delaware in connection with Case No. 1:19-cv-1277-LPS on Dec. 5, 2019, 176 pages.
*EIS, Inc.* v. *Wow Tech International GmbH*, "Letter to the Honorable Leonard P. Stark from Paul D. Brown regarding Discovery Dispute," filed with the United States District Court for the District of Delaware in connection with Case No. 1:19-cv-1277-LPS on Dec. 6, 2019, 4 pages.
IP Australia, "Opposition—Evidence," issued in connection with Australian Patent Application No. 2018203659 dated Nov. 12, 2019, 1 page.
"Decision Denying Insitution of Inter Partes Review," issued by the United States Patent and Trademark Office in connection with Case IPR2019-01444 dated Feb. 10, 2020, 16 pages.
"Summary of Opponent's Submissions," filed with IP Austrailia in connection with Australian Patent Application No. 2015386680 dated Feb. 5, 2020, 39 pages.
*EIS, Inc.* v. *Wow Tech International GmbH*, "Defendant's Revised Motion to Dismiss EIS, Inc.'s Complaint Pursuant to Federal Rule of Civil Procedure 12(b)(6)," filed with the United States District Court for the District of Delaware in connection with Case No. 1:19-cv-1277-LPS on Feb. 4, 2020, 3 pages.
*EIS, Inc.* v. *Wow Tech International GmbH*, "Defendant's Opening Brief in Support of the Revised Motion to Dismiss Pursuant to Rule 12(b)(6)," filed with the United States District Court for the District of Delaware in connection with Case No. 1:19-cv-1277-LPS on Feb. 4, 2020, 30 pages.
*EIS, Inc.* v. *Wow Tech International GmbH*, Revised Motion to Dismiss Pursuant to Rule District of Delaware in connection with Case "Plaintiff EIS's Answering Brief in Opposition to Defendant's 12(b)(6)," filed with the United States District Court for the No. 1:19-cv-1277-LPS on Feb. 4, 2020, 33 pages.
"Evidence in Support," filed with IP Australia in connection with Australian Patent Application No. 2018203659 dated Nov. 8, 2019, 245 pages.
European Patent Office, "Extended European Search Report," issued in connection with European Patent Application No. EP 19161328.0, dated Jul. 18, 2019, 9 pages (includes English translation of written opinion).
European Patent Office, "Search Report," issued in connection with European Patent Application No. EP 19153494, dated Sep. 11, 2019, 2 pages.
"Petitioner's Request for Rehearing Under 37 C.F.R. 42.71," filed with the United States Patent and Trademark Office in connection with Case IPR2019-01302 dated Feb. 7, 2020, 20 pages.
"Petitioner's Amended Mandatory Notices Pursuant to 37 C.F.R. 42.8," filed with the United States Patent and Trademark Office in connection with Case IPR2019-01302 dated Feb. 25, 2020, 5 pages.
"Petitioner's Amended Mandatory Notices Pursuant to 37 C.F.R. 42.8," filed with the United States Patent and Trademark Office in connection with Case IPR2019-01444 dated Feb. 25, 2020, 5 pages.
"Petitioner's Request for Rehearing Under 37 C.F.R. 42.71," filed with the United States Patent and Trademark Office in connection with Case IPR2019-01444 dated Mar. 6, 2020, 19 pages.
United States Patent and Trademark Office, "Notice of Allowance," issued in connection with U.S. Appl. No. 15/965,208, dated Apr. 8, 2020, 9 pages.
*EIS, Inc.* v. *Wow Tech International GmbH*, "Defendant's Reply in Support of Their Revised Motion to Dismiss Pursuant to Rule 12(b)(6)," filed with the United States District Court for the District of Delaware in connection with Case No. 1:19-cv-01227-LPS on Mar. 10, 2020, 16 pages.
Canadian Patent Office, "Notice of Allowance," issued in connection with Canadian Patent Application No. 2978739, dated Jan. 30, 2020, 1 page.
United States Patent and Trademark Office, "Notice of Allowance," issued in connection with U.S. Appl. No. 15/965,117, dated Mar. 17, 2020, 9 pages.
Canadian Patent Office, "Office Action," issued in connecction with Candian Patent Application No. 3051672, dated Mar. 4, 2020, 4 pages.
United States Patent and Trademark Office, "Notice of Allowance," issued in connection with U.S. Appl. No. 15/354,599, dated Mar. 25, 2020, 21 pages.
Korean Patent Office, "Notice of Allowance," issued in connection with Korean Patent Application No. 10-2017-7028845, dated Mar. 30, 2020, 6 pages (includes English translation).
"Order," issued by the United States Patent and Trademark Office in connection with Case IPR 2019-01302 dated Apr. 6, 2020, 2 pages.
"Order," issued by the United States Patent and Trademark Office in connection with Case IPR 2019-01444 dated Apr. 6, 2020, 2 pages.
"Decision Denying Institution of Inter Partes Review," filed with the United States Patent and Trademark Office in connection with Case IPR 2020-00007 dated Apr. 6, 2020, 31 pages.
United States Patent and Trademark Office, "Final Office Action," issued in connection with U.S. Appl. No. 15/888,568, dated Apr. 16, 2020, 7 pages.
"Petitioners Amended Mandatory Notices Pursuant to 37 C.F.R. 42.8," filed with the United States Patent and Trademark Office in connection with Case IPR2020-00007 dated Feb. 25, 2020, 5 pages.
China National Intellectual Property Administration, "Second Office Action," issued in connection with Chinese Patent Application No. 201710927530.4, dated Apr. 16, 2020, 6 pages (English Translation Included).
"Petitioner's Request for Rehearing Under 37 C.F.R. 42.71," filed with the United States Patent and Trademark Office in connection with Case IPR 2020-00007 dated May 6, 2020, 20 pages.
"Petitioner's Amended Mandatory Notices Pursuant to 37 C.F.R. 42.8," filed with the United States Patent and Trademark Office in connection with Case IPR2019-01302 dated Apr. 17, 2020, 5 pages.
"Petitioner's Amended Mandatory Notices Pursuant to 37 C.F.R. 42.8," filed with the United States Patent and Trademark Office in connection with Case IPR2019-01444 dated Apr. 17, 2020, 5 pages.
United States Patent and Trademark Office, "Notice of Allowance," issued in connection with U.S. Appl. No. 15/354,599, dated May 6, 2020, 21 pages.
United States Patent and Trademark Office, "Notice of Allowance," issued in connection with U.S. Appl. No. 15/965,117, dated May 14, 2020, 9 pages.
United States Patent and Trademark Office, "Notice of Allowance," issued in connection with U.S. Appl. No. 15/965,208, dated May 15, 2020, 9 pages.
United States Patent and Trademark Office, "Corrected Notice of Allowability," issued in connection with U.S. Appl. No. 15/354,599, dated May 27, 2020, 19 pages.
United States Patent and Trademark Office, "Corrected Notice of Allowability," issued in connection with U.S. Appl. No. 15/965,117, dated Jun. 15, 2020, 12 pages.
United States Patent and Trademark Office, "Corrected Notice of Allowability," issued in connection with U.S. Appl. No. 15/965,208, dated Jun. 12, 2020, 11 pages.
"Decision Granting Petitioner's Request on Rehearing of Decision Denying Institution, Granting Institution of Inter Partes Review," issued by the United States Patent and Trademark Office in connection with Case IPR 2019-01302 dated Jun. 17, 2020, 9 pages.
*EIS, Inc.* v. *Wow Tech International GmbH*, "Notice of Supplemental Authority in Support of Plaintiff EIS Inc.'s Opposition to

(56) References Cited

OTHER PUBLICATIONS

Defendants' Motion to Dismiss," filed with the United States District Court for the District of Delaware in connection with Case No. 1:19-cv-01227-LPS on Jun. 19, 2020, 13 pages.
*EIS, Inc.* v. *Wow Tech International GmbH*, "Defendant's Response to Plaintiff Notice of Supplemental Authority," filed with the United States District Court for the District of Delaware in connection with Case No. 1:19-cv-01227-LPS on Jun. 23, 2020, 8 pages.
*EIS GmbH* v. *USPTO*, "Complaint," filed with the United States District Court for the Eastern District of Virgina in connection with Case No. 1:20-cv-00430-LMB-TCB on Apr. 17, 2020, 636 pages.
*EIS GmbH* v. *USPTO*, "Amended Complaint," filed with the United States District Court for the Eastern District of Virginia in connection with Case No. 1:20-cv-00430-LMB-TCB on Jun. 25, 2020, 577 pages. (uploaded in two parts).
United States Patent and Trademark Office, "Corrected Notice of Allowability," issued in connection with U.S. Appl. No. 15/354,599, dated Jul. 13, 2020, 2 pages.
United States Patent and Trademark Office, "Corrected Notice of Allowability," issued in connection with U.S. Appl. No. 15/354,599, dated Aug. 3, 2020, 2 pages.
United States and Trademark Office, "Corrected Notice of Allowabilty," issued in connection with U.S. Appl. No. 15/965,117, dated Jul. 22, 2020, 3 pages.
United States Patent and Trademark Office, "Corrected Notice of Allowability," issued in connection with U.S. Appl. No. 15/965,208, dated Jul. 22, 2020, 3 pages.
"Decision Granting Petitioner's Request on Rehearing of Decision Denying Institution, Granting Institution of Inter Partes Review," issued by the United States Patent and Trademark Office in connection with Case IPR 2019-01444 on Aug. 11, 2020, 13 pages.
*EIS, Inc.* v. *Wow Tech International GmbH*, "Notice of Supplemental Authority in Support of Plaintiff EIS Inc.'s Opposition to Defendants' Motion to Dismiss," filed with the United States District Court for the District of Delaware in connection with Case No. 1:19-cv-01227-LPS on Aug. 14, 2020, 17 pages.
"Schmerz und Gluckseligkeit," Spiegel Magazine, Edition Jun. 2006, pp. 136-138.
Linder-Ganz E et al., "Assessment of mechanical conditions in sub-dermal tissues during sitting: a combined experimental-MRI and finite element approach," Journal of Biomechanics 40 (2007) pp. 1443-1454.
H. Zahouani et al., "Characterization of the mechanical properties of a dermal equivalent compared with human skin in vivo by indentation and static friction tests," Skin Research and Technology 2009; 15: pp. 68-76.
John Z. Wu et al., "Simultaneous determination of the nonlinear-elastic properties of skin and subcutaneous tissue in unconfined compression tests," Skin Research and Technology 2007; 13: pp. 34-42.
Jessica L. Sparks et al., "Use of Silicone Materials to Simulate Tissue Biomechanics as Related to Deep Tissue Injury", Advances in Skin & Wound Care; vol. 28 No. 2, 2015; pp. 59-68.
International Searching Authority, "International Search Report," issued in connection with International Application No. PCT/DE2019/100309, dated Jul. 15, 2019, 7 pages (includes English translation).
International Searching Authority, "Written Opinion," issued in connection with International Application No. PCT/DE2019/100309, dated Jul. 15, 2019, 13 pages (includes English machine translation).
International Searching Authority, "International Search Report," issued in connection with International Application No. PCT/DE2019/100308, dated Oct. 10, 2019, 10 pages (includes English translation).
International Searching Authority, "Written Opinion," issued in connection with International Application No. PCT/DE2019/100308, dated Oct. 10, 20, 2019, 22 pages (includes English machine translation).
*EIS, Inc.* v. *Wow Tech International GmbH*, "Defendants' Response to Plaintiff's Second Notice of Supplemental Authority," filed with the United States District Court for the District of Delaware in connection with Case No. 1:19-cv-01227-LPS on Aug. 21, 2020, 191 pages.
"Decision Granting Petitioner's Request on Rehearing of Decision Denying Institution, Granting Institution of Inter Partes Review," issued by the United States Patent and Trademark Office in connection with Case IPR 2020-00007 on Sep. 25, 2020, 22 pages.

PIN-SHAPED STIMULATION DEVICE

CROSS-REFERENCE TO RELATED APPLICATION

This application is based upon and claims the benefit of priority from German Patent Application No. DE 10 2016 118 911.1 filed Oct. 5, 2016, the entire contents of which are incorporated herein by reference.

BACKGROUND OF THE INVENTION

The present invention relates to a pin-shaped stimulation device for erogenous zones, in particular for the clitoris, systems having a stimulation device, and methods for sexual stimulation.

The erogenous zones of the human body can be (sexually) stimulated with a variety of aids. For example, vibrators are thus used to apply a stimulus to a particular area of the skin by direct contact. This form of stimulation, however, can lead to irritations or skin inflammations. Direct contact with the intimate zones with such aids may also not be desired for personal reasons, such as hygiene or because of personal reservations.

In particular, direct stimulation of the clitoris, for example using a clitoral massage vibrator, is problematic. The clitoris is usually a woman's most sensitive erogenous zone. The entire clitoris is highly innervated whereby it is particularly touch-sensitive and responsive to sexual stimuli. In this context, the clitoral glans, in which the nerve cords of the two crura meet, should be emphasized in particular. Thus, on the one hand, frequent application of a clitoral massage vibrator for direct stimulation leads to habituation effects or conditioning of the stimulated erogenous zone, while, on the other, the first applications of such a device may require certain practice or familiarization.

Furthermore, medical studies conducted in 2006 identified the female clitoris as the definitive starting point of the female climax, and, for the first time, neurologically proved the different qualities of sensation of clitoral (and vaginal) orgasm, as the "Spiegel" magazine explains in its edition from 06/2006 on pages 136 to 138 in the article for women entitled "Schmerz and Gluckseligkeit" ("Pain and Bliss"). Thus, according to the most recent medical research, the stimulation of the clitoris, and not the vagina, is considered as the starting point of the sexual arousal of the woman and thus as the key to female "sexual pleasure".

Furthermore, the sensitivity of the human erogenous zones, such as the clitoris, the inner and outer labia or the nipples, here differs greatly from one individual to the next. The individual can be so sensitive that direct stimulation is only possible after extensive foreplay, and even then, only very delicately, or may not be possible at all. Furthermore, the sensitivity of the corresponding zone can change dramatically from one situation to another or even during one sexual act.

For the above reasons, different indirect forms of stimulation are usual practice as alternatives for direct stimulation.

For indirect stimulation of erogenous zones, and particularly the clitoris, conventional vacuum devices are used to stimulate the erogenous zones of the person concerned without directly contacting the main area to be stimulated. Thus, for example, vacuum pumps for the primary or secondary female sexual organs are known, which usually have a suction cup for placing on the appropriate area and a hand pump. The negative pressure exerted on the clitoris by this type of device, for example, generates a negative pressure in the clitoris itself which is usually below the systolic blood pressure. This difference in pressure results in an enlargement of the clitoris and/or stimulates the blood flow in the affected area. This vascular clitoral engorgement serves both to promote desire by increasing sensitivity and for visual and tactile manipulation. The improved blood circulation also results in an increased secretion of vaginal moisture, which makes stimulation more pleasurable. However, the manual operation of the hand pump is often onerous or irksome. In addition, the long-term or uninterrupted application of negative pressure with this device category may also result in habituation effects, which limit the effectiveness of the device in the long term. In addition, purely an increase of the blood flow in the clitoris is often not sufficient to obtain the climax; thus, vacuum pumps are often only used as foreplay in order to achieve the climax by a subsequent direct (pressure) massage of the erogenous zones.

Electrically driven vacuum pumps are also increasingly used instead of a manually operated vacuum pump. As an example of this, WO 2006/058291 A2 discloses a device for sexual therapy, wherein the arrangement comprises a tubular suction chamber for the clitoris, an electrical vacuum source (vacuum pump) and a plurality of air flow openings. Operation of the vacuum pump generates an ongoing air flow or air exchange in the chamber, in the area of the clitoris. Here, this has the disadvantageous effect of suctioning the vaginal moisture, which is increased as a result of the negative pressure, thus having a drying effect on the stimulated skin parts. Likewise, the suctioned moist air leads to contamination of the vacuum arrangement that is downstream in term of current, for example the vacuum pump. Such arrangements with vacuum pumps may thus be problematic from the point of view of hygiene, as vacuum pumps and the associated valves or ventilation components often have dead spaces and/or are difficult to clean. Furthermore, the device serves to treat the blood vessels in the clitoris and not to provide stimulation up to sexual climax.

U.S. Pat. No. 6,099,463 A discloses a device for stimulation of the clitoris having a tubular suction chamber, a vacuum source or a vacuum pump and several valves by means of which the size of the vacuum is controlled. Here, the vacuum can also be used in a cyclical form in order to obtain a stimulation effect, wherein habituation effects can also be expected with this device because of the use of a continuous vacuum. The disadvantages of hygiene and dehydration of the area of skin to be stimulated that were previously explained also exist here. Similarly, the pressure arrangement having several valves, vacuum pumps etc. is relatively complex.

U.S. Pat. No. 6,464,653 B1 discloses therapeutic devices and methods that generate a clitoral engorgement with the aid of a vacuum generated by a vacuum pump to assist in the treatment of clitoral disorders such as incontinence. A control valve or modulator that can be appropriately covered by a finger is used to manually adjust or vary the level of vacuum in the suction chamber. This requires the user's attention and may be irksome or distracting under certain circumstances. This relatively complex device having further valves also has the disadvantages relating to hygiene and dehydration that were mentioned above, with the device moreover serving for long-term therapeutic purposes and not for short-term sexual stimulation.

WO 2008/028076 A2 discloses a therapeutic device for women, which mainly serves to treat sexual disorders. The device includes a combination of indirect stimulation by means of a vacuum chamber and direct stimulation by means of mechanical vibrators and oscillators. This device is held and handled in the manner of a pistol grip or a traditional telephone receiver.

The negative pressure in this therapeutic device is used to increase blood flow in the clitoris, while the actual stimulation or massage of the region of skin takes place by means of mechanical vibrations/oscillations. Thus, a suction cup for placing on the region of skin to be stimulated is internally connected to a motor via a mechanical connection. The suction cup is extended by the motor after activating the device, wherein the volume of the suction cup increases. The resulting volume of the suction cup and thus the strength of the vacuum can be adjusted by means of control elements on the device. The air displaced in the device by the suction process is outwardly discharged again via a tube. In this device, the vacuum has only one supporting function, while the actual stimulation takes place in a direct manner, which leads to the disadvantages of direct stimulation explained above.

US 2013/001 276 9 A1 discloses a device in which a pulsing positive pressure for stimulation is used as an air pressure massage. A pump or compressor thus produces a pulsing positive pressure which is directed towards the erogenous zones to be stimulated by means of a nozzle. In this device, the affected region of skin advantageously dries out severely or completely. Also, there is usually a temperature difference between the temperature of the air supplied and the temperature of the area of skin to be stimulated, which may be seen to be distracting in some circumstances. With this device, the problems of hygiene described above also emerge, wherein, in this case, pathogens or germs or other contaminants can also potentially be transported directly to the genital area of the user.

U.S. Pat. No. 1,898,652 A further discloses a "pulsator" which operates by means of an air jet in order to massage areas of skin.

EP 0 365 230 A2 discloses a suction device having a suction pump, a suction valve and an outlet valve.

WO 2004/004610 A1 discloses a portable penile aneurysm enhancer.

U.S. Pat. No. 3,910,262 discloses a therapeutic device for producing male and female orgasms.

U.S. Pat. No. 2,112,646 discloses a device for treating diseases of the genital organs.

DE 14 63 673 U discloses a massage device.

The devices of the prior art mentioned above have the common disadvantage that the complexity of the arrangements generating negative pressure or positive pressure may be high and these devices may have problems in respect of hygiene.

Furthermore, the devices of the prior art have the further common disadvantage in that habituation effects occur in the event of long-term, continuous or frequently recurring application of negative pressures.

A further disadvantage of some of the previously described vacuum devices is, firstly, that the negative pressure has to be limited by means of a control valve or a vacuum pump and, secondly, that the negative pressure is supposed to be relieved by means of manually opening a release valve before the suction cup is detached from the skin. Should one of the valves have a technical defect and/or the user operate the device incorrectly, there is a risk of injury in certain circumstances.

DE 10 2013 110 501 A1 discloses a stimulation device which addresses the problems mentioned above and which will be explained in detail below. The subsequently explained prior art by the same applicant can be arbitrarily combined with its features having the embodiments and aspects of the present invention.

FIGS. 1 to 3 show the stimulation device of DE 10 2013 110 501 A1, incorporated herein by reference in its entirety, which is implemented as a handheld device. With this device of DE 10 2013 110 501 A1, a pressure field is produced made of negative and positive pressures in a chamber (labelled second chamber 4*a*), which is particularly suitable for stimulating the clitoris.

With reference to FIG. 1, a front view of a first embodiment of the stimulation device 100 of DE 10 2013 110 501 A1 is explained in detail, wherein, in FIG. 2, a perspective view and, in FIG. 3, a cross-section of the stimulation device 1 of a first embodiment of DE 10 2013 110 501 A1 are shown.

Said stimulation device 1*a* is a preferably portable electric or small device which has a housing 8*a*, a pressure field generation device 2, operating elements 71*a*, a display 72*a*, an on/off switch 74*a*, a bushing 75*a*, an optional battery 76*a* and optional illumination 9*a*.

The housing 8*a* is preferably implemented in such a way that it can be held with one hand and it does not have any sharp or pointed edges. Furthermore, the housing 8*a* can consist of plastic, for example polycarbonate (PC) or acrylonitrile butadiene styrene (ABS). In addition, the gripping regions or even the entire housing can be supplemented by or formed from a haptically advantageous silicone. The housing 8*a* is preferably formed to be at least water-repellent or splash-proof, for example protection class IP 24.

Such a housing 8*a* resembling the shape of a cuboid having an extension or the shape of a traditional telephone receiver (for example a receiver of a W48 Bakelit telephone device) can also be held by hand, much like a telephone receiver. Here, the housing is at least extensively enclosed by the hand, which represents a non-ergonomic handheld position. The result of this with such conventional housings is the requirement that these have to be formed in such a way that they have a sufficiently large size in order to allow them to be enclosed by the hand.

For example, the external periphery (for example measured in the middle and in the peripheral direction) in the housing 8*a* of the prior art is more than 14 cm in order to allow it to be enclosed by the hand and thus to hold the device above the erogenous zone to be stimulated. As a result, the housing 8*a* is deemed to be bulky.

The size of the housing disadvantageously results in an increased material cost, an increased weight and also increased tool costs, for example for an injection moulding tool for larger plastic parts.

The operating elements 71*a* which are shown in FIGS. 1 to 3 serve to set the type of operation of the device, i.e. to set the modulation pattern of the pressure field. The operating elements 71*a* can be implemented, for example, as at least one push button, as at least one rotation switch or as at least one touch-sensitive switch. Furthermore, the operating elements 71*a* can provide an optical feedback for activation, for example by means of light diodes (LED) integrated in the switch.

An optional display 72*a* provides information to the user about the device state and/or setting state. The display 72*a* can be formed, for example, from a plurality of light diodes, or as an LCD display. The displayed information can be, for example, the charging state of an optional battery or the current setting of the modulation pattern.

The on/off switch 74*a* serves to activate and deactivate the stimulation device 1*a*. This on/off switch can be, for example, a push button, which switches the stimulation device 1*a* on or off by being pressed for a longer time, or an engaging sliding switch.

A bushing 75*a* serves the external current supply of the stimulation device 1 via an external plug 73*a*, which is connected, for example, to an external network adapter. In order to ensure the spray water resistance of the stimulation device 1, instead of the bushing, a magnetically inductive transformer can preferably be provided, which allows a transfer of power into the stimulation device 1 without an electrically conductive contact. Preferably, the stimulation device 1*a* additionally has a battery, for example a nickel-metal hydride battery (NiMH) for wireless operation. Alternatively, a longer current supply wire can also be guided out of the stimulation device.

The pressure field production device 2*a* of an embodiment of DE 10 2013 110 501 A1 has a first chamber 3*a* inside the stimulation device 1, a second chamber 4*a* for placing on a body part 11*a* to be stimulated, and a connection element 5*a*, which connects the first chamber 3*a* to the second chamber 4*a*.

A drive unit 6*a*, for example an electric motor, drives the first chamber 3*a* via an axis 61*a* and by means of an eccentric cam 62*a* (or additionally by means of a connecting rod) in such a way that the volume of the first chamber 3 is changed correspondingly to the rotation of the axis of the drive unit 6*a*.

A control device 7*a* controls the drive unit 6, the operating elements 71*a* and the display 72*a*. Here, the control device 7*a* and the drive unit 6*a* are supplied with power by the internal battery 76*a* and/or the external power supply 73*a*.

An optional lighting device 9*a* is provided on or in the housing 8*a*. Here, the lighting device 9*a* preferably serves to illuminate the inside of the second chamber 4*a*. The lighting device 9*a* can either be switched off by the user or, when activating the stimulation device 1*a*, is activated automatically. Furthermore, the lighting device 9*a* can be formed from the energy-saving light diodes. The lighting device can, for example, serve as orientation aids for the user of the stimulation device 1*a* in the dark or as additional optical stimulation.

With reference to FIG. 3, the longitudinal axis 80*a* of the housing 8*a* (which extends from the upper end of the housing to the lower end of the housing 8), the alignment axis 81*a* of the preferred direction of the media flow when operating the drive unit 6*a*, the axis or drive shaft of the motor axis 82*a*, and the opening plane 83*a* of the opening 42*a* of the second chamber 4*a* are drawn in to illustrate the geometry of the housing 8*a*.

The angle of intersection α between the longitudinal axis 80*a* and alignment axis 81*a* is about 90 degrees. As a result, this kind of arrangement is called an L-shaped arrangement in the following. The opening plane 83*a* is arranged to be virtually parallel to the longitudinal axis 80*a* of the housing 8. In addition, it is noted that, in FIGS. 1 to 6, because of this L-shaped arrangement, the front side of the stimulation device 1*a* is called a different side from the one in the stimulation device 1 according to the invention (cf. FIGS. 7 to 17, for example).

With the intended use of the stimulation device 1*a* of DE 10 2013 110 501 A1 for stimulating the clitoris, the user of the device now has to pull the opening 42*a* over the clitoral glans so that it fits exactly, and place the edge of the opening 42*a* on the skin surrounding the clitoral glans with a desired degree of tightness (whereby a gap between the affected area of skin and the edge of the opening, for example, can remain).

Here, as a result of the anatomy of the user and the L-shaped arrangement previously explained, a holding position of the hand emerges which has regularly been deemed not to be ergonomic or comfortable according to the understanding of the inventor.

The exact positioning of the opening of the stimulation device of DE 10 2013 110 501 A1 above the (virtually point shaped) clitoral glans also constitutes a problematic process for the user in conventional devices since the stimulation effect is greatly dependent on the "exact fit" positioning of the opening. Thus, the users regularly miss the optimum position, to which a considerable manual effort is connected which can be seen as disruptive.

In particular, the user will often want to exactly proportion the contact pressure of the stimulation device 1*a* on the skin surrounding the clitoral glans (which is very sensitive), for example, depending on the state of arousal, wherein the weight of the stimulation device 1*a* has to be delicately cushioned by the gripping hand.

In addition, the stimulation device 1*a* must also be balanced above the virtually punctiform clitoral glans, which is difficult because of the centre of mass of the stimulation device 1*a* which is arranged to be laterally offset relative to the clitoral glans in the longitudinal direction of the housing 8*a*. Thus, the user has to compensate not only the total weight, but also the tilting moment of the housing 8*a*. This is also seen as disturbing or not ergonomic.

In addition, the stimulation device 1*a* is also seen as too heavy and too large.

Thus, the housing is comparatively bulky or large in terms of the preferred usage, since the stimulation device 1*a* is used between or on the labia of the woman in spatially confined surroundings. For example, the user often has to stretch out both legs when using the stimulation device which makes the accessibility of the clitoral glans yet more difficult since the thighs are virtually parallel.

Here, slight touches of the bulky housing 8*a* with the female body, for example with the thighs, can also be seen as disturbing.

In addition, there is also the circumstance that, in some circumstances, a different person may also want to hold the device in order to stimulate the user. Because of the shape of the housing 8*a* and anatomy of the user, this leads to an inconvenient holding position for the other person as well.

Furthermore, the housing 8*a* receives vibrations or oscillations that are generated because of the movement of the eccentric cam by means of the electric motor. These oscillations have a preferred direction that is perpendicular to the axis 82*a* and parallel to the alignment axis 81*a*. Thus, the wall 41*a* of the second chamber 4*a* vibrates or oscillates, said second chamber 4*a* abutting on the skin surrounding the clitoral glans with its front edge, in the direction of the body of the user, along with the housing, wherein these additional vibrations or oscillations are often unwanted.

Furthermore, the device 8*a* can be regularly seen as loud during operation.

The problems of lacking ergonomics that are explained above can also be present with the vacuum device of US 2009/0118573 since this has a housing which is held in the manner of a gun handle. Thus, the longitudinal axis of the device here is also perpendicular to the axis of use. In the same way, disturbing oscillations or vibrations are generated here in the direction of the area of skin that is to be treated.

U.S. Pat. No. 5,377,701 A also discloses a vacuum device having a housing that is held in the manner of a gun handle.

With reference to FIGS. 4, 5 and 6, an embodiment of DE 20 2015 105 689 U1 is explained below. In FIG. 4, a front view of the first embodiment of the stimulation device 1*b* is shown having an appendage 140*b* in a straight position, wherein furthermore, in FIG. 5, a side view of the stimulation device 1 is shown having the appendage in an angled position and, in FIG. 6, a cross-section of the stimulation device 1*b* of the first embodiment of DE 20 2015 1050689 U1 is shown.

The first embodiment of the stimulation device 1*b* is a preferably portable electric or small device which has a housing 8*b*, a pressure field generation device 2*b*, an on/off switch 74*b* and optional lighting device 9*b*.

The housing 8*b* is preferably implemented in such a way that it can be held with one hand and it does not have any sharp or pointed edges. Furthermore, the housing 8*b* can consist of a plastic, for example polycarbonate (PC) or acrylonitrile butadiene styrene (ABS). In addition, the gripping regions or even the entire housing can be supplemented by a haptically advantageous silicon or consist of this. The housing 8*b* is preferably formed to be at least water-repellent or splash proof, for example protection class IP 24. The dotted line in FIG. 5 further specifies an optional side edge of the housing 8*b*.

The optional on/off switch 74*b* serves to activate and deactivate the stimulation device 1*b*. This on/off switch can be, for example, a push button which switches the stimulation device on or off when pressed for a long time, or an engaging sliding switch. Alternatively, the stimulation device 1*b* can be switched on and off by remote control.

The pressure field generation device 2*b* of a first embodiment has a first chamber 3*b* inside the stimulation device 1*b*, a second chamber 4*b* for placing over a body part 11*b* to be stimulated, and a connection element 5*b* which connects the first chamber 3*b* to the second chamber 4*b*.

A drive unit 6*b*, for example an electric motor, drives the first chamber 3*b* via an axis 61*b* and by means of an eccentric cam 62*b* (or alternatively by means of a connecting rod) in such a way that the volume of the first chamber 3*b* can be changed to correspond to the rotation of the axis 61*b* of the drive unit 6*b*.

Thus here, as with DE 10 2013 110 501 A1, the alignment axis 81*b* of the opening 42*b* of the second chamber 4*b* is also arranged at a right angle to the longitudinal axis 80*b* of the housing 8*b*. The angle of intersection 13 between the longitudinal axis 80*b* and the alignment axis 81*b* here is about 90 degrees and constitutes an L-shaped arrangement. The opening plane 83*b* is arranged to be virtually parallel to the longitudinal axis 80*b* of the housing 8*b*.

Thus, the housing 8*b* also has the same disadvantages which were previously described in more detail with reference to the housing 8*a* of DE 10 2013 110 501 A1.

A control device 7*b* controls the drive unit 6*b*, optional control elements 71*b* and at least one optional display 72*b*. Here, the control device 7*b* and the drive unit 6*b* are supplied with power, for example, by the internal battery 76*b* and/or the external power supply 73*b*.

The stimulation device 1 of DE 20 2015 105 689 U1, incorporated herein by reference in its entirety, depicted in FIGS. 4 to 6, further has at least one appendage 140*b*. This appendage 140*b*, which is preferably a component of the housing 8*b*, is optionally able to be moved or bent relative to the housing part in which the pressure field generation device 2 is contained. Here, the appendage can be angled or even rotated by means of a joint 141*b*. The joint 141*b* can be formed, for example, as a plastically deformable plastic part, as a setting joint or as a hinge. FIG. 5 shows an example of a bent position of the appendage 140*b* relative to the section of the housing 8*b* of the stimulation device 1 in which the pressure field generation device 2*b* is contained. Alternatively, the appendage can also be formed to be rigid or immovable.

The appendage 140*b* is preferably a stimulation means for inserting in the human body, for example in the vagina or other bodily orifices as well. Here, the appendage 140*b* is formed as a conventional dildo, for example. Alternatively, the appendage can be formed in such a way that it is adjusted to the human anatomy of a different bodily orifice, for example to the mouth. In addition, the appendage 140*b* can be formed in such a way that it can also be used as a hand grip in order to hold the stimulation device 1. However, holding the device 1*b* on the appendage behind a joint is impractical since the joint impedes metering of the corresponding forces.

Thus, even if the stimulation device 1*b*, as shown in FIG. 5, having an appendage 140*b* is to be held in a bent shape, the stimulation device 1*b* has a holding position in the manner of a gun handle which is inconvenient and also disadvantageous, as is described above in more detail.

In addition, the appendage 140*b* can optionally have a vibration device 142*b* which can be switchable or controllable. The vibration device 142*b* shifts the appendage in mechanical oscillations which support the direct stimulation effect of the appendage 140*b*.

The appendage 140*b* is optionally applied to the section of the housing 8 which receives the pressure field generation device 2*b* in such a way that the (entire) housing 8 of the stimulation device 1*b* is formed to be consistent. Thus, the housing 8 creates the impression that it is formed as one piece or one part, for example by means of the flexible and/or seamless connection elements of the housing 8. Alternatively, the housing 8*b* incl. the appendage 140*b* can have a silicone covering.

In a straight or not bent alignment of the appendage 140*b*, as is shown in FIG. 4, the stimulation device 1*b* can be held or even inserted into bodily orifices. If the appendage 140*b*, as is shown in FIG. 5, is bent, for example, after insertion, in this way, the opening 42*b* can be guided to the body part 11*b* to be stimulated. In this bent position of the stimulation device 1*b*, both a direct and indirect stimulation of at least one erogenous zone of the body can take place simultaneously. Here, the body part 11*b* to be stimulated can be located between the appendage 140*b* and the pressure field generation device 2*b*. This kind of "hands-free" holding of the stimulation device 1*b* by means of the vagina (and possibly the two thighs, between which the stimulation device 1*b* can be clamped), however, is unwanted by the user in certain circumstances. It is thus preferable to hold the stimulation device in general by hand, and not with other body parts.

Furthermore, an optional lighting device 9*b* can be provided on or in the housing 8*b*. Here, the lighting device 9*b* preferably serves to illuminate the inside of the second chamber 4. The lighting device 9*b* can either by switched by the user or can be automatically activated when the stimulation device 1*b* is activated. Furthermore, the lighting device 9*b* can be formed from energy saving light diodes, for example. The lighting device can serve, for example, as orientation aids for the user of the stimulation device 1*b* in the dark or as additional optical stimulation.

The stimulation devices of DE 10 2013 110 501 A1 and DE 20 2015 105 689 U1 additionally have the common disadvantage that there is far too much dead space or unused volume inside the respective housing 8*a* and 8*b* because of the basic design described above. Thus, these devices are implemented in a comparatively voluminous and correspondingly large manner. The housing size further leads to an increase waste of material for the housing.

Thus, with the stimulation devices of DE 10 2013 110 501 A1 and DE 20 2015 105 689 U1, there is the possibility for improvement in terms of the ergonomics of these devices.

Furthermore, a device (with the product name "Womanizer W 500 Pro") was developed by the applicant which is not formed to be shaped like a dumbbell, rather it is flat and shaped like a computer mouse (i.e. the shape of the housing greatly resembles the shape of a computer mouse). This stimulation device, however, has the same disadvantages because of the geometric agreements with the stimulation device of DE 10 2013 110 501 A1, these disadvantages having been explained above. In particular, this product also has an L-shaped arrangement.

Those devices, which are moulded or formed in the manner of a gun handle (an/or having a bent housing and an accompanying L-shaped arrangement), also have the ergonomic disadvantages described above.

BRIEF SUMMARY OF THE INVENTION

Thus, when considering the problems described above, the object underlying the invention is to specify an optimised stimulation device which is more ergonomic.

The ergonomics of the stimulation device relate, for example, to the aspects of weight, volume, the holding position of the hand, compactness, handling, comfort during use, suitability to use and transportability of the stimulation device according to the invention.

The object underlying the invention is solved by the stimulation device according to claim 1. Advantageous developments and embodiments are the subject matter of the further subordinate and dependent claims.

According to the invention, a stimulation device for erogenous zones, in particular the clitoris, is provided, having a housing which is substantially (rod or) pin-shaped, a pressure field generation device having a drive unit that generates a pressure field made of temporally alternating negative and positive pressures in the hollow space, a control device which controls the drive unit; wherein the housing has a longitudinal axis which extends from a front end of the housing up to a back end of the housing, and an opening for placing over the clitoris is provided in the front end of the housing, and wherein the hollow space is arranged inside the housing and is connected to the opening of the housing.

The longitudinal axis of the housing of the stimulation device according to the invention is an imaginary axis that extends from a front end of the elongated housing up to a back end of the elongated housing (which is spaced apart axially relative to this front end). Preferably, the longitudinal axis runs in parallel to the length of the housing.

Regularly, but not exclusively, the longitudinal axis can be an axis running in the longitudinal direction relative to the longitudinal extension of the stimulation device.

The longitudinal axis corresponds, for example, to the direction of the greatest total extension of the housing.

Preferably, the longitudinal axis is also the longitudinal central axis which extends roughly centrally through the stimulation device.

Furthermore, the longitudinal axis is preferably also substantially an axis of symmetry of the stimulation device or of the housing. Thus, the housing in terms of its basic shape is formed, for example, to be extensively cylindrical. Switches, bushing or similar small details do not come into consideration when considering the symmetry.

In addition, a housing is then formed to be elongated or stretched out when its length is at least three (3) times or even n times the width and/or height. Preferably, the factor n has the value four (4), five (5), six (6) or seven (7). The greater the factor n is, the more elongated or stretched out the housing is formed to be.

Alternatively, the housing of the stimulation device according to the invention can thus be said to be formed in a stretched-out manner if it can be received in an imaginary cylinder whose diameter is, for example, smaller by the factor 3, preferably 4, 5, 6, or 7 than its length.

The front end of the housing is the end of the housing which is arranged to be adjacent to or over the erogenous zone when using the stimulation device, i.e. it is the "active" end having the opening for stimulation in the stimulation device according to the invention.

The rear or back end of the housing is the end of the housing which is arranged opposite the front end in the longitudinal direction. This back end is, for example, the "passive" end of the housing, i.e. generally, a simple end of the housing. Operating elements can be arranged on the back end.

According to the invention, a pressure field generation device of the stimulation device has a hollow space having an opening for placing on a body part or on the erogenous zone, preferably over the clitoris.

Thus, the hollow chamber is pulled over the clitoral glans such that the clitoral glans is received in the hollow space. This placement can take place in a sealing manner, or also only in a partial or extensively sealing manner, when, for example, a gap remains open between the wall of the opening and the skin of the erogenous zone.

The front end of the housing preferably has a placement region for placing the stimulation device on the erogenous zone. The placement region is called the resting surface which comes into contact with the skin when using the stimulation device.

The hollow space according to the invention defines a volume inside the housing for a medium, for example air. This hollow space is separated from the rest of the inside of the housing by flexible and/or rigid walls.

Furthermore, the hollow space is connected to the opening of the housing. Thus, the hollow space has the opening (of the housing) for placing over the erogenous zone to be stimulated.

The pressure field according to the invention is formed in this hollow space, said pressure field having temporally alternating negative and positive pressures relative to a reference pressure, wherein this will be described in more detail later (for example with reference to FIGS. 40 *a*) to *c*)).

When generating the pressure field, the hollow chamber has a current system according to the invention which has currents that are temporally alternating and are regularly opposing one another. This is explained in more detail later by FIGS. 21 and 22.

The hollow chamber according to the invention can have, for example, at least one first chamber and at least one second chamber and at least one connection element that connects the first chamber to the second chamber. Here, the term "first chamber" functionally refers to the part of the hollow space in which the drive device or drive unit can act upon the hollow space, for example by changing the volume. The term "second chamber" functionally refers to the part of the hollow space which has the opening for placing over the erogenous zone, and in which the pressure field according to the invention can act on the erogenous zone. The chambers according to the invention are thus not respectively structurally completely separated spaces or compartments of the hollow space, but only functional sections of a hollow space. Thus, the connection element can also only represent a marginal tapering or narrowing in the form of an individual outlet opening between the two chambers.

A pressure field can be generated in the second chamber by the formation according to the invention of chambers that communicate in terms of current via at least one connection element by changing the volume of the first chamber in a simple manner, said pressure field being temporarily aimed at the region of skin to be stimulated.

A pressure field in the sense of the invention is a temporally changing field of media pressures which, at times, has positive pressures and, at times, has negative pressures wherein a negative pressure is a media pressure that lies below the reference pressure, and a positive pressure is a media pressure that lies above the reference pressure. As a result, the medium moves forwards and backwards in an alternating manner in the hollow space according to the invention, whereby the pressure field is generated.

The medium is usually in the form of gas, preferably air, however, alternatively or additionally for example, it can be a fluid medium, water or a commercially available lubricant. For example, the chambers according to the invention can be filled with the lubricant before using the stimulation device. In this way, stimulation of the corresponding region of skin takes place by means of a suitable skin friendly fluid, which may be desired depending on the individual preference of the user. As a further example, the stimulation device can also be used underwater with water as the medium (for example in the bath or in the swimming pool). Preferably, the stimulation device is formed to be waterproof. If air is the medium, a kind of air column is moved forwards and backwards in the hollow space according to the invention.

The reference pressure is usually the surrounding pressure present at the start of usage (i.e. before placing the stimulation device on the region of skin to be stimulated) in terms of the stimulation device. With the preferred use of the stimulation device with air, the reference pressure is the currently present/prevailing air pressure or the normal pressure.

For example, when using the device under usual standard conditions, the reference pressure can be c. 1 bar, wherein, as a result, a negative pressure according to the invention (measured absolutely) can be 0.7 bar or −0.3 bar (measured relatively), for example, and a positive pressure according to the invention (measured absolutely) can be 1.3 bar or +0.3 bar (measured relatively).

By means of the pressure field according to the invention, the area of skin to be stimulated is stimulated, on the one hand, in terms of its blood flow, while, on the other hand, it is indirectly stimulated. Thus, two advantageous effects are combined. Because of the increased blood flow, the erogenous zone of the person concerned is more sensitive, while, in addition, a kinetic effect is generated that serves to stimulate the erogenous zones, for example sexual arousal until climax. The stimulation effect is generated by means of the effect of the pressure field on the surface of the area of skin to be stimulated. In this manner, the stimulation effect created by the pressure field is generated indirectly, i.e. without a solid body, for example a vibrator, directly touching the part of the skin to be stimulated.

By means of the exemplary usage of the temporally changing pressure field, an excitation of the clitoris is imitated by means of the pressure field that usual takes place during sexual intercourse. Here, a changing stimulus is also generated on the clitoris as a result of the cohabital movement. Thus, it is a realistic imitation of the natural cohabital act, wherein medical statements confirm that the usage of the pressure field according to the invention leads to neither habituation effects nor to addiction. This is grounded, in particular, in the alternating use of negative and positive pressures (or also in the non-continuous use of only one kind of pressure).

Furthermore, the maximum useable pressure is regularly limited by the maximum resilience of the region of skin to be stimulated. Thus, too high a positive pressure, particularly with erogenous zones such as the clitoris, poses the risk of painful injuries. Stimulation device that function exclusively by means of negative pressures are usually limited to this maximum in their functionality. In contrast, an extended working region of the stimulation triggering pressure field or effect is created according to the invention by means of the combination of positive and negative pressures since the working region of the pressure can, from now on, be used in the positive and in the negative region up to a maximum without the danger of an unintentional excess.

By means of the alignment of the at least one connection element corresponding to an alignment axis on the skin region to be stimulated, the pressure field can act directly on the target region, wherein the pressure field is influenced significantly by the configuration of the at least one connection element and the at least one opening from the connection element into the second chamber, and can thus be adjusted depending on the use of the stimulation device. Thus, an opening of the connection element can lie opposite the body part to be stimulated, preferably directly opposite. Thus, the pressure field that is generated in the second chamber is generated in the immediate proximity of the erogenous zones, preferably the clitoral glans, and is directed at this.

For example, in a stimulation device which is intended for the clitoris, the connection element can have an individual passage opening having the effect of nozzles on the clitoral glans between the first and second chamber. The individual passage opening can be, for example, an individual constriction in the hollow space. Furthermore, the connection element can be formed as a nozzle. The nozzle accelerates the medium when generating the positive pressure of the pressure field. Preferably, the nozzle also directs the media flow towards the clitoris, when the positive pressure is generated in the hollow space. Such a nozzle can be formed or moulded to be conical or rounded, for example, as will be described below with reference to several figures.

Alternatively, the connection element can consist of several, for example four, passage openings between the chambers, when a larger area of the skin region is to be stimulated.

Furthermore, after placing the hollow space that is open on the side or partially open (and the second chamber, for example) on the skin region to be stimulated, there is an intrinsically closed system of the media or air current in the pressure field generation device, i.e. the flow system according to the invention. Thus, the medium or the air is moved forwards and backwards significantly in the chambers or in the hollow space, while an exchange with media or air from outside the system is at least extensively avoided. Thus, the first chamber is connected exclusively to the second chamber (via or by means of the connection element). Thus, there are no other connections of the first chamber than those to the second chamber; for example, there is no direct connection of the first chamber with the surroundings of the device via a pressure valve or via an air removal channel.

For example, the temperature of the air in the flow system according to the invention can be quickly adjusted to the skin temperature, while the disturbing supply of new (for example cold) air from outside the system is avoided, as can be the case with the prior art, among others, when using vacuum pumps or fans. In addition, drying effects are avoided, since there is little or no removal of stimulation-encouraging fluid, for example bodily fluid.

Furthermore, the pressure field generation device according to the invention has the advantage of increased hygiene and improved cleaning capability because of the simple construction as a hollow space that is closed (to the rest of the inside of the housing). In particular, the present invention avoids valves or pumps/compressors having potential dead spaces and parts that cannot be cleaned. Thus, the pressure field generation device according to the invention is easy to clean. For example, cleaning the stimulation device can take place in a simple manner by filling the first chamber with a cleaning fluid and activating the pressure field. Alternatively, the front part of the hollow space and the second chamber, for example, can be arranged such that they can be exchanged, which also simplifies cleaning the two chambers.

Furthermore, the hollow space of the pressure field generation device according to the invention, for example the chambers according to the invention and the connection element, can be produced to be one part, wherein this consists of a single plastic moulding (e.g. rubber or silicone). As further alternatives, the first chamber, the second chamber and the connection element can be implemented to be two or three parts. Preferably, each functional unit of the hollow space is a separate component, which simplifies the construction. As a further example, the one bracket of the first chamber, a complementary flexible wall of the first chamber, the second chamber and the connection element can each constitute a separate component of the pressure field generation device.

In addition, the construction according to the invention leads to avoiding complex elements in terms of current, such as valves, for example, which leads to a simplification of the production. The stimulation device according to the invention thus does not have any valves.

Furthermore, the stimulation device according to the invention has a drive unit which controls the hollow space in such a way that a pressure field is generated in the region of the opening of the hollow space, said region serving to stimulate the erogenous zones. Similarly, the stimulation device according to the invention has a control unit which controls the drive unit.

Preferably, the volume of the first chamber is changed in such a way that the pressure field is formed for stimulation via the connection element in the second chamber.

Furthermore, the transported volume is constructively limited by the maximum possible volume change, which can be caused by the drive unit.

Consequently, the maximum positive or negative pressure the stimulation device can build up in the second chamber is limited due to the dimensions of the components of the pressure field generating arrangement and the drive. In particular, the maximum positive or negative pressure can be limited to an amount that minimizes or rules out any risk of injury for the areas of skin to be stimulated. As a result, a safety valve that is usual in the prior art, or a manual intervention in the stimulation process by the user, such as the opening of a release valve, is for example rendered unnecessary.

Furthermore, the variation over time in the pressure field or the modulation of the pressure field by the control device is controlled largely or completely automatically. Thus, the modulation of the pressure field, such as intensity, time profile or sequence, can be previously stored in the control device. Preferably, the variation over time in the pressure field can have a regular or recurring (stimulation) pattern, such as pulses at a predetermined cycle rate or regularly alternating pulse sequences. This allows the user's interaction with the stimulation device to be limited according to the invention to switching on and off and selecting the stimulation pattern, while the stimulation device automatically executes the preferred stimulation pattern. Thus, according to the invention, the complexity of using the stimulation device is low, when compared with conventional (medical) vacuum stimulation devices. Alternatively or in addition, the stimulation pattern of the stimulation device can be individually configured by the user during or before operation.

Preferably, the modulation pattern can be generated or changed by means of a voltage or current control of an electric motor by adjusting and/or varying the number of revolutions of the electric motor. When the number of revolutions is consequently changed, the number of strokes of an eccentric cam which is mounted on the shaft changes, as well as the number of strokes of the corresponding flexible wall.

Preferably, the opening of the housing and the hollow space is arranged in such a way that the longitudinal axis of the housing penetrates the opening of the hollow space. Thus, the imaginary longitudinal axis of the housing intersects an imaginary surface which is spanned by the inside of the opening or a surface which is surrounded by the front or outermost edge of the opening of the housing. This front edge preferably serves for placement on the skin. This imaginary surface can be formed to be planar or flat (for example as a planar circular surface or a planar oval surface) or bent (for example concave).

According to the invention, it is thus provided that the large volume pistol housing of the generic type (including corresponding dead volumes) or the conventional large volume housing is replaced by an L-shaped arrangement, by an elongated, compact, preferably pin or rod-shaped housing which can be held or guided by the operating person in the manner of a highlighter or pen. Thus, the opening according to the invention of the stimulation device is provided on the "active" end, similar to with a pen.

Thus, not only is a more sensitive and more relaxed grip of the stimulation device possible, but also the spatial positioning of the stimulation device above the erogenous zone, for example above the clitoris, is clearly made easier for the user or even for a third person.

Furthermore, the inventors have recognised that the stimulation effect can be varied significantly by the placement angle and the pressing pressure. Depending on how tightly the opening is placed on the erogenous zone or the area of skin to be stimulated, the pressure ratios inside the hollow space clearly vary. For example, measurements of the inventors have shown that the maximum and minimum pressures inside the hollow space are more than 30 or 50 times higher in the event of a completely sealed placement of the opening than when the opening is not placed very tightly, for example with a small gap facing outwards. Therefore, the user can set the intensity of the stimulation effect by means of the position of the placement of the opening over the erogenous zone or by means of the inclination of the stimulation device, without here having to carry out adjustments, for example, in terms of the modulation pattern on the device by means of the operating elements. For example, it is regularly the wish of the user that the intensity of the stimulation effect increase during the course of the use of the stimulation device.

As a result, the handling of the housing and, in particular, the positionability of the opening of the hollow space, also play an important role when adjusting the intensity of the stimulation effect during use. Thus, the arrangement according to the invention having an elongated, pin-shaped housing shape (and having the opening of the hollow space/the housing on the front end of the housing) facilitates the overall stimulation effect of the pressure field during use, since the intensity of the stimulation can now clearly be adjusted in a more delicate manner, according to the respective current requirement of the user.

In other words, it is advantageous that the placing angle of the opening can be manually set in a delicate manner relative to the erogenous zone or skin surface because of the housing formation according to the invention, since the placing angle can be determined to be more precise, the longer the housing is.

Since the user no longer holds the stimulation device according to the invention in the manner of a handle (for example in the style of a tennis racket)—as explained above—but in the manner of a pen or pommel, the housing can be formed to be smaller.

It is thus no longer necessary to form the housing to be so large, in particular in the peripheral direction (and also in the longitudinal direction), that it is possible to enclose it by hand. That is to say, the periphery of the housing no longer has to so big in the longitudinal direction, as is the case with conventional telephone receiver style housings with an L-shaped arrangement, in order to allow a one-sided, comfortable grip with the hand, but rather the periphery of the housing according to the invention can clearly become smaller, since guiding the stimulation device according to the invention between thumb and forefinger, for example, is sufficient.

In addition, as a result of the reduction of the housing that has been achieved, material, and thus weight, can be saved.

It is also easier for the user to balance the stimulation device above the erogenous zones, since an elongated, compact and lighter housing can also be aligned more easily relative to the centre of mass of the housing, and, in addition, the housing can also come to rest in the hand in the crook between thumb and forefinger, whereby the weight of the housing can come to rest at least partially on the hand.

Alternatively, guiding the stimulation device according to the invention can also take place by means of holding the longitudinal housing on its back end (i.e., similar to holding a walking stick, which has a pommel). This is also a comfortable holding position for the hand, in particular when the anatomical conditions of the user are taken into consideration. Such a handling of the stimulation device was, up until now, not possible with the L-shaped arrangements of the prior art.

Optionally, a pommel or a thickening (which is ball-shaped, for example) can be provided for this purpose on the back end. In this way, a more delicate and more relaxed guiding of the stimulation device is also made possible.

As a result of the opening of the hollow space or the housing of the stimulation device according to the invention being arranged on the front end of the housing, in contrast to the common L-shaped arrangements, the stimulation device can also be guided in such a way that contact of any other housing parts with the skin can be avoided.

Furthermore, an elongated, hollow housing is not necessary, in comparison to usual L-shaped arrangements, which saves space, since, in comparison to conventional devices, less dead space (in particular in the region between the pressure field generation device and the drive unit, which are usually perpendicular to one another in prior art in its extension direction) is present. Therefore, the stimulation device according to the invention can also be formed or moulded to be more compact.

Furthermore, the housing is formed to be elongated in the shape of a pin or in the shape of a rod in such a way that it can be guided manually in the manner of a pen for placement over the erogenous zone, in particular the clitoris (or clitoral glans).

Among other things, this offers the advantage that the actuation of the elongated stimulation device that is shaped like a rod or pin, for example, is more trusted by the user as a result of previous practice (for example with a pen) and can be carried out in a more ergonomically simple manner.

According to a development of the invention, a stimulation device is provided, wherein the opening defines an opening plane that forms an angle with the longitudinal axis of the housing that is greater than 30 degrees (alternatively greater than 45 degrees), preferably between about 35 and 65 degrees (alternatively: 40 to 50 degrees), in particular between about 55 degrees and about 65 degrees, or greater than about 80 degrees, in particular about 90 degrees.

Thus, the opening according to the invention is detached, for example at a pointed angle relative to the longitudinal axis of the stimulation device. This angled arrangement of the opening of the hollow space is advantageous since it takes the female anatomy into consideration and allows a more relaxed and more comfortable handling. For example, in particular when placing the stimulation device over the clitoris, the holding arm of the user can be bent more sharply. If the user is also lying in a horizontal position when using the stimulation device according to the invention, then the stimulation device can be held in a steeper or vertical position, which simplifies balancing the stimulation device over the clitoris, since, among other things, the tilting moment is smaller.

Alternatively, the opening plane is formed to be perpendicular or somewhat perpendicular to the longitudinal axis, which is also advantageous for the manipulability of the device. The term "somewhat" in terms of angle specifications, in this disclosure, generally means an angle exactness of ±1 degree of the angle.

According to a development of the invention, the opening of the housing is arranged in such a way that the longitudinal axis of the housing penetrates (through) the opening of the housing.

A housing that has been formed according to the geometric principle above is still more delicate and intuitive to handle. Thus, there is the "active" end which serves the stimulation, in the longitudinal axis of the housing, whereby the "rotation and pivot point" of application is easier for the user to ascertain. In the same way, the housing design is simplified since the housing can now be formed asymmetrically (in terms of length) for example, whereby the production becomes more cost efficient.

According to a development of the invention, a stimulation device is provided, wherein the hollow space can be controlled by means of the drive unit or can be supplied with forces in such a way that a pressure field that preferably acts in the direction of the longitudinal axis of the housing is generated in the hollow space, said pressure field being aimed by means of the opening of the hollow space at the erogenous zone for the stimulation thereof. Thus, the pressure field is aligned on the longitudinal axis of the stimulation device, whereby an accurate and delicate positioning of the stimulating pressure field is advantageously facilitated. In particular, "targeting" the target region or the erogenous zone along the elongated housing is again facilitated and can take place more intuitively.

According to a development of the invention, the hollow space can be set up by means of the pressure field in such a way that the longitudinal axis of the stimulation device intersects or penetrates the pressure field. A housing formed according to the geometric principle above having the hollow space is more delicate and intuitive to handle.

According to a development of the invention, a stimulation device is provided, wherein the housing has a central section that is formed for holding the stimulation device with one hand adjacent to the front end in the longitudinal direction, said section being formed or arranged to extend along the longitudinal axis and in the peripheral direction around the longitudinal axis, in particular only across a peripheral section.

As a result of this central section, again holding the stimulation device in the manner of a pen is encouraged. Furthermore, the central section can have a haptically advantageous material, for example rubber or silicone, so that it can be gripped better. Furthermore, the central section directly or immediately connects to the front end, whereby the elongated stimulation device can have a haptically advantageous material not only on the front end, but also with the section behind it. This takes into consideration that, in the central section, there is an increased probability that this can also come into contact with other parts of the skin, for example the thighs or the labia of the user. Thus, the stimulation device is formed to be haptically (and tactilely) and ergonomically advantageous.

The central section can also be formed, in particular, only across a peripheral section, which saves material and coating materials, for example. Thus, the central can be provided only for the resting surface of the finger.

According to a development of the invention, a stimulation device is provided, wherein the central section extends over at least 30%, preferably over at least 40%, further preferably at least 50% of the axial extension of the longitudinal axis 80 and optionally up to a maximum of 70% of the axial extension of the longitudinal axis.

Tests by the inventor have proved that a certain minimum length of the central section is required in order to sufficiently provide an area for gripping with fingers.

According to a development of the invention, a stimulation device is provided, wherein the stimulation device has a centre of mass that is arranged closer to the back end than the front end, when seen in the longitudinal direction.

When holding the stimulation device in the hand in the ways described in more detail above in the manner a pen or in the manner of a pommel, it is advantageous when the centre of mass is closer to the back end, when seen in the longitudinal direction, than to the front end. Thus, the front (lighter) end, for example, can be moved in an easier and more delicate manner, when the (heavier) back end rests on the outer surface of the hand or in the inner surface of the hand.

According to a development of the invention, a stimulation device is provided, wherein the longitudinal axis represents an approximate axis of symmetry of the housing. Such a symmetry leads to advantages in terms of production, for example it is possible to use the parts for the housing multiple times (for example, half shells can be used); or the construction of the product is simplified. In addition, a housing having such an axis of symmetry has a centre of mass which can be arranged on or adjacent to the longitudinal axis, which, in turn, improves the ability of the housing the be handled or balanced.

According to a development of the invention, a stimulation device is provided, wherein the hollow space has a wall, which consists of a flexible material, and the wall forms the opening of the housing, and the wall on the front end also forms the outer wall of the housing. Thus, this wall preferably forms the resting surface of the housing on the skin.

Thus, not only the direct (front) contact surface of the wall of the opening of the hollow space with the corresponding part of skin is formed from a flexible (haptically and tactilely advantageous) material, such as silicone or rubber, for example, but the outside of the front end of the housing of the stimulation device according to the invention is also correspondingly formed. This improves the tactile perception that the user obtained from the housing. For example, the outer labia can be brought into contact with the (outer) wall of the front end, when the stimulation device is placed over the clitoris.

According to a development of the invention, a stimulation device is provided, wherein the hollow space has an alignment axis which is defined by the alignment of the current(s) of the medium when generating the pressure field (or the positive pressure) in the region of the opening; and the alignment axis intersects the longitudinal axis at an angle which is less than or equal to 50 degrees, preferably less than or equal to 35 degrees; or the alignment axis is arranged substantially in parallel to the longitudinal axis. If the hollow space, for example, is formed cylindrically behind the opening of the housing running into the depths of the housing, then the currents, for example, can be directed towards and away from the opening, alternating temporally, along the direction of the central axis of this cylinder.

Thus, the alignment axis is arranged in parallel or having a small (flat) angle in relation to the longitudinal axis of the stimulation device. Thus, the handling, in particular the kind of delicate alignment of the pressure field generating stimulation, is thus improved, according to experiments by the inventor.

According to a development of the invention, a stimulation device is provided, wherein the drive unit is an electric motor having a drive shaft or axis; and the central axis of the drive shaft or axis of the electric motor is arranged substantially in parallel to the alignment axis, which preferably aims at the erogenous zone to be stimulated. It is also preferred that the central axis of the drive shaft of the electric motor is arranged in parallel to the longitudinal axis.

The electric motor and the eccentric cam arranged on the axis is the source of oscillations or vibrations which are aligned substantially perpendicular to the axis because of the unbalance of this arrangement. The axis of rotation of the eccentric cam often does not correspond to the main inertia axis. As a result, the axis of the motor vibrates or oscillates and thus the motor and consequently also the housing do so too, in a direction that is perpendicular or at a right angle to the central axis of the axis of the motor. In conventional L-shaped arrangements, the erogenous zone to be stimulated is consequently found in the substantial propagation region or in the direction of these oscillations or vibrations. With reference to FIG. 3 of the prior art, the substantial propagation direction corresponds to the oscillations or vibrations of the axis 81*a*. As a result, these oscillations transfer to the body of the user via the wall of the hollow space and via the contact surface of the wall, which can disturb the user.

On the other hand, the alignment axis and the central axis of the axis of the electric motor are aligned to be coaxial relative to each other, wherein oscillations or vibrations in the direction of the axis of the motor axis are clearly less pronounced than when perpendicular thereto. The previous development uses this knowledge, wherein the alignment axis and thus the erogenous zone are arranged in the direction of the axis of the motor axis. In this direction, the oscillations or vibrations of the electric motor having the eccentric cam are thus less pronounced, and do not disturb the user, or disturb her substantially less.

Preferably, the alignment axis and the central axis of the axis of the electric motor are aligned to be coaxial to each other, wherein oscillations or vibrations are the least pronounced in this kind of arrangement.

Alternatively, the alignment axis and the central axis of the axis of the electric motor can form an angle of the axes relative to each other of ≤30 degrees, preferably ≤15 degrees, wherein tests have shown that, even with the above angle regions, a perceptible reduction of the pronouncement or strength of the vibrations or oscillations of the opening of the hollow space/housing takes place.

According to a development of the invention, a stimulation device is provided, wherein the pressure field generation device has a flexible wall, which can be displaced by the drive unit; and the direction of the displacement of the flexible wall is provided at an angle of preferably >45 degrees ≤90 degrees, in particular 90 degrees, relative to the alignment axis.

Not only the motor having the eccentric cam generates unwanted oscillations or vibrations, but also unwanted oscillations or vibrations are generated on the flexible wall of the hollow space. These vibrations or oscillations also have a propagation direction which takes place in the direction of the displacement of the flexible wall. Thus, analogously to considerations in terms of the vibrations or oscillations of the eccentric cam, the previous arrangement according to the invention can also again reduce the vibrations or oscillations.

According to a development of the invention, a stimulation device is provided, wherein the pressure field generation device is formed in such a way that is has at least one damping element.

This represents a further measure in order to reduce the vibrations or oscillations of the stimulation device of the pressure field generation device. Such a damping element is a silicone bearing which is arranged between the eccentric cam and the flexible wall. Alternatively, the damping element can be a silicone or rubber damper (which is preferably formed in a hollow cylindrical shape in such a way that is can be inserted in screw connections) that is arranged between the fixing points of the pressure field generation device and the complementary suspension bracket of the housing. Similarly, the damping element can also alternatively be a sheathing of the motor made of an elastic material. For example, the motor can be wrapped in sponge and fixed in the housing.

According to a development of the invention, a stimulation device is provided, wherein the damping element is arranged between the opening and the electric motor or the flexible wall mechanically or in terms of current in such a way that vibrations and/or sounds that are generated inside the housing are damped in the direction of the opening.

In the arrangement presented above, the damping element is preferably a cushion-shaped or cuboid attenuator made of silicone or rubber, which is arranged in the longitudinal direction between the motor (or the flexible wall) and the opening. The damping element here preferably covers a large part of the cross-sectional area of the housing, when seen in the longitudinal direction, in order to provide an effective damping effect. Here, the mechanical oscillations or vibrations, i.e. those transferred via the solid body, are damped in the longitudinal direction of the housing. The damping element can here be inserted or arranged adjacent to the front end of the housing in the internal space of the housing or, for example, between the front end and the central section of the housing.

Alternatively or additionally, if the damping element is used as a damping element in terms of current, then the acoustic oscillations in the medium, which are generated in the first chamber, can be damped (for example, the flexible wall oscillates; in addition, there are unwanted current sounds on edges or narrow points in the hollow space). Thus, the damping element has a channel in which acoustic oscillations, in particular in a frequency range of ten to a few hundred Hertz, are effectively damped (for example by more than 6 dB).

According to a development of the invention, a stimulation device is provided, wherein the damping element has a channel which runs in an S-shape, and/or the channel is coated or lined with a sound-damping material on its inner wall.

The two measures carried out above of the S-shaped course and the coating having a sound-damping material serve to improve the sound-damping effect of the damping element. Because of the S-shaped course, a sound wave from the first chamber can no longer outwardly propagate in a straight line and in an undamped manner. Thus, the volume of the stimulation device during operation is reduced.

Preferably, the two openings of the S-shaped channel have opening planes running in parallel to each other.

According to a development of the invention, a stimulation device is provided, wherein the damping element consists at least partially of silicone, vinyl or rubber. These are materials by means of which the necessary components can be produced cost effectively and in different shapes, while at the same time these materials have good (acoustic and mechanical) damping properties.

According to a development of the invention, a stimulation device is provided, wherein the housing has the central section adjacent to the front end, said central section having at least two gripping surfaces.

The two gripping surfaces can be used by the user as orientation aids as to how the fingers are to be placed on the housing of the stimulation device. In addition, these gripping surfaces can also be provided with a rubber coating or a "grip", in order to improve the hold of the stimulation device or in order to prevent slippage when the stimulation device has become greasy or slippery.

According to a development of the invention, a stimulation device is provided, wherein the housing has the central section adjacent to the front end, the central section being formed completely as a gripping section.

Preferably, the whole central section can thus be formed as a gripping section, so that the user has a high degree of freedom in how she holds the stimulation device. It is preferred that the central section is therefore formed completely out of silicone or rubber or consists of silicone or rubber, or, on the other hand, the central section is coated completely or in a patterned manner by a material that offers the user a good hold for the hand.

According to a development of the invention, a stimulation device is provided, wherein the central section has an external contour which is formed to be round, oval, of equal thickness or a regular polygon, seen in the cross-sectional direction or in the cross-sectional plane of the central section.

The external contours according to the invention offer the advantage that they are relatively simple to manufacture. In particular, an external contour that is of equal thickness in the longitudinal direction of the housing and the central section can be guided easily by hand, since the surfaces fit well into the anatomy of the hand. An external contour in the shape of a Reuleaux triangle is therefore particularly preferred, wherein the three outer edges or corners can additionally be rounded off easily. Here, it is also advantageous that material is saved, since a cylinder having an equal external radius has more wall surfaces.

According to a development of the invention, a stimulation device is provided, wherein the front end of the housing consists of silicone or rubber, and is preferably formed exchangeably as the head of the stimulation device.

An exchangeable front end has the advantage that it can be easily replaced when closing, or also that cleaning the stimulation device after use is made easier.

According to a development of the invention, a stimulation device is provided, wherein the silicone of the front end is medical silicon having a pressure-elasticity module less than 0.1 $N/mm^2$, preferably less than 0.05 $N/mm^2$, in particular less than 0.01 $N/mm^2$.

The head of the pressure field generation device can consist, in particular, of silicone, preferably of silicone rubber or silicone elastomer, which can be relatively elastic or soft.

Conventionally, the silicones are used in common stimulation devices for the clitoris which have an elasticity module (E-module) of more than 0.5 $N/mm^2$ (or a thrust module/G-module of more than 0.2 $N/mm^2$) so that they remain permanently stabile and can be permanently fixed. The citations (cf. Linder-Ganz E, Shabshin N, Itzchak Y, Gefen A. Assessment of mechanical conditions in subdermal tissues during sitting: a combined experimental-MRI and finite element approach; and: Zahouani H, Pailler-Mattei C, Sohm B, Vargiolu R, Cenizo V, Debret R. Characterization of the mechanical properties of a dermal equivalent compared with human skin in vivo by indentation and static friction tests. Skin Res Technol 2009; 15:68-76; and Wu J Z, Cutlip R G, Andrew M E, Dong R G. Simultaneous determination of the nonlinear-elastic properties of skin and subcutaneous tissue in unconfined compression tests. Skin Res Technol 2007; 13:34-42; and Jessica L. Sparks, PhD; Nicholas A. Vavalle, M S; Krysten E. Kasting; Benjamin Long, M S; Martin L. Tanaka, PhD; Phillip A. Sanger, PhD; Karen Schnell, MSN; and Teresa A. Conner-Kerr, PhD, Use of Silicone Materials to Simulate Tissue Biomechanics as Related to Deep Tissue Injury, ADVANCES IN SKIN & WOUND CARE & VOL. 28 NO. 2, 2015) state values of the thrust module (G-module) of the skin in the region of 2.8 m-31.9 kPa (c. 0.0028 $N/mm^2$-0.0319 $N/mm^2$).

With the regions of skin concerning the clitoris, it can be assumed that these have a thrust module (G-module) that is preferably settled in the low region between c. 2.8 kPa and 15 kPa (c. 0.0028 $N/mm^2$-0.015 $N/mm^2$).

Because of the clear differences presented above of the elasticity moduli or the thrust moduli of silicone relative to skin, in common stimulation devices having silicone heads, the edge of the opening 41 of the second chamber (4*a* and 4*b*) is often seen as too "hard" by the users of stimulation devices for the clitoris.

It is tactilely advantageous if the silicone material has elastic properties which correspond or at least come close to the elastic properties of the human skin and the tissue lying below. As a result of this adjustment of the elastic properties, the silicone head is seen as more pleasant and softer.

As a result, it is advantageous when the silicone head according to the invention consists of a silicone which has an elasticity module (E-module) of less than 0.1 $N/mm^2$. Analogously, this would correspond to a thrust module (G-module) of less than 0.04 $N/mm^2$. A yet softer or more elastic material is also seen as even more pleasant.

Correspondingly softer silicone heads can be fixed permanently on the stimulation device according to the invention by means of a support piece (that is integrally formed with the silicone head and adhered thereto) or a support body. Several silicone heads can be supplied with the stimulation device for exchanging when sealing.

According to a development of the invention, a stimulation device is provided, wherein the silicone of the front end has additives, in particular stabilisers or dyes.

Preferably, when producing the front end from silicone, coloured pastes can additionally be added which give the silicone the red (for example RAL 3020) or red-violet (RAL 4002) colour.

When producing the silicone head according to the invention, a platinum-catalysed addition crosslinking can also be used. Here, it is advantageous that here there is no smell or taste to the silicone, and a quick vulcanisation and thus short cycle times can be achieved.

According to a development of the invention, a stimulation device is provided, wherein the housing is completely or partially encased by a layer made of silicone, rubber or vinyl. Thus, further parts of the stimulation device can also be formed to be haptically advantageous in order to facilitate further kinds of handling or holding with the hand.

According to a development of the invention, a stimulation device is provided, in which a cup-shaped (or half-open) cap, which can be applied to or stuck on the housing, such that the cap covers at least the opening of the hollow space.

Such a cap improves the transportability and the hygiene of the stimulation device, since the opening of the hollow space is covered. Since the opening of the hollow space is regularly used in the private parts, the cap according to the invention protects the opening, and thus also the hollow space, from dirt ingress. If the front end of the stimulation device is also formed from (soft) silicone, then this end is sensitive towards mechanical loads. Thus, the cap also protects the front end of the stimulation device from mechanical damages.

The cap according to the invention can have a cross-sectional shape which corresponds to the external cross-sectional shape of the housing. For example, the cross-sectional shape of the cap can be of equal thickness, round, oval or regularly n-cornered.

According to a development of the invention, a stimulation device is provided, wherein the cap according to the invention is dimensioned in such a way that it can be put or placed on the stimulation device up to a stop, such that the front end and the central section are covered (preferably completely) by the cap.

Thus, advantageously, not only the opening and the front end of the stimulation device can be covered and protected by the cap, but also the grip regions which can also consist of sensitive silicone or are coated with rubber.

According to a development of the invention, a stimulation device is provided, wherein the housing is set up in such a way that it is provided to be waterproof, preferably IP67, and the hollow space of the pressure field generation device is provided to waterproof, preferably IP67, in comparison to the inside of the stimulation device.

Thus, the hollow space in particular, in comparison to the rest of the inside of the stimulation device, is sealed in such a way that it corresponds to the (standardised EU) IP67 specifications. This is therefore possible with the stimulation device according to the invention, since the hollow space according to the invention has only one single opening to the outside of the housing, and, on the other hand, no opening (for example via a valve) into the (further) housing inside. With such a sealing according to IP67, further usage possibilities of the stimulation device, for example in a swimming pool, open up, wherein, because of the relatively high IP classification, the reliability of the device is also ensured. Furthermore, all bushing that is possibly present for the current supply are to be sealed, for example by means of corresponding plugs which can be inserted in the bushing.

According to a development, the hollow space of the pressure field generation device has at least one first chamber and at least one second chamber having the opening for placing over the erogenous zone and at least one connection element having at least one opening into the second chamber, wherein the connection element connects the first chamber to the second chamber; and wherein the drive unit can change the volume of the first chamber by displacing the flexible wall in such a way that the pressure field is generated via the connection element in the second chamber, said pressure field serving the stimulation.

According to a development of the invention, a system having a stimulation device and a bracket for storing and charging the stimulation device is provided, wherein the charging bracket has an (inductive) bracket-side charging coil, and the stimulation device has a complementary stimulation-device-side charging coil, and the battery of the stimulation device can be charged by means of inductive coupling of these charging coils when the stimulation device is deposited in or on the loading bracket, wherein the stimulation device does not have any bushing for supplying current.

This allows a wireless or cable-less charging of the stimulation device according to the invention. In this case, no connections of the stimulation device are necessary in order to provide it with energy, for example in order to charge its battery. The stimulation device is then formed to be free from bushing or connector free.

According to a development of the invention, a system having a stimulation device, as is described above, is provided, wherein the bracket-side charging coil and the stimulation-device-side charging coil are arranged in such a way that these are arranged to be adjacent to each other when the stimulation device is deposited in or on the charging bracket.

According to a development of the invention, the stimulation device is set up without a gun handle.

According to a development of the invention, the stimulation device is set up without valves.

Furthermore, the use of the stimulation device for sexual pleasure and not for medical or therapeutic purposes is proposed.

In the present invention, the methods described below in more detail serve the stimulation of erogenous zones for sexual pleasure, therefore the methods do not serve medical, for example therapeutic, purposes.

According to a further aspect of the invention, the use of the stimulation device according to the invention as a sex toy for stimulating the female clitoris is proposed according to a further aspect of the invention. As explained at the start, the female clitoris is a particularly sensitive erogenous zone for the woman, which is why the use according to the invention of an indirect positive pressure stimulation in combination with a negative pressure stimulation for the clitoris seems to be particularly advantageous for stimulating to orgasm or to the sexual high point.

According to a development, the stimulation device, preferably in the front end and the central section, is formed uniformly. Here, uniformly means, in particular, that the transitions between the individual housing sections are formed to be gap free. Preferably, the transitions from the front end to the central section (and vice versa) are seamless or gap-free, or at least retain the shape. This improves the hygiene and the operability of the stimulation device.

The previously described features and functions of the present invention and further aspects and features are subsequently described further by means of a detailed description of preferred embodiments with reference to the attached figures. In the figures, the same features/elements and features/elements with the same function are characterised by the same reference numerals.

BRIEF DESCRIPTION OF THE DRAWINGS

Shown is/are.

DETAILED DESCRIPTION

Figure 1:
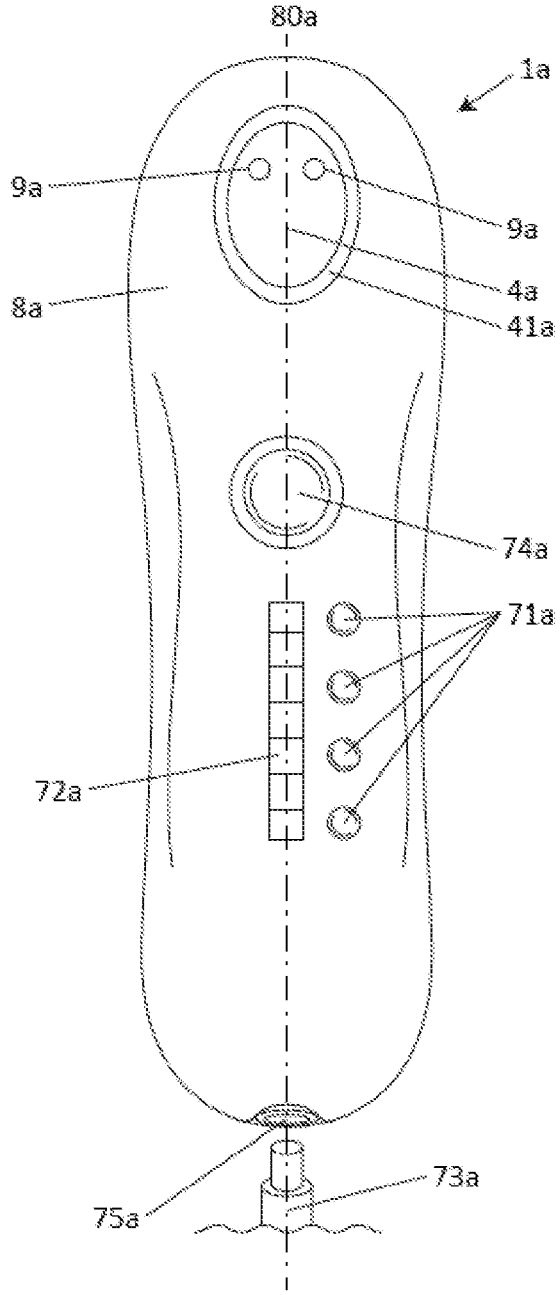
Fig. 1 Prior art
FIG. 1 a front view of an embodiment of a stimulation device of the prior art.
Figure 2:
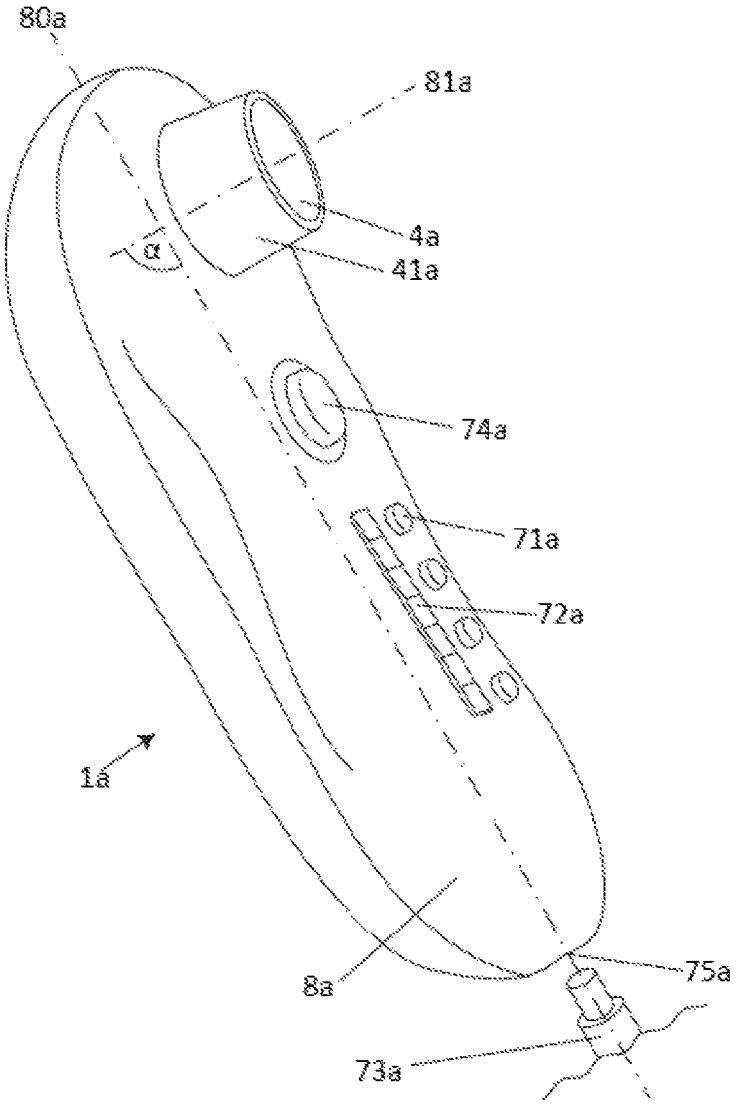
Fig. 2 Prior art
FIG. 2 a perspective side view of a stimulation device of the prior art.
Figure 3:
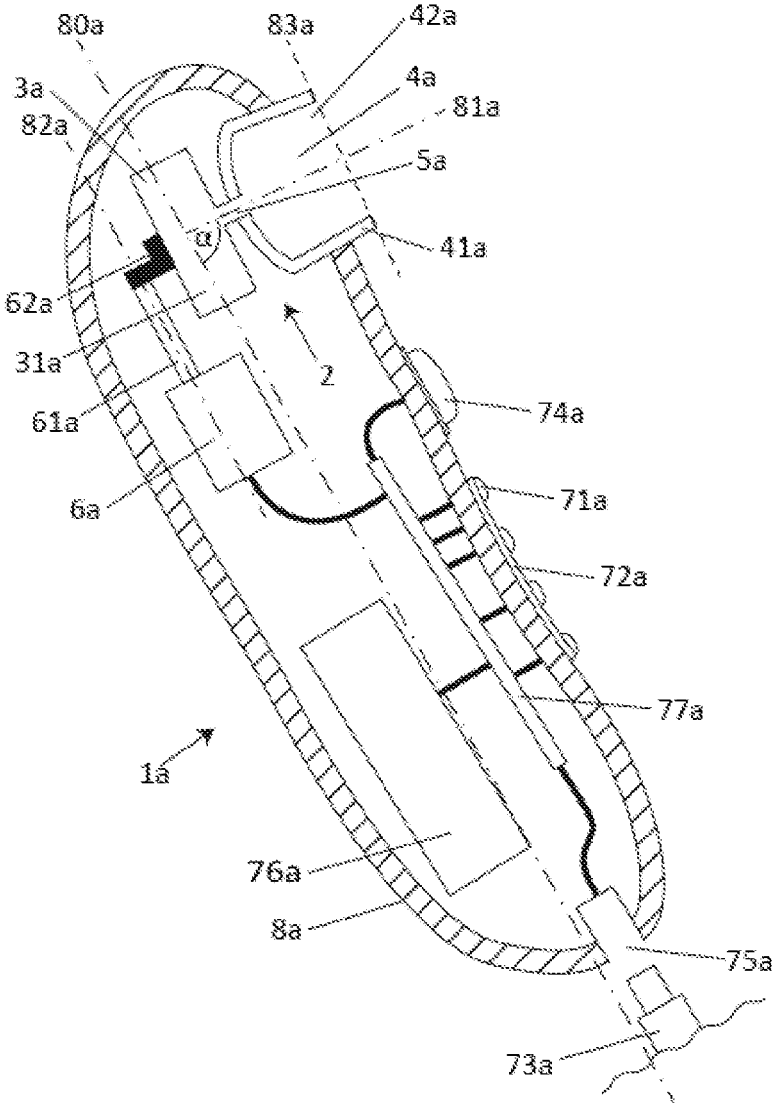
Fig. 3 Prior art
FIG. 3 a cross-section of a stimulation device of the prior art.

In the section below, the same or identical features, which have already been described in more detail in terms of the preceding embodiment with reference to a preceding aspect are not explained again in order to avoid repetitions. The same reference numerals refer, in general, to the same features, or those with a corresponding function.

With reference to FIG. 7 *a*), a side view of a stimulation device 1 according to the invention of a first embodiment and, with reference to FIG. 7 *b*), a view of the stimulation device 1 according to the invention of FIG. 7 *a*) from behind is explained in more detail.

FIGS. 7 *a*) and 7 *b*) show an elongated and rod-shaped stimulation device 1 having a housing 8 (for example made of ABS plastic), and a front end 90, a back end 91, wherein the stimulation device 1 is formed to be circular in terms of its cross section or in terms of the external contour on its cross-section plane. In the back end, an on/off switch 74 is provided, which optionally has a lighting element for displaying the switching state. An optional display 72 can relay the current setting of the modulation pattern or the strength of the stimulating pressure field. A central section 88 is optionally coated with silicone, while the gripping surface 89 (and a further gripping surface 89 on the side facing away that is not depicted in more detail) in the form of an elongated oval surface (for example as a Lame oval) determines the preferred placement position for the finger and ensures a good hold for the finger. These gripping surfaces 89 can be shown by colour, for example, or an additional rubber coating can be applied on the surface of the central section 88.

A cup-shaped cap 85 that is complementary to the front end 90 or that fits in terms of shape is formed in such a way that—much like a cap of a pen—it can be placed on the front end 90. The cap 85 covers (and protects) the front head or the wall 41 and the opening 42 of the stimulation device 1 in the placed-on state and reaches up to the passage or the intersection of the wall 41 on the front end 90 relative to the central section 88 in the longitudinal direction.

Preferably, the outer diameter of the cap 85 in the transverse direction is the same as the external diameter of the housing 8 in the transverse direction.

The opening 42 of the stimulation device 1 is arranged in the front end 90, wherein the longitudinal axis 80 penetrates the opening 42. The directions "to the front" and "to the back" are correspondingly shown by the arrows in the Figure. The front end 90 is the "active" end which is used for the stimulation by means of the pressure field.

The opening 42 is formed to be chamfered or at an angle in relation to the longitudinal axis 80, which is why the opening plane 83 (which is defined by the outer edges of the opening) is intersected by the longitudinal axis 80 at an angle δ. This angle is preferably 60 degrees (±5 degrees). The axis labelled with the reference numeral 81 depicts the alignment axis 81 of the hollow space 10 of the stimulation device 1 according to the invention. Thus, the hollow space 10 and the opening 42 are formed in a current-technical manner in the region of the opening 42 in such a way that the pressure field has preferred directions in term of current (of the forward and backward movement of the medium) at the opening 42 of the housing 8 along the alignment axis 81 in the non-placed state of the stimulation device 1.

The on/off switch 74 can preferably be formed to be embedded in the housing 8 so that it does not protrude from the housing 8.

Figure 7A:
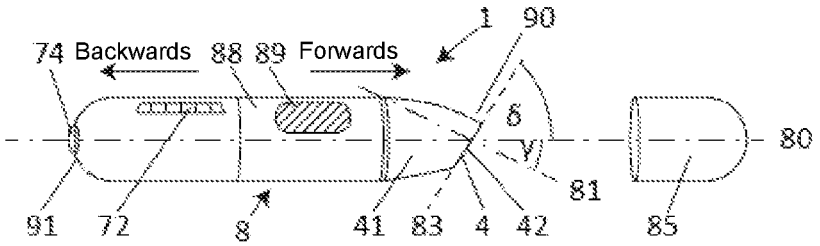
FIG. 7*a* a side view of a stimulation device according to the invention of a first embodiment.
Figure 7B:
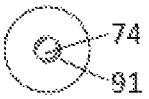
FIG. 7*b* a view of the stimulation device according to the invention from FIG. 7*a*, from behind.

The longitudinal axis 80 is an imaginary line between the front end 90 and the back end 91, which presently also depicts the axis of symmetry for the base shape of the housing 8 in FIGS. 7*a* and 7*b*. In these symmetry considerations, operating elements 74, displays 72 or gripping surfaces 89 are not taken into consideration, which represent only marginal adjustments of the base shape of the housing 8.

The alignment axis 81 preferably intersects the longitudinal axis 80 at an angle γ of 30 degrees, while the opening plane 83 is arranged at a right angle to the alignment angle 81.

Thus, the stimulation device 1 according to the invention has a compact, narrowly elongated construction. This leads to weight savings and an ergonomic operability of the device 1. Preferably, the stimulation device 1 of FIGS. 7 *a*) and 7 *b*) is implemented to be waterproof (IP67). Therefore and because of the simple external shape of the stimulation device 1, it is easy to clean.

Figure 8A:
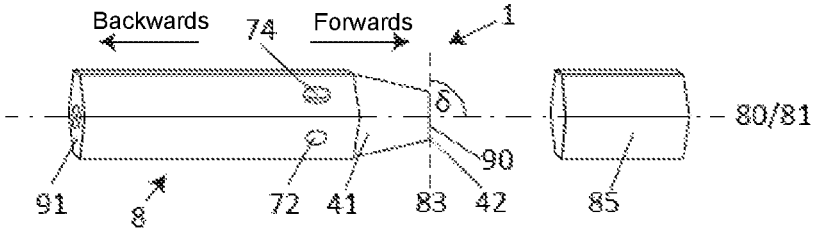
FIG. 8*a* a side view of a stimulation device according to the invention of a second embodiment.
Figure 8B:
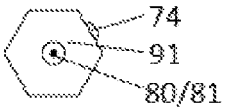
FIG. 8*b* a side view of the stimulation device according to the invention from FIG. 8*a*, from behind.

With reference to FIG. 8 *a*), a side view of a stimulation device according to the invention of a second embodiment and, with reference to FIG. 8 *b*), a view of the stimulation device according to the invention of FIG. 8 *a*) from behind is explained in more detail.

The second embodiment has a regular hexagonal housing 8 which has a flat back end 91. Thus, this housing 8 can be advantageously picked up or put down, as well without it rolling away. The housing shape thus serves as roll prevention. The opening plane of the opening 42 in the front end 90 of the housing 8 is arranged to be at a right angle (cf. angle δ) to the longitudinal axis 80. In this embodiment, the alignment axis 81 coincides with the longitudinal axis 80. The on/off switch 74 and the display 72 are arranged to be adjacent to the front end 80. The cap 85 is formed analogously, as in the first embodiment, and fits correspondingly to the housing shape of the housing 8 of the second embodiment.

Figure 9A:
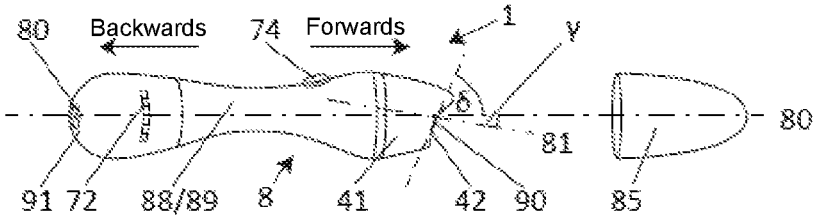
FIG. 9*a* a side view of a stimulation device according to the invention of a third embodiment.
Figure 9B:
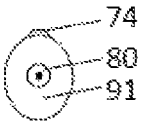
FIG. 9*b* a view of the stimulation device according to the invention from FIG. 9*a*, from behind.

With reference to FIG. 9 *a*), a side view of a stimulation device according to the invention of a third embodiment and, with reference to FIG. 9 *b*), a view of the stimulation device according to the invention of FIG. 9 *a*) from behind is explained in more detail.

The housing 8 of this embodiment is formed to be somewhat centrally waisted, and tapers correspondingly towards the centre. The two swellings or bulges—when seen in the longitudinal direction of the housing 8—to the left and right of the central tapering preferably both have the same maximum radius in the transverse direction. The housing 8 thus has a shape similar to that of a dog bone.

The cross-sectional shape of the housing 8 is approximately oval, and is preferably retained with the same width/height ratio across the entire length of the housing 8. This leads to the housing 8 lying comfortably in the hand, and does not easily roll away, if the stimulation device 1 is put down.

At the same time, the central section 88 forms the gripping surface 89 over its entire surface, wherein this preferably provides a rubbery coating. Furthermore, the central section 88 is formed via further parts of the housing 8 in the longitudinal direction. In synergy with the waisted shape of the housing 8, this leads to an ergonomic handling of the housing 8, since the housing 8 comes to rest in the narrow region in the middle in or on the hand, when the housing 8 is guided in the manner of a writing device. In addition, thumb and index finger rest on the front swelling of the housing 8 in this gripping position, which is more ergonomic.

In addition, the stimulation device 1 has the swelling or pommel-like cross-section enlargement on the back end 91. This advantageously leads to the stimulation device 1 having a kind of "pommel" or "head" on the back end 91, at which point the stimulation device 1 can be held comfortably in a closed hand (for example in a first hold), which also represents an ergonomic holding.

Alternatively, the swelling of the housing 8 can have a larger maximum radius in the transverse direction on the back end 91, like the front swelling.

The opening 42 of the hollow space of the stimulation device 1 has a slightly concave opening plane, since the front end of the opening 42 runs slightly wavy or wave-shaped in the front end 90 of the housing 8. In this case, the emerging opening plane is also slightly concavely curved or arched. Such a curvature of the opening plane leads to the opening 42 being able to be placed more pleasantly over the area of skin that is also (slightly) curved or not even, said area of skin surrounding the female clitoral glans. Thus, the opening plane 42 is adjusted in terms of its shape to the anatomy of the clitoris in such a way that the opening 42 can be placed in a form-fit manner or fitting to the area of the skin which surrounds the clitoral glans without significant pressing pressure. The angle of intersection δ of the opening plane 83 with the longitudinal axis 80 is determined in terms of the intersection point with the longitudinal axis 80, and is the smallest possible angle. An angle region of about 65 to 75 degrees was experimentally determined as the optimal angle δ for the use of such a curved opening plane 83 for using on the clitoris 12.

The cap 85 is formed to be analogous to the first embodiment, and fits correspondingly to the housing shape of the housing 8 of the third embodiment.

The angle of intersection γ between the alignment axis 81 and the longitudinal axis 81 is a pointed angle. Preferably, this is about 3 to 12 degrees, which, after experiments, has generally been proven to be a more pleasant angle region for handling for the user.

Figure 10A:
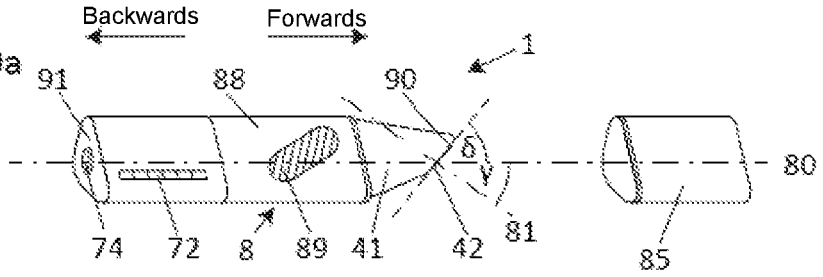
FIG. 10*a* a side view of a stimulation device according to the invention of a fourth embodiment.
Figure 10B:
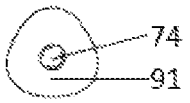
FIG. 10*b* a view of the stimulation device according to the invention from FIG. 10*a*, from behind.

With reference to FIG. 10 *a*), a side view of a stimulation device according to the invention of a fourth embodiment is explained in more detail and, with reference to FIG. 10*b*), a view of the stimulation device according to the invention of FIG. 10 *a*) from behind is explained in more detail.

FIG. 10*a* shows a housing that is triangular in terms of its cross-section, which is formed to be elongated. Preferably, the external shape is designed to be of equal thickness in the cross-section directional to save material and weight. Thus, on the one hand, a very light and compact housing can be realised, while on the other hand, a triangular housing of equal thickness fits well to the anatomy when holding the housing 8 with thumb and index finger in the manner of a writing device, and is therefore ergonomic.

The on/off switch, in turn, is realised to be embedded in the back end 91 of the housing 8 so that the device 1 can be placed upright on a table, for example, by means the flat back end.

The gripping surfaces 89 (one of which is not depicted in more detail, since this is arranged to be covered on the side of the triangle that is of equal thickness that is facing away) are realised to be elongated ovals, and arranged in such a way that they constitute the support surface of the finger on the housing 8 when the housing 8 is guided in the manner of a writing device. The two gripping surfaces are thus arranged to be asymmetrical. The gripping surface 89 depicted in FIG. 10*a* is provided for the thumb of a left-handed person. The gripping surface not depicted in more detail would be arranged to correspond to the (imaginary) position of an index finger on the other side of the triangle in an elongated oval shape rather than in the direction of the longitudinal axis 80 of the housing 8. Thus, the gripping surfaces can be adjusted in terms of their flat arrangement fundamentally to the anatomy of the hand and the finger of the users (particularly preferably after determining whether the present user is right-handed or left-handed).

In additional, the gripping surfaces 89 can also be formed as trough-shaped indents in the central section 89. Alternatively, the gripping surfaces 89 can have corresponding rubber coatings in order to improve the grip of the device.

The cap 85 according to the invention is formed to be analogous to the first embodiment, and fits correspondingly to the housing shape of the housing 8 of the third embodiment and continues the housing shape in the longitudinal direction 80.

Figure 11A:
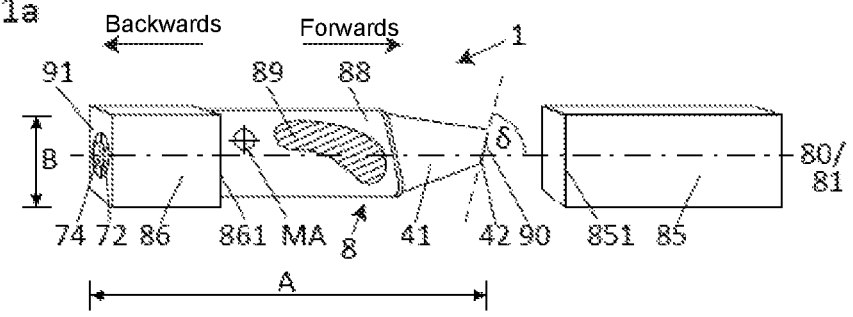
FIG. 11*a* a side view of the stimulation device according to the invention of a fifth embodiment.
Figure 11B:
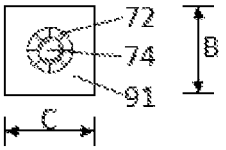
FIG. 11*b* a view of the stimulation device according to the invention from FIG. 11*a*, from behind.

With reference to FIG. 11 *a*), a side view of a stimulation device according to the invention of a fifth embodiment and, with reference to FIG. 11 *b*), a view of the stimulation device according to the invention of FIG. 11 *a*) from behind is explained in more detail.

In the fifth embodiment, the external shape of the cross-section changes at the passage between the central section 88 to a back section 86. The central section 88 is preferably implemented to be triangular in terms of it cross-section having rounded corners or edges (in particularly of equal thickness; alternatively, the central section 88 of this embodiment can also be formed to be round or oval). The back section 86 is preferably formed to be cuboid or quadratic in terms of cross-section (alternatively, it can be formed to be rectangular or even spherical; the latter leads to forming a ball or button-shaped holding pommel on the back end 91 of the stimulation device 1). Here, these parts are preferably arranged in the back section 86 of the housing 8, said parts being heavy or having a high weight, for example the battery. Thus, the centre of mass MA of the housing 8 of the stimulation device 1 is further placed towards the back in the direction of the back end 91, which leads to better handling.

The ratio of length A to width B (which is the same as height C) of the housing is preferably ≥3.5 (three point five), in particular ≥3.9 (three point nine). Because of this elongated embodiment, the housing 8 can be handled more easily and more ergonomically.

The display 72 is implemented on the back end 91 of the housing 8 in the form of an LED display surrounding the on/off switch. Thus, the user intuitively associates the display of the switching state with the corresponding on/off switch, and vice versa.

Thus, the fifth embodiment is preferably characterised in that the external contour of the housing 8 changes from the central section 88 to the back section 86. In other words, the fifth embodiment is preferably characterised in that the central section 88 has a different external contour to that of the back section 86.

In comparison to the caps 85 of the first to the fourth embodiment, the cap 85 of the fifth embodiment is formed to be longer. When the cap 85 of the fifth embodiment is placed on the housing 8, then not only the front end 90 is surrounded by the wall 42, but also the central section 88. Thus, the edge 851 of the cap 85 abuts on the edge 861 of the back section 86, when the cap 85 is placed on the housing 8. If this cap 85 is placed on completely, then the stimulation device 1 gives off a uniform, elongated cuboid impression with which it is not immediately recognisable, what purpose the device 1 contained has. Therefore, in the present discrete, light and compact design of the stimulation device 1, the stimulation device 1 can be taken in the handbag in a discrete and hygienic manner, for example.

The angle δ between the plane of the opening 42 of the hollow space and the longitudinal axis 80 is about 80 degrees, preferably about 80 to 90 degrees, in particular about 90 degrees.

In the fifth embodiment, the alignment axis 81 can further preferably coincide with the longitudinal axis, i.e. these are preferably arranged coaxially relative to each other.

Below, with reference to FIG. 12 *a*), a side view of a stimulation device according to the invention of a sixth embodiment, with reference to FIG. 12 *b*), a view of a stimulation device according to the invention of the sixth embodiment from the front, and, with reference to FIG. 12 *c*), a view of a stimulation device according to the invention of the sixth embodiment from behind, and, with reference to FIG. 13, a perspective view of a 3D wireframe model of the sixth embodiment of the stimulation device according to the invention are explained in more detail.

In terms of its basic principle, this sixth embodiment is similar to the fifth embodiment, to which reference is made.

Figure 12A:
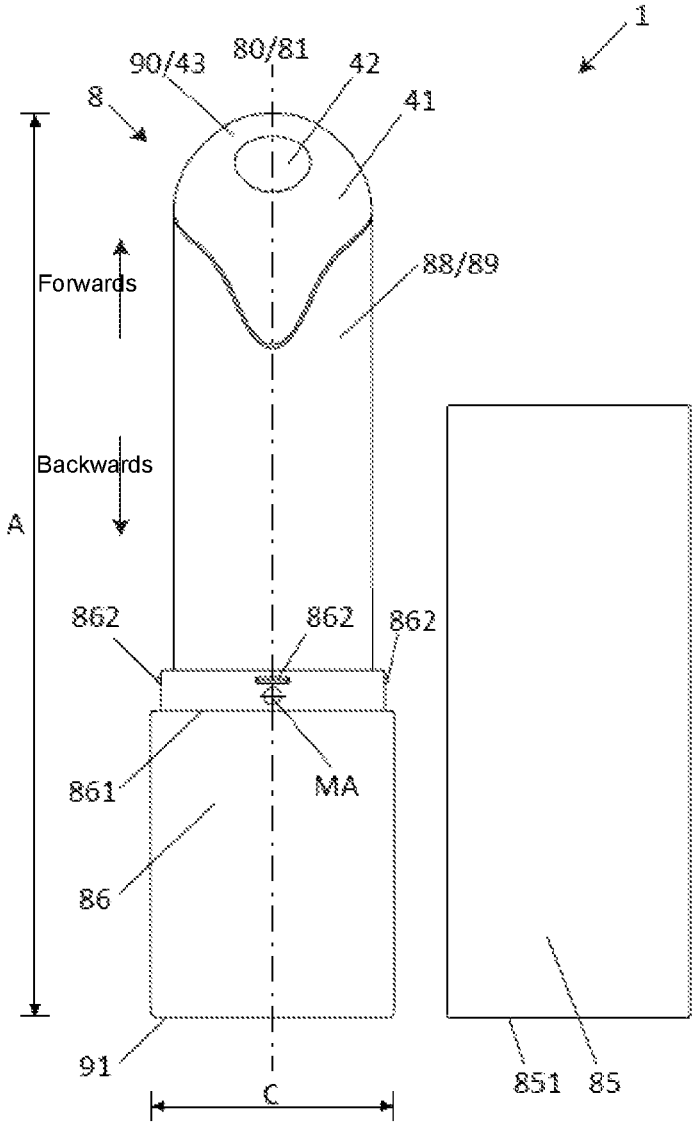
FIG. 12*a* a side view of a stimulation device according to the invention of a sixth embodiment.

An elongated housing 8, which is presently depicted standing upright in FIG. 12*a*, extends along a longitudinal axis 80 and has the opening 42 of a second chamber 4 on the front end 90. Furthermore, the housing on the front end 90 has a (flat) resting region 43 which comes into contact with the skin.

Latching closures 862 are provided for fixing the cuboid and hollow cap 85, said latching closures 862 latching when the cap 85 is pushed over the front end 90 and over the central section 88 of the housing 8 up to the opposite contact of the stop edges 861 and 851. In FIG. 12*a*, the cap 85 is depicted next to the housing 8 only for simplification.

The centre of mass MA of the stimulation device 1 is in the back section 86, whereby this can be handled better. Furthermore, the centre of mass is preferably set up in such a way that is in on the longitudinal axis 80. This also improves the handling of the stimulation device 1, since the lateral tipping moments are reduced or avoided. In addition, the previously explained position of the centre of mass is calibrated or set up by means of additional (small) weight elements inside the housing 8.

The longitudinal axis 80 represents an axis of symmetry or the cap 85, for the back section 86 and for the central section 88.

For example, the housing is about 4 cm wide (reference numeral C), and about 12 cm long (reference numeral A). Alternatively, the housing is about 3 cm wide, for example, (reference numeral C) and about 12.5 cm long (reference numeral A). Thus, it has been shown in the development of the stimulation device that the resulting internal volume of the housing with the previous alternative dimensions of the housing 8 has precisely sufficient space in order to receive the components (motor, battery, control device etc.) of the stimulation device 1.

Figure 12B:
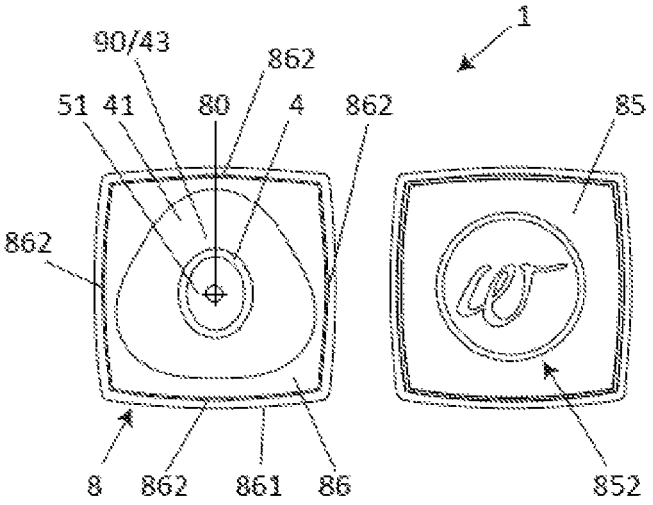
FIG. 12*b* a view of a stimulation device according to the inventions of a sixth embodiment, from the front.
Figure 12C:
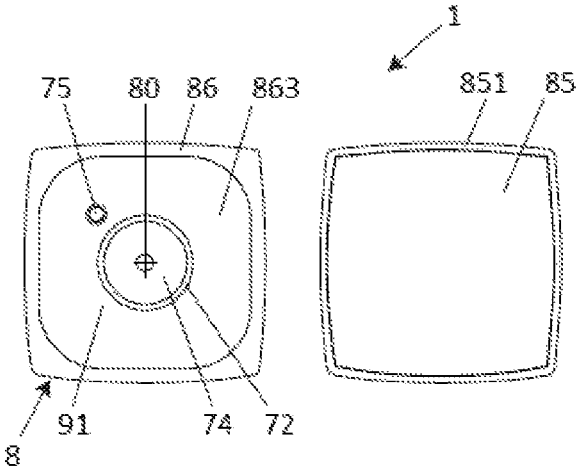
FIG. 12*c* a view of a stimulation device according to the invention of a sixth embodiment, from behind.

With reference to FIG. 12 *b*), which shows a view of the stimulation device 1 (or on the left side of FIG. 12 *b*), the housing 8 and on the right side of FIG. 12*b*, the cap 85) from in front, the external contour of the central section 88 and the head of the stimulation device 1 having the opening 42 can be seen. These are implemented to be approximately of equal thickness, which leads to the corresponding advantages that have been described previously.

The opening 51 of the connection element 5 into the second chamber 4 is formed to be oval. The second chamber is arranged along the longitudinal axis 80 in such a way that the alignment axis 81 of the hollow space according to the invention is in parallel to (preferably coaxially with) the longitudinal axis 80 of the housing 8. The second chamber 4 is provided having its corresponding wall 41 to be able to be placed or exchanged. The opening 42 of the second chamber 4 is implemented to be oval. The second chamber 4 widens in terms of current of a diffuser from the opening 51 in the direction of the opening 42, in order to facilitate the formation of the positive pressure of the pressure field according to the invention.

Furthermore, in FIG. 12 *b*), on the right-hand side, a top view of the cap 85 according to the invention 85 is depicted. This has a quadratic base cross-section, which is implemented to be slightly bulged. In the middle on the end surface of the cap, space is provided for a logo 852.

FIG. 12 *c*) shows a view from behind of the stimulation device 1 (or, on the left-hand side, a back view of the housing 8 and, on the right-hand side, a back view into the cap 85). On the back side of the housing 8, in the middle within a repositioned or embedded end surface 863, an on/off switch 74 having a corresponding light ring 72 is provided as a display. Furthermore, a bushing 75 for the connection of a current supply is provided. This bushing can be closed with a correspondingly sealing stop.

Figure 13:
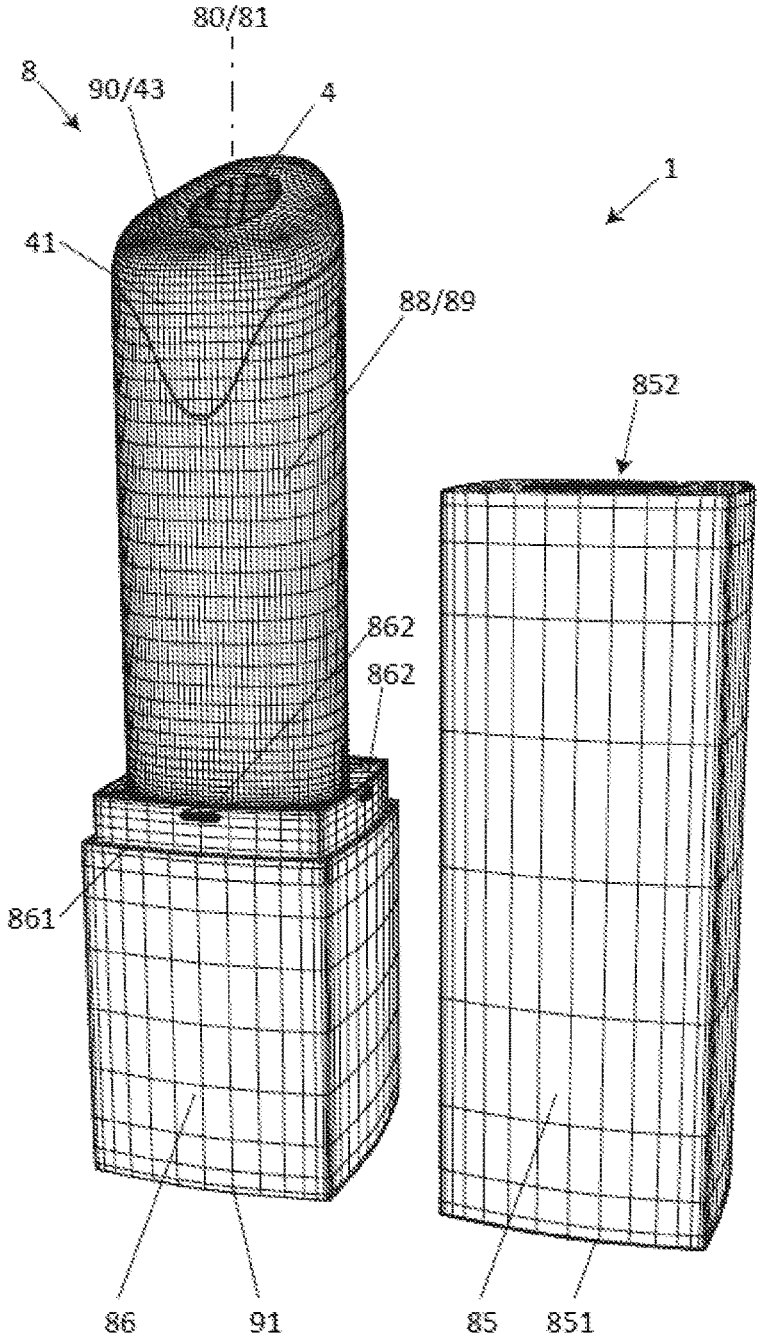
FIG. 13 a perspective view of a 3D wireframe model of the sixth embodiment of the stimulation device according to the invention.

The perspective view of the sixth embodiment of FIG. 13 represents, in particular, the slightly slanted, widely implemented front surface of the wall 41 of the pressure field generation device 2. With the preferably widened support surface 43 or the placing region 43 of the wall 41 for placing over the clitoris, the pressure is distributed across the surface, which is more pleasant during use. Thus, the usual relatively sharp and uncomfortable edges of openings of stimulation devices of the prior art are replaced by the resting surface 43 or the placing region 43 according to the invention, which has a surface which is arranged (approximately) in parallel to the opening plane 83 and completely surrounds the opening 42.

Figure 14:
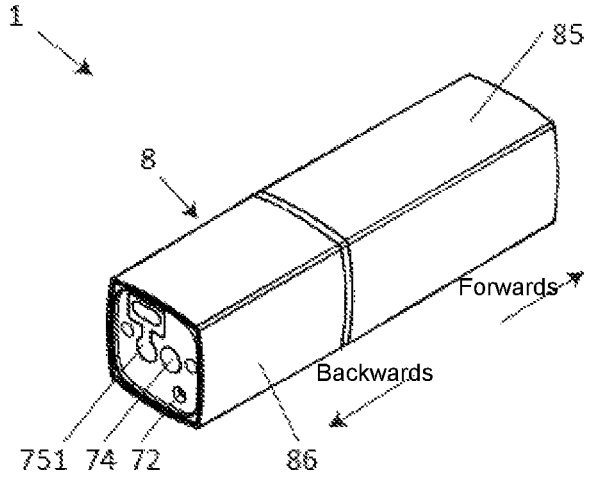
FIG. 14 a perspective view of a stimulation device according to the invention of a seventh embodiment with a closed cap.
Figure 15:
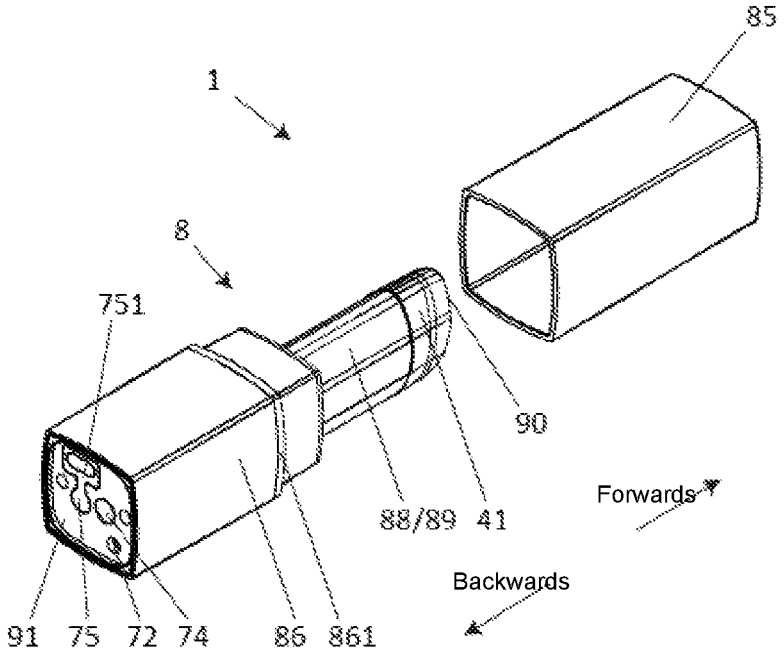
FIG. 15 a perspective view of a stimulation device according to the invention of a seventh embodiment with a cap open forwards.
Figure 16:
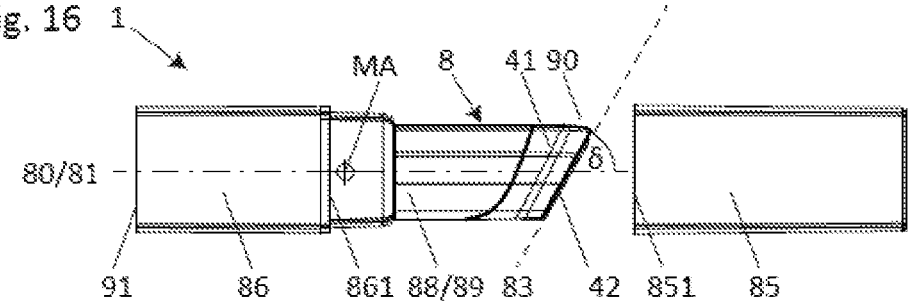
FIG. 16 a side view of a lying stimulation device according to the invention of a seventh embodiment with an open cap.
Figure 17:
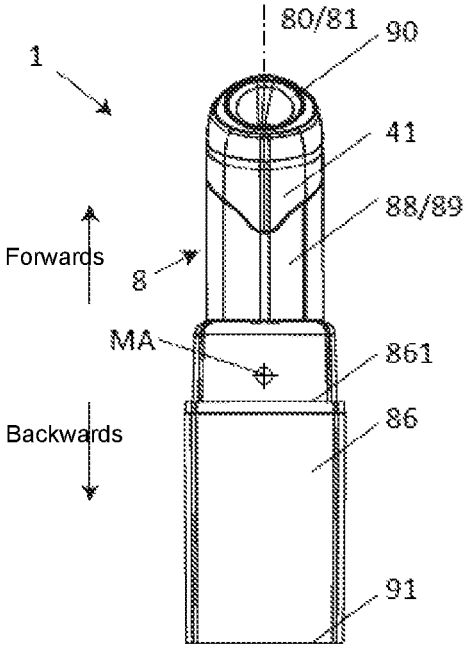
FIG. 17 a side view of a standing stimulation device according to the invention of a seventh embodiment without a cap.
Figure 18:
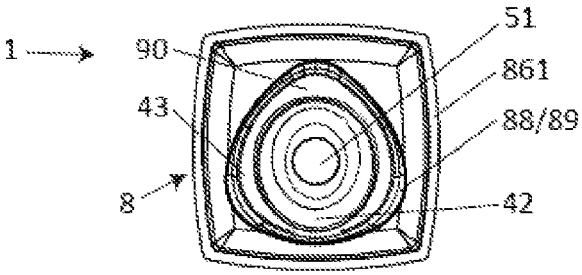
FIG. 18 a view of a stimulation device according to the invention of a seventh embodiment, from the front.

With reference to FIGS. 14 to 18, a seventh embodiment of the present invention is explained in more detail. FIG. 14 shows a perspective view of a stimulation device according to the invention of a seventh embodiment having a closed cap. FIG. 15 shows a perspective view of a stimulation device 1 according to the invention of the seventh embodiment having an opened cap. FIG. 16 shows a side view of a (lying) stimulation device according to the invention of the seventh embodiment having an opened cap. FIG. 17 shows a side view of a (standing) stimulation device according to the invention of a seventh embodiment without a cap. FIG. 18 shows a view of the stimulation device according to the invention of the seventh embodiment from the front.

The seventh embodiment is provided to be very similar to the sixth embodiment. Therefore, only the differences relative to one another are explained in more detail below.

In the back end 19, the bushing 75 for the current supply having a latch-like plug-bushing closure 751 (preferably made of silicone or rubber) is set up in such a way that the closure 751 can seal or caulk the bushing in a waterproof manner (IP 67).

The display 72 is implemented in the form of a transparent viewing panel and an LED behind it. The on/off switch is preferably simultaneously the operating element, by means of which the modulation of the pressure field can be set. Thus, the stimulation device is switched on or off by means of a long press in each case, whereas a short press changes the modulation.

The central section 88 is implemented to be approximately of equal thickness and coated with silicone. Thus, the whole central section 88 constitutes a coherent gripping surface 89. The wall 41 is continued in a seamless or transition-free manner by means of the central section 88, wherein the head and the central section 88 of the housing 8 has the same external contour in cross-section.

With reference to FIGS. 16 and 17, it can be seen that the back section 86 tapers forwards in a step-like manner, in particular, so that the cap 85 can be placed on the housing 8 in a form-fit manner. The head of the stimulation device is implemented to be slanted or slightly curved, wherein the opening plane 83 of the opening 42 intersects the longitudinal axis 80 at an angle δ. The angle δ of this embodiment is about 60 degrees (60 degrees±10 degrees). Preferably, the angle δ of this embodiment ranges from about 40 to 70 degrees, in particular ranges from about 55 to 65 degrees.

The longitudinal axis is presently an axis of symmetry for the cap 85 and the basic shape of the back section 86 of the housing.

The centre of mass MA is preferably in the back section 86 of the housing 8.

FIG. 18 shows a view of the housing 8 of the seventh embodiment from the front. Thus, the opening 51 inside the hollow space is formed to be circular in the cross-sectional direction. Furthermore, a widened resting surface 43, which intersects the opening plane 83 at a slight angle, is provided. The opening 42 is, in turn, provided to be oval.

Figure 19:
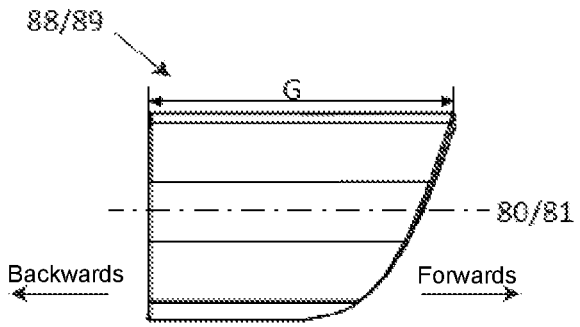
FIG. 19 a side view of a gripping part according to the invention of the seventh embodiment.
Figure 20:
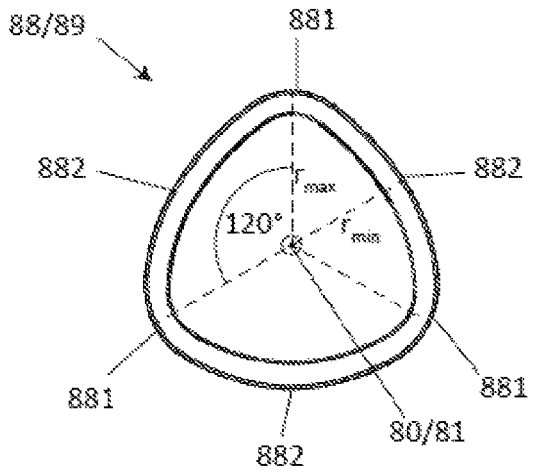
FIG. 20 a sectional view of a gripping part according to the invention of the seventh embodiment in the transverse direction of the housing FIG. 21 a schematic cross-section of a pressure field generation device of an aspect of the present invention.

With reference to FIG. 19, a side view of a central section 88 or a gripping part having a gripping surface 89 according to the invention of the seventh embodiment is explained in more detail and, with reference to FIG. 20, a sectional view in the cross-sectional direction of the housing of the central section 88 according to the invention or a gripping part having a gripping surface 89 of the seventh embodiment is explained in more detail. Thus, the central section 88 is preferably implemented as one piece as a single component of the stimulation device 1.

The central section 88 has a length G which is at least 30%, preferably at least 40% of the total length A of the housing 8 (which is measured without the cap 85).

The external contour of equal thickness which is shown (cf. FIG. 20, reference numerals 882 and 881) of the central section 88 does not have any sharp outer edges or hard corners in the longitudinal direction in comparison to Reuleaux triangles, but is implemented to be rounded throughout (c. reference numeral 881). The total diameter of the central section 88 is r-min at each point plus r-max.

The longitudinal axis 80 of the housing 8 constitutes a central axis for the central section 88.

Figure 21:
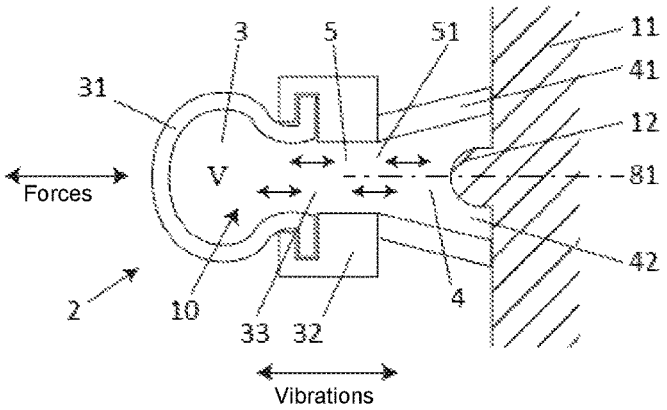

With reference to FIG. 21, a schematic cross-section is explained in more detail by a principal pressure field generation device of one aspect of the present invention.

A hollow space 10 forms an at least extensively closed unit (i.e. an at least closed volume) after placing the stimulation device over the related body part 11 to be stimulated, preferably the clitoris 12. There is a medium, preferably air, in the hollow space.

This hollow space can be functionally divided into a first chamber 3, a second chamber 4 and a connection element 5.

Here, the term "first chamber 3" functionally refers to the part of the hollow space at which the drive unit 6 can act on the hollow space, for example by means of a regular volume change. Thus, the volume of the first chamber 3 is alternately enlarged and reduced.

The term "second chamber 4" further functionally refers to the part of the hollow space which has the opening 42 for placing over the erogenous zone, and in which the pressure field according to the invention can act on the erogenous zones or on the clitoris (or clitoral glans) 12. The chambers 3 and 4 according to the invention should thus not be understood in such a way that they constitute spaces or departments of the hollow space which are each completely separated in terms of structure. The two chambers 3 and 4 are connected via the connection element 5, for example in the form of a straight (and preferably rigid) channel (in terms of current). Preferably, the connection element 5 can also represent only a slight tapering or narrowing in the form of an individual outlet opening or a wide channel between the two chambers 3 and 4 having two openings 33 and 51. The two openings preferably have a common central axis.

The first chamber 8 has a flexible wall 31 which can be supplied and displaced by means of the drive unit 6 by forces. The flexible wall 31 is fixed in a bracket 32. This bracket 32 preferably consists of a rigid plastic.

Because of the regular volume change by means of the drive unit 6, a current system is formed in the hollow space 10.

In detail, the pressure field generation device 2 has an opening 42 or placing over the clitoris 12 and a flexible wall 31, wherein the pressure field generation device 2 is set up in such a way that, when the opening 42 is placed over the clitoris 12, an at least extensively closed current system is formed in the pressure field generation device 2, and the drive unit 6 acts on the flexible wall 31 with forces during control in such a way that this is displaced away from the clitoris 12 in a first direction and towards the clitoris 12 in a second direction, in a temporally alternating manner, whereby media currents in the current system of the hollow space 10 which are aimed towards the clitoris 12 and away from the clitoris 12 in a temporally alternating manner, are generated and a pressure field consisting of a pattern of negative and positive pressures which are modulated in relation to normal pressure is generated; and wherein the at least extensively closed current system extensively or completely avoids a removal of bodily fluid from the pressure field generation device 2, such that the pressure field generated in the current system of the pressure field generation device 2 stimulates the clitoris 12 for sexual arousal.

By means of the double arrows, the movement directions of small exemplary volume shares of the medium in the current system according to the invention are depicted in FIG. 21, i.e. the currents according to the invention. Thus, these move forwards and backwards to correspond to the displacement of the flexible wall in parallel to the axis of the alignment 81 of the hollow space 10. Considered as a whole, a kind of media column or air column is thus cyclically moved forwards and backwards in the hollow space, wherein the pressure field according to the invention is formed to be adjacent to or on the clitoris (or clitoral glans). Furthermore, mechanic vibrations starting from the flexible wall 31 (induced by the acting forces and also introduced by the drive unit 6) are transferred via the bracket 32 and the wall 41 of the second chamber 4 in the direction of the body part 41 to be stimulated, which is seen as disturbing, in certain circumstances.

Figure 22:
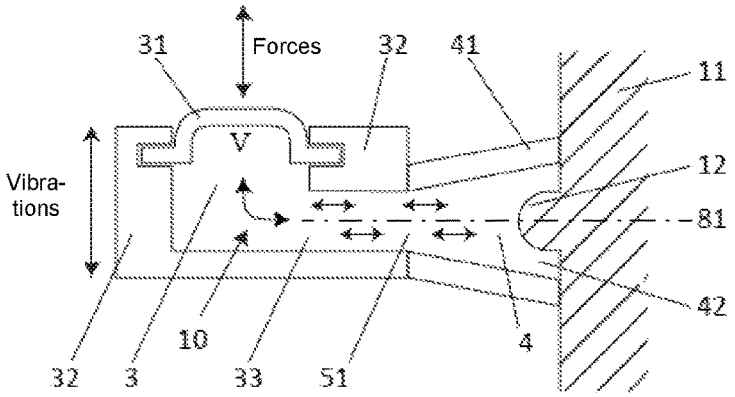
FIG. 22 a schematic cross-section of a pressure field generation device of a further aspect of the present invention.

With reference to FIG. 22, a schematic cross-section of a pressure field generation device of a further aspect of the present invention is explained which addresses the theme of the vibrations explained above.

The current system of this aspect according to the invention is formed to have an angled shape. Thus, the flexible wall 31 is displaced at a right angle (or alternatively at a different angle of at least 45 degrees) relative to the alignment axis 81 of the hollow space 10. The corresponding vibrations thus no longer propagate in the direction of the body part to be stimulated, for example in the direction of the clitoris, but at an angle to it, as depicted in FIG. 22. When applying this aspect to the first to seventh embodiment, the vibration would thus have a (core) direction which is aligned in the transverse direction of the longitudinal housing 8. As a result, the disturbing vibrations in the longitudinal direction 80 of the stimulation device 1 are reduced in the direction of the front end 90.

Figure 23:
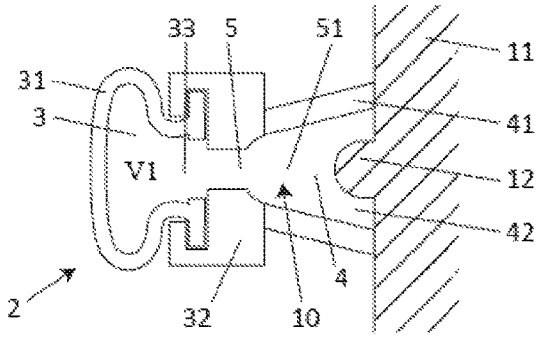
FIG. 23 a cross-section of a pressure field generation device of a further aspect of the present invention in the first state.
Figure 24:
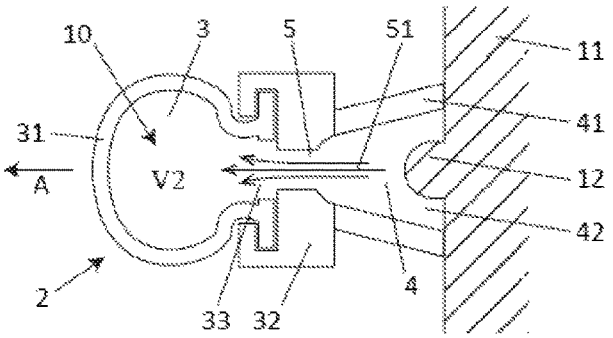
FIG. 24 a cross-section of a pressure field generation device of the aspect of FIG. 23 of the present invention in the second state.
Figure 25:
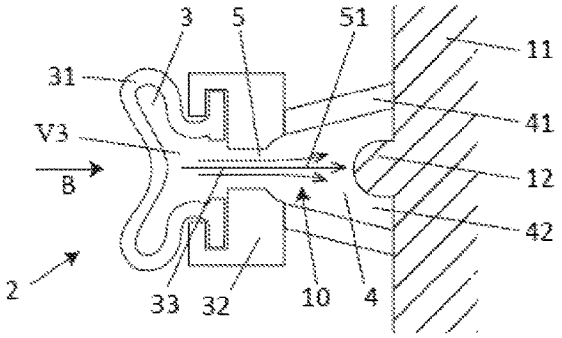
FIG. 25 a cross-section of the pressure field generation device of the aspect of FIG. 23 and FIG. 24 of the present invention in the third state.
Figure 26A:
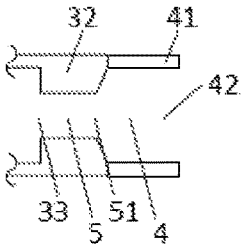
FIGS. 26 *a*) to *e*) schematic cross-sectional views of sections of the hollow space according to the invention FIG. 27 schematic cross-sectional views of sections of the hollow space according to the invention FIG. 28 a perspective side view of a pressure field generation device of the stimulation device of the seventh embodiment of the present invention.
Figure 26D:
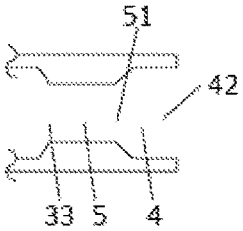
Figure 26B:
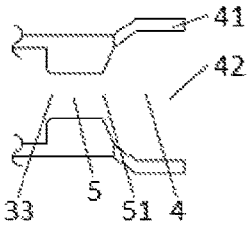
Figure 26E:
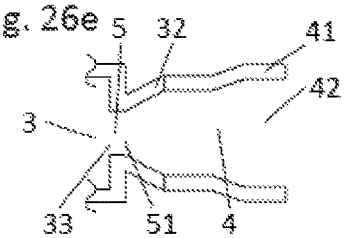
Figure 26C:
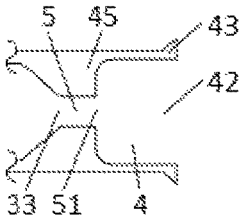

FIGS. 23 to 25 present the principle of the pressure field generation device 2 in detail.

FIG. 23 shows a principle pressure field generation device 2 in a first state, wherein the second chamber 4 is placed on or over the region of skin or body part 11 to be stimulated. Preferably, the second chamber 4 is placed over the erogenous zone which has the female clitoral glans.

The first state of the pressure field generation device 2 is characterised by a neutral displacement of the first chamber 3, i.e. it does not exert an external force, for example from the drive unit, on the first chamber 3. Here, the volume V1 of the first chamber is the standard volume of this chamber 3.

The body part 11 to be stimulated is a region of skin of the body, wherein here, for example, a particularly sensitive erogenous zone, the clitoris 12, is depicted. Thus, the application of the present invention, however, is not fundamentally limited to the female clitoris 11, but the stimulation device 1 can be applied to all body parts or erogenous zones (for example the inside of the upper thigh, groin, neck, nipples, etc.), which can be stimulated by means of media or air pressure massage and/or negative pressure.

The second chamber 4 forms a chamber that is extensively or completely closed to the outside of the pressure field generation device 2 by placement on the body part 11 to be stimulated or because of the placement over the clitoris to be stimulated, said chamber being connected to the second chamber via only the connection element 5, wherein the edges of the chamber 4 ideally close in a sealing manner by means of the surface of the body part 11. In this way, a closed hollow space having two communicating functional units, chambers 3 and 4, emerges, wherein, when changing the volume of one of the chambers 3 or 4, a corresponding pressure equalisation between chamber 3 and 4 takes place via the connection element 5.

A wall 31 of the first chamber 3 is fixed by means of a bracket. The bracket 32 is, in turn, fixed on the housing 8. Furthermore, the wall 41 of the second chamber is mounted on the bracket 32. Two openings in the wall 41 of the second chamber 4 and the bracket 32 which are aligned relative to each other (preferably in the longitudinal direction) together form the connection element 5, which connects the first chamber 3 and the second chamber 4 by means of a channel. This channel runs straight between the first chamber 3 and the second chamber 4, wherein the diameter of the channel broadens or narrows in the direction of the second chamber 4. Here, the wall 31, the bracket 32 and the wall 41 are preferably adhered to one another to be media- or air-proof. Alternatively, these can also be press-fitted to one another (for example by means of sealing regions between the housing 8 and the respective part) or screwed together. Furthermore, the bracket 32 can be adhered or screwed to the housing 8, for example.

The wall 31 of the first chamber 3 consists preferably of a flexible media- or air-impermeable material, for example rubber or silicone. The bracket preferably consists of a rigid plastic, which is also media- or air-impermeable. The wall 41 of the second chamber is preferably produced from a flexible, skin friendly material, for example from silicone or rubber.

Figure 4:
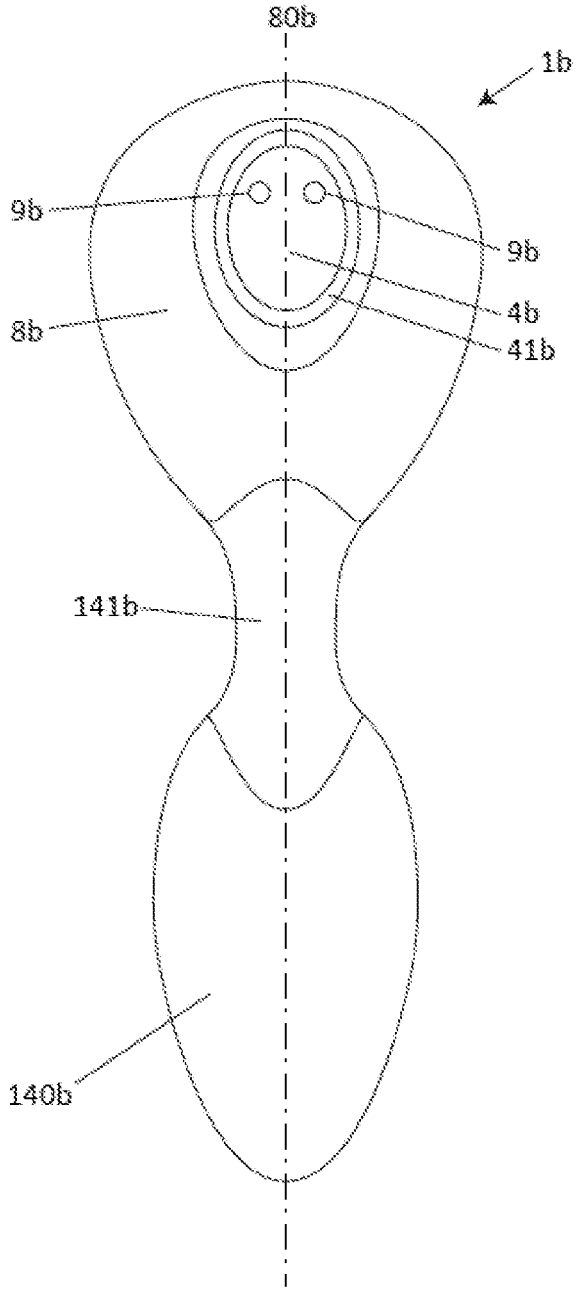
Fig. 4 Prior art
FIG. 4 a front view of a stimulation device of the prior art having an appendage in a straight position.
Figure 5:
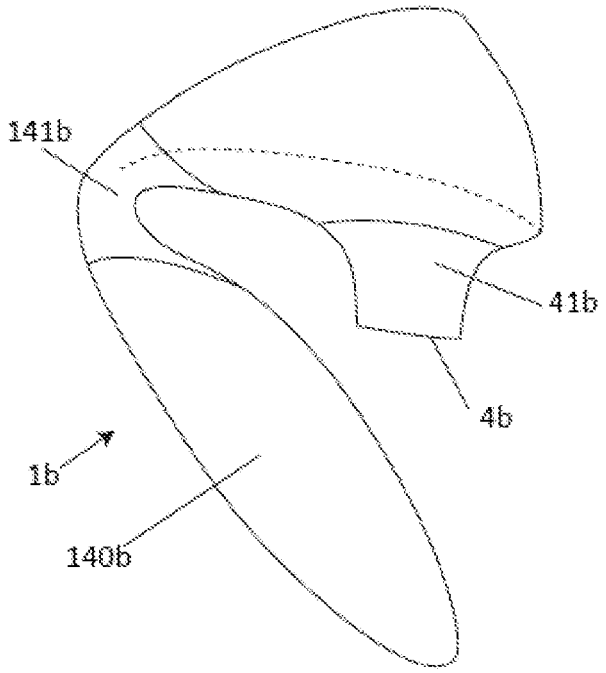
Fig. 5 Prior art
FIG. 5 a side view of a stimulation device of the prior art having the appendage in the bent position.
Figure 6:
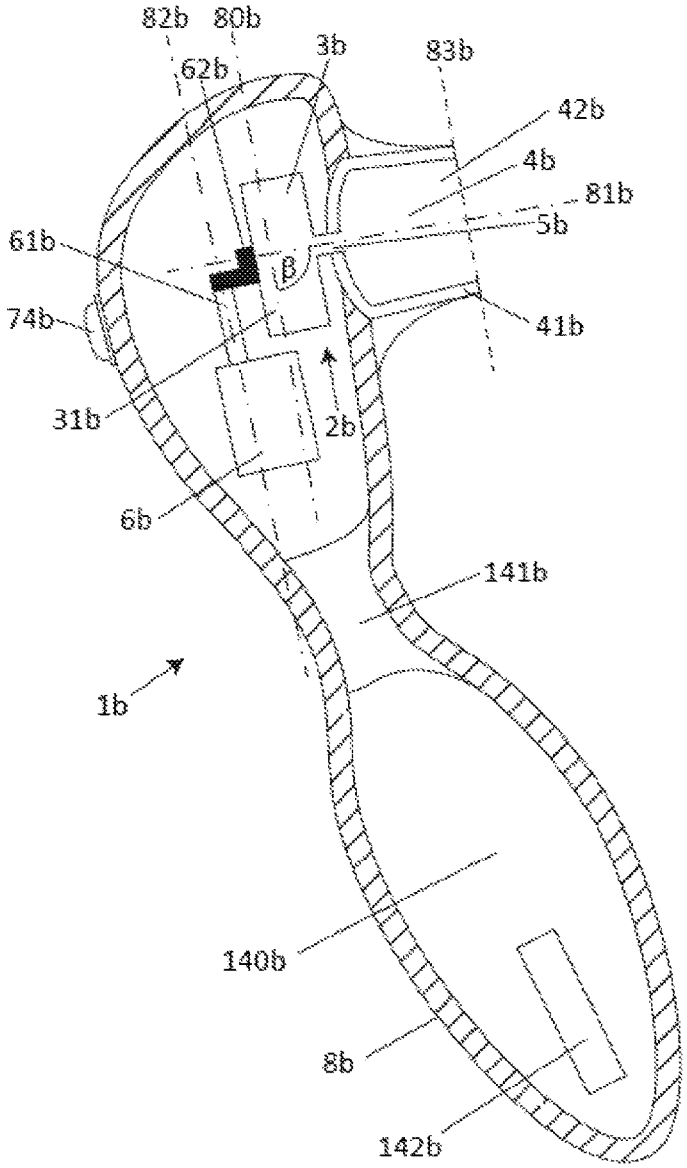
Fig. 6 Prior art
FIG. 6 a schematic cross-section of a stimulation device of the prior art.

FIG. 24 shows the pressure field generation device 2 of FIG. 4 in a second state, wherein, in turn, the second chamber 4 is placed on the body part 11 to be stimulated. The second state is characterised in that a force A acting on the first chamber 3 causes an expansion of the chamber 3. In detail, in this embodiment, the force A pulls the wall 31 of the first chamber 3 in a direction which is aimed away from the second chamber 4.

As a result, the volume V2 of the chamber 3 enlarges, i.e. V2>V1. In order to equalise the arising pressure difference between the chambers 3 and 4, the medium or the air now flows from the second chamber 4 into the first chamber 3.

Assuming that, in the first state, the pressure present in chambers 3 and 4 corresponds to the current prevailing external reference pressure (for example air pressure), the present total pressure in the second state is now lower than the external reference pressure. This negative pressure is constructed in such a way that it is preferably lower than the usual systolic blood pressure in the blood vessels of the body part 11. Thus, the blood flow in this region is increased and more blood flows to the clitoris 12 in the second state.

FIG. 25 shows the pressure field generation device 2 in a third state, wherein, in turn, the second chamber 4 is placed on the body part 11 to be stimulated. The third state is characterised in that a force B acting on the first chamber 3 causes a volume reduction or compression of the chamber 3. In detail, the force B is opposed in terms of its direction to the direction of force A and deforms the wall 31 of the first chamber in such a way that the resulting volume V3 of the chamber is smaller than volume V1. The compression of the chamber 3 causes a positive pressure in the chamber 3 which is equalised by a media or air current through the connection element 5 in the direction of the second chamber 4.

This media current is now preferably aimed at the body part 11 to be stimulated, in particular at the glans of the clitoris 12, by means of the alignment of the opening 51 and/or the connection element 5. The indirect (pressure) stimulation according to the invention thus takes place by means of the medium flowing in the direction of the erogenous zones. Here, the size (or the cross-sectional surface area) of the opening 51 is preferably sized in such a way that this is small enough in comparison to the volume displaced in the first chamber 3 in order to sufficiently accelerate the medium for a perceptible massage effect. Often, in particular with a clitoral glans, a slight cross-sectional reduction or narrow point in the hollow space is sufficient so that the pressure field according to the invention can develop a targeted stimulation effect.

Furthermore, the type of current can be advantageously influenced not only by means of the size and the alignment of the opening 51, but also by means of the inner configuration of the connection element. For example, helical grooves in the connection element 5 cause a swirl of the current according to the invention, wherein the current profile of the current develops a "softer" or more turbulent effect on the body part to be stimulated. Alternatively, the pressure field emerging in the second chamber 4 can be adjusted to correspond to the use by means of several openings 51. As a further alternative, a nozzle can be provided as the connection element, which leads to the pressure field being constructed in the medium preferably adjacent to the clitoris.

In the arrangement shown in FIGS. 23 to 25, it is advantageous that it is hygienically unproblematic (for example because of the avoidance of dead spaces) and simple in terms of construction. For example, no valves or further openings in or on the first chamber 3 are required. It is noted that the basic principles of the pressure field generation of the invention are then also realised when the starting point of the compression and expansion activity of the drive unit 6 is at the maximum volume V2 or the minimum volume V3. Thus, often a pressure equalisation, for example via a gap between the skin and the opening 42, takes place, in which the average pressure in the hollow space will level to a central pressure. In addition, the device 1 is often already switched on before the placement over the erogenous zone. Thus, the pressure field according to the invention is generated independent of the prevailing starting conditions in terms of the displacement of the flexible wall 31 of the first chamber 3.

FIGS. 26*a* to 26*e* disclose further aspects in terms of the formation, in particular in terms of the (inner) shaping of the connection element 5.

The shaping of the connection element 5 influences the current-mechanical properties in the pressure field generation device 2. With the through current of channels or hollow spaces, current sounds, in particular with air as the medium, occur which are independent of the current speed, of the cross-section of the channel and the degree of turbulence. Turbulences are, in turn, caused by sharp edges.

FIG. 26 *a*) shows the connection element 5 in the shape of a straight channel, wherein the opening 33 and the opening 51 each have sharp edges on the edges of this. This leads to turbulences and disturbing current sounds.

Thus, the pressure loss coefficient of arrangement of FIG. 26 *a*) is capable of optimisation. The stimulation effect of the pressure field of the stimulation device 1 can be optimised according to the invention by an improved configuration in terms of current, as is presented in more detail below.

FIG. 26 *b*) shows the connection element 5 in the form of a straight channel, wherein the edge of the opening 33 (in the direction of the first chamber 3) has rounded corners. This reduces the pressure loss coefficient of the channel-like configuration according to the invention, which is why the degree of effectiveness of the pressure field generation device according to the invention becomes larger and this becomes quieter. In addition, the second chamber 4 has a larger internal diameter in comparison to the second chamber of FIG. 26 *a*), whereby the pressure field emerges closer to the opening 51, and the second chamber 4 can thus be provided to be comparatively shorter in the longitudinal direction, which saves space and weight.

FIG. 26 *c*) shows the connection element 5 in the shape of a straight channel having a truncated conical opening 33 in the direction of the first chamber 3. This further reduces the pressure loss coefficient $\zeta$ in comparison to the channel-like configurations of FIGS. 26 *a*) and *b*).

FIG. 26 *d*) shows a further improved configuration in terms of current of the connection element 5. Thus, the first chamber 3 and the second chamber 4 are separated by a marginal (for example by about c. 15% of the diameter of the first chamber) narrowing or constriction of a channel-shaped connection element 5, wherein the two openings 33 and 51 (on both sides of the channel) have a truncated conical internal shape. As a result of the medium being moved forwards and backwards in the current system according to the invention, the two openings or sides of the channel are advantageously optimised in terms of current since the two current directions are lossy.

Thus, it is possible to optimise the pressure loss coefficient ζ in comparison to conventional stimulation devices in such a way that a smaller (or weaker powered) electric motor can be used, which saves weight and costs. In addition, the current sounds are avoided or reduced, which improves the ergonomics of the stimulation device 1.

FIG. 26 *e*) shows a shaping of the second chamber 4. In order to distance the clitoris (or clitoral glans) from the nozzle-like opening 51 further from the clitoris (in order to avoid an over-stimulation), it can be necessary that the length of the second chamber is enlarged in the direction of the alignment axis 81 and/or in the direction of the longitudinal axis 80. Thus, the second chamber 4 can be set up in such a way that its diameter (in the cross-sectional direction) is gradually enlarged in a multitude of (preferably two) steps in the direction of the opening 42. Correspondingly, the media flow (when the first chamber 3 is compressed) is gradually decelerated in the direction of the opening 42, while the pressure field is aimed at the erogenous zone to be stimulated in a targeted manner, since the media pressure gradually increases.

Figure 27:
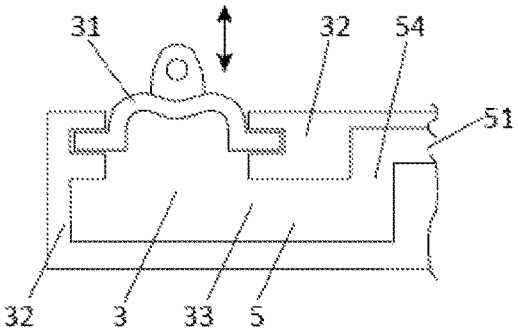

FIG. 27 shows a first chamber 3 having an opening 33 of the first chamber 3 arranged at a right angle to the direction of the displacement of the flexible wall 31, and a channel-shaped connection element 5, which has an S-shaped course. Thus, the channel running in an S-shape forms a damping element 5 according to the invention. Thus, in this aspect, because of the S-shaped course of this aspect, a direct, straight-line expansion of acoustic effects outwards from the first chamber 3 is avoided (i.e. out from the opening 42). Thus, the S-shaped course of the channel of the connection element 5 causes a damping of disturbing sounds from the opening 42.

The embodiments explained above are further implemented by means of subsequent explanations.

Figure 28:
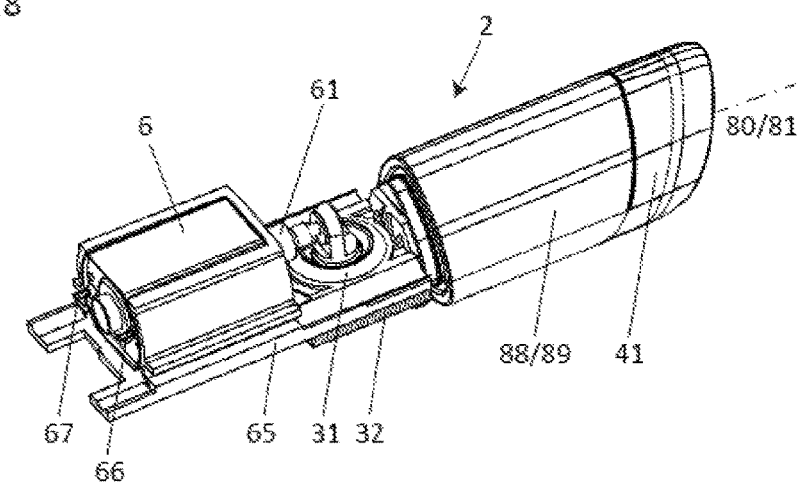

FIG. 28 shows a perspective view of a part of an exemplary internal construction of the stimulation device 1 of the sixth or seventh embodiment. The basic concepts of the invention explained below can be used in each present aspect and in each present embodiment and are correspondingly combined. An eccentric cam is mounted on the axis 61 of an electric motor 6, said eccentric cam engaging in an appendage of a flexible wall 31. The (DC current) motor has two poles 67 and 68. Furthermore, the motor 6 is fixed on a motor bracket 65, which has a straight-line course on both sides such that the motor bracket 65 can be inserted in a groove-like, internal guide of the housing 8 (preferably from the back). In the same way, the bracket 32 of the first chamber 3 is fixed on the motor bracket 65, for example it is adhered or screwed on (this is labelled in a hatched manner in FIG. 26).

Figure 29:
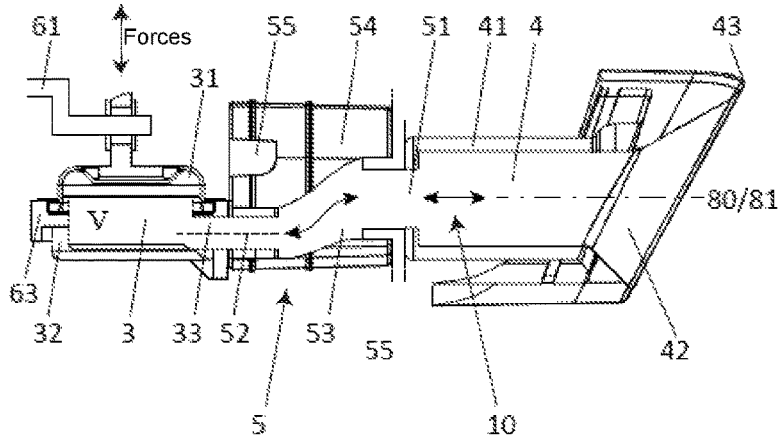
FIG. 29 a schematic sectional view of the pressure field generation device according to the invention of FIG. 28.

FIG. 29 shows a cross-section of the construction of FIG. 28 in the longitudinal direction. The first chamber 3 has a volume V. A lateral or radially arranged opening 33 of the first chamber 3 initially leads into a straight-running channel section of the connection element 5. Furthermore, the channel 53 runs in an S-shaped manner in the direction of the second chamber 4. The material of the damping element 54, in which the S-shaped channel section is formed, is preferably silicone or rubber. The damping element 54 constitutes a section of the connection element 5. Thereafter, the S-shaped channel 53 opens into the second chamber 4 via the opening 51. The second chamber 4 is initially formed to be cylindrical, and opens away from the opening 51 opposite the end of the second chamber 4 in a truncated conical manner. Furthermore, the alignment axis 81 is arranged to be at least parallel, preferably coaxial, in relation to the longitudinal axis 80 of the stimulation device 1 (said longitudinal axis preferably being arranged centrally).

Thus, the damping element 54 arranged in the longitudinal direction 80 between the first chamber 3 and the second chamber 4 or the opening 42 not only serves for the current-technical/acoustic damping of noises in the medium in the manner of a silencer, but also for the damping of vibrations or oscillations, which are present in the solid body, for example in the bracket 32 or the motor bracket 65, for example, or are forwarded in these. Here, these vibrations or oscillations are damped in the direction of the opening 42. Thus, the damping element presently has a double function of damping oscillations or vibrations in the fluid and in the solid medium in the direction of the opening 42. Consequently, the ergonomics of the stimulation device 1 according to the invention are improved.

The damping element 54 further has a bracket 55 that can be plugged for simple insertion in the stimulation device 1.

In this embodiment, the placing region 43 is a comparably narrow surface, which closes the peaked (peripheral) front end 90 of the stimulation device 1.

Figure 30:
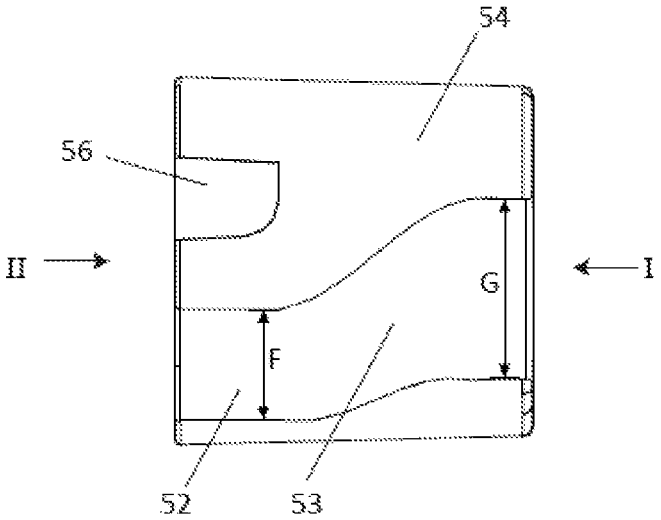
FIG. 30 a sectional view in the longitudinal direction of a damping element of the pressure field generation device of FIG. 28.
Figure 31:
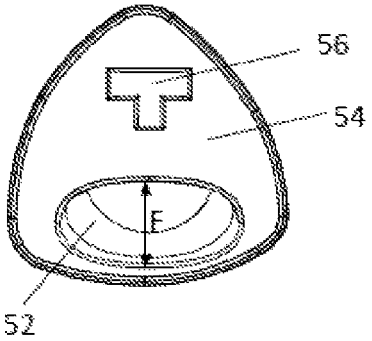
FIG. 31 a view of the damping element of the pressure field generation device of FIG. 28, from behind.
Figure 32:
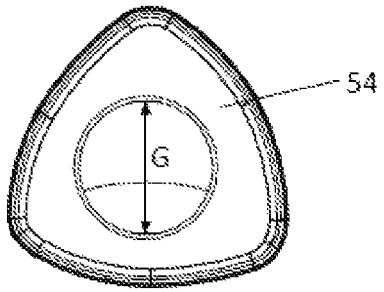
FIG. 32 a view of the damping element of the pressure field generation device of FIG. 28, from the front.

FIGS. 30 to 32 show a cross-sectional view in the longitudinal direction 80, a view from behind and a view from in front of the damping element 54 according to the invention respectively.

In order to keep the housing construction as compact as possible in the cross-sectional direction of the housing 8, the cross-section of the straight-running channel section and the corresponding (back) opening of the damping element 54 on the side II of the first chamber 3 is here formed to be oval. The (front) opening of the damping element 54 on side I of the second chamber 4 is formed to be round. Here, the diameters F and G of the two openings are calculated in such a way that the cross-sectional surface areas of the two openings are (at least approximately) the same. The channel of the damping element 54 thus changes its cross-sectional shape, without changing the cross-sectional surface area. Thus, current losses are kept as marginal as possible, while the stimulation device 1 can be kept compact in terms of the cross-sectional direction.

Figure 33:
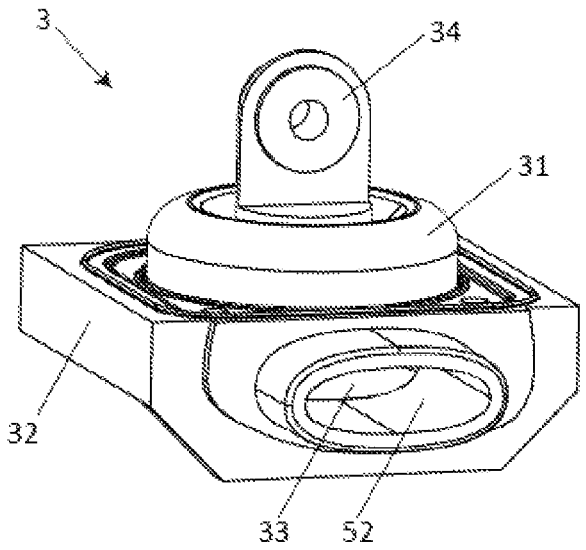
FIG. 33 a perspective view of a section of the hollow space of a first chamber of the pressure field generation device of FIG. 28.

FIG. 33 shows a perspective view of the first chamber 3 of the sixth and seventh embodiment from outside, having the flexible wall 31, having the oval opening 33 (that has already been explained in more detail above) that has the corresponding straight running channel section 52 and the bracket 32. The flexible wall 31, which consists, for example, of silicone, has an appendage (protruding upwards in FIG. 33), which has a hole for receiving the eccentric cam appendage. A donut-shaped or ring-shaped transition element 34 is inserted into this hole, said transition element 34 having an internal hole in which the appendage of the eccentric cam is inserted (which is not depicted in more detail). This transition element 34 consists preferably of rubber or a damping silicone. Thus, oscillations or vibrations, which occur on the motor side, are significantly damped before they are transferred into the medium in the first chamber 3 via the flexible wall and would be able to be perceived as disturbing noises outside the stimulation device 1. Thus, it has been shown that the flexible wall 31, similar to a membrane (among other things, because of its flat design) is prone to transferring vibrations or oscillations of the motor axis 61 or the eccentric came to the medium of the chamber 3. Thus, it is presently advantageous to insert the transition element between the flexible wall 31 and the eccentric cam or the motor shaft 61 in order to dampen disturbing vibrations or oscillations before they are coupled into the medium in the first chamber 3.

Figure 34:
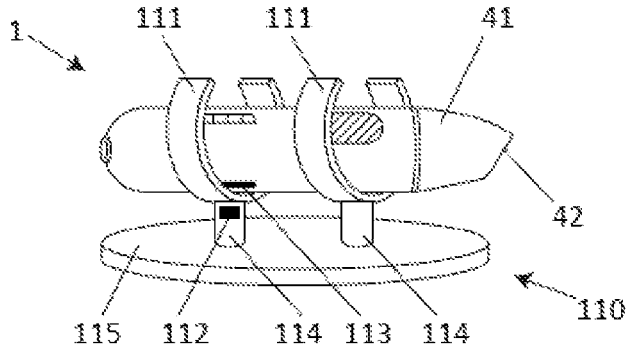
FIG. 34 a schematic view of a bracket according to the invention for a stimulation device of an embodiment, FIG. 35 a schematic sectional view of a cup-shaped bracket according to the invention for a stimulation device of an embodiment.

FIG. 34 shows a system having one of the embodiments of the stimulation device 1 according to the invention. Thus, a bracket 110 has at least two forked bracket arms 111, into which the stimulation device 1 is placed. The bracket arms 111 are connected to bracket foot 115 via bracket legs 114, said bracket foot 115 preferably being formed to be even and flat. In at least one of the bracket legs, there is a bracket-side charging coil or inductor. Correspondingly, the stimulation device 1 according to the invention has a stimulation device-side charging coil or inductor. If the stimulation device 1 is placed in the bracket arms 111, a (known) inductive coupling 1 between the stimulation device and an electronic power device (that is not shown in more detail) can take place via the coils (that are preferably paired). Thus, a battery of the stimulation device 1 can be charged wirelessly or without cables, without a bushing or a connection to or in the housing 8 being required. This simplifies, for example, a waterproof formation of the housing 8.

Figure 35:
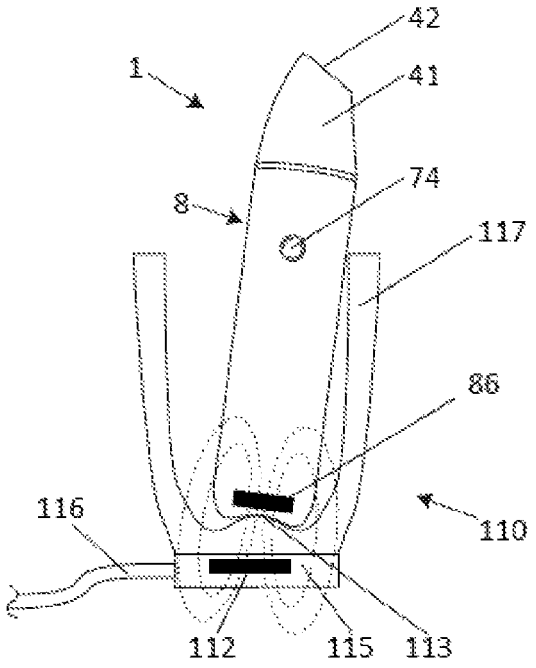

FIG. 35 shows an alternative system having a bracket 110 for charging the stimulation device 1 according to the invention. Here, the stimulation device-side charging coil or inductor can be advantageously housed in the back end 91 of the stimulation device 1. This facilitates a suitable weight distribution and setting of the centre of mass MP of the stimulation device 1. In addition, (convenient) coils are preferably formed to be circular, whereby these can be advantageously stored to be compact with the central axis of the coil in the coaxial (or alternatively parallel) alignment in terms of the longitudinal axis 88 in the housing 8. A cup shaped device, for example a simple water glass, is provided as the bracket 110, in which the pin-shaped stimulation device 1 can be simply placed. This has the advantage that the bracket 110 can be cleaned quite easily. In the plate or platter-shaped bracket foot 115, the bracket-side loading coil or inductor is housed, on which the bracket 110 is placed. If the stimulation device 1 is placed into the bracket 110, a (known) inductive coupling between the stimulation device 1 and an electronic power device (not shown in more detail) can take place by means of the (preferably paired) coils mentioned above. Correspondingly, the battery of the stimulation device can also be supplied with energy and charged by means of this bracket 110 without cables or in a wireless manner.

Figure 36:
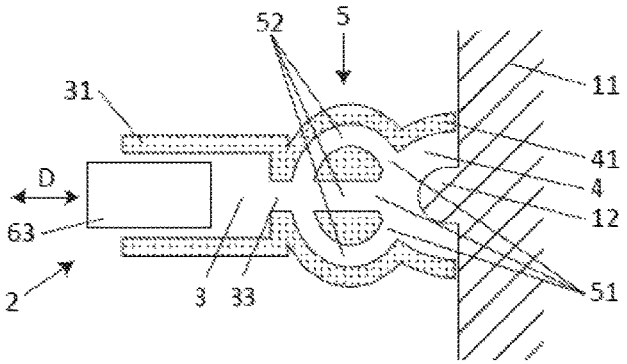
FIG. 36 a cross-section of a pressure field generation device of a further aspect of the present invention.

FIG. 36 shows a fourth aspect of the invention having an alternative construction of the pressure field generation device 2. Here, the second chamber 4, several connection elements 5, and partial sections of the wall 31 of the first chamber 3 are formed to be one piece. Alternatively, the pressure field generation device 2 can also be constructed from individual parts in two or more parts by adhering to the geometric model of FIG. 36, depicted in a similar way to in FIG. 21, 22 or 25.

The volume change of the first chamber 3 here takes place in a manner similar to a piston pump, however, here, possible valves are lacking. Thus, a piston 63 is moved backwards and forwards by the drive unit, for example an electric motor or electromagnet, in the directions of the double arrow D. This kind of drive has the advantage that the volume of the first chamber 3 can be reduced to zero or virtually to zero in a simple manner, and thus the first chamber 3 can be almost completely emptied.

The design of the connection element 5 having several channels 52 and openings 51 leads to a distribution of the pressure field on several concentration points. While the design of the connection element 5 having only one channel, as described in connection with FIG. 25, for forming a significantly concentrated pressure field leads towards a target region, the media or air flow can be distributed on several target regions with the design of the connection element 5 shown in FIG. 36. Thus, the clitoris 11 can be blown onto not only on its glans, but from several sides in equal measure. This distribution of the concentration of the air current on several regions can, depending on the application, help to avoid an overstimulation, and/or help to enlarge the stimulation region.

Figure 37A:
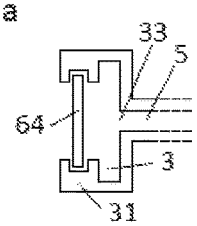
FIGS. 37 *a*), *b*) and *c*) schematic cross-sections of a pressure field generation device of a further aspect of the present invention.
Figure 37B:
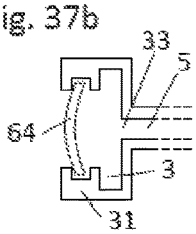

FIGS. 37 *a*) to 37 *c*) show a fifth aspect of the invention having (partial) cross-sections of a construction of the pressure field generation device 2 having a bending element 64 as a drive for changing the volume of the first chamber 3. The bending element 64 can be a conventional piezoelectric bending element, for example, which is deformed or bent after application of tension. In this aspect of the invention, the wall 31 of the first chamber 3 is constructed to be rigid or stiff, while the bending element 64 is adjusted to the sides of the first chamber 3 in a suitable manner. Here, the transition points between the bending element 64 and the wall 31 are sealed (for example elastically adhered). With this construction, the drive for the pressure field generation device 2 is already integrated into this and an external drive is not necessary. For example, an electric motor having the eccentric cam is not necessary. As a result, among other things, potentially disturbing individual oscillations can be reduced because of the movement of the eccentric cam of the stimulation device.

Figure 37C:
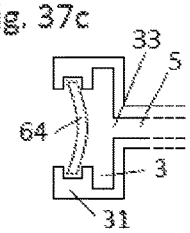
Figure 38A:
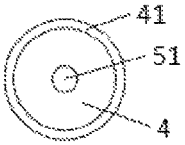
FIGS. 38 *a*) to *f*) different views from below and the side of further aspects of a second chamber of the present invention.
Figure 38B:
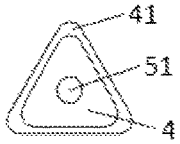
Figure 38C:
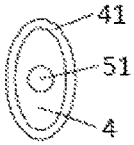
Figure 38D:
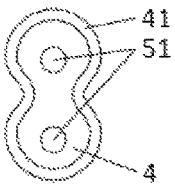
Figure 38E:
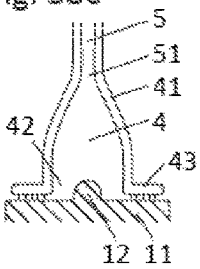
Figure 38F:
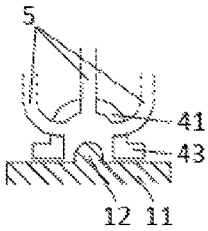

FIG. 37 *a*) shows the pressure field generation device 2 having the bending element 64 in the neutral position in detail. Thus, the volume of the first chamber 3 having the bending element 64 in the neutral positions is the standard volume. FIG. 37 *b*) further shows the first chamber 3 having an energised bending element that is successively bent outwards, which is why the volume of the first chamber 3 is enlarged; and, as a result, a negative pressure prevails in the pressure field generation device 2. FIG. 37*c* shows an opposingly energised bending element of the first chamber 3 in comparison to FIG. 10*b*, which is why the volume of the first chamber 3 is reduced; and in succession, a positive pressure prevails in the pressure field generation device 2.

FIGS. 38 *a*) to 38 *f*) show different views from below and the side of further aspects of the second chamber 4 of the present invention. FIG. 38 *a*) shows in detail a view from below of a circular second chamber 4, having a centrally arranged opening 51; FIG. 38 *b*) shows a view from below of a triangular second chamber 4 having a centrally arranged opening 51; FIG. 38 *c*) a view from below of an oval second chamber 4 having a centrally arranged opening 51; and FIG. 38 *d*) a view from below of an approximately octagonal second chamber 4 having two openings 51 arranged offset relative to the centre. FIG. 38 *e*) further shows a side cross-section of a second chamber 4 according to the invention, wherein the second chamber 4 additionally has an extended contact surface 43 with the skin or resting part 43 or placing region 43 in order to improve the sealing (off) function of the second chamber 4 on the skin. The extended contact surface 43 can additionally have grooves or projections, which yet further improve the sealing function. FIG. 38 *f*) shows a side cross-section of a second chamber 4 having several separated connection elements 5 and an extended contact surface because of the resting part 43 or the placing region 43.

Thus, the shape of the second chamber 4 can be fundamentally adjusted to the anatomy of the erogenous zone to be stimulated. Here, the shape of the chamber 4 of FIG. 38 a) is adjusted, for example, to the round shape of the breast, while the shape of the chamber 4 of FIG. 38 *c*) is better adjusted to the shape of the female vulva. Furthermore, the shape of the second chamber 4 additionally also determines the characteristic of the pressure field according to the invention. Thus, the size of the second chamber 4 determines the extent of the achievable negative or positive pressure, in relation to the volume displaced by the first chamber 3. Furthermore, the intensity of the massage effect according to the invention can be set to this via the proximity of the opening 51 of the connection element 5 to the region of skin to be stimulated. The massage effect can also be distributed across several regions by means of several openings 51, cf. FIG. 38 *d*). Thus, the clitoris, for example, can be stimulated less directly on the very sensitive clitoral glans (cf. FIG. 38 *e*)), but more so on the region surrounding the clitoral glans, in order to avoid excessive excitation of the clitoris.

Figure 39:
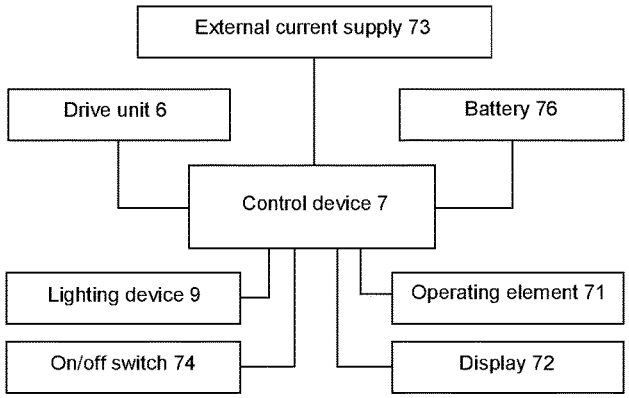
FIG. 39 a block diagram of an aspect of the present invention.

FIG. 39 shows a block diagram of an example of a functional construction of an embodiment of the present invention having a control device 7, a drive unit 6, a lighting device 9, an on/off switch 74, operating elements 71, a battery 76 and an external current supply 73. This basic construction of the control device 7 can fundamentally be used in all disclosed aspects and embodiments.

The control device 7 which has a microcontroller or is hardwired, initially controls the current supply of all users of the stimulation device 1, and optionally a charging/discharging process of the battery 76 and/or battery management. In particular, the control device 7 controls the energisation of the drive unit 6, for example the size of the displacement, the frequency, the modulation, etc.

Optionally provided operating elements 71 serve to set the operating type of the device, i.e. to set the modulation pattern of the pressure field. The operating elements 71 can be implemented, for example, as at least one push button, as at least one rotation switch, or as at least one touch-sensitive switch. Furthermore, the operating elements 71 can provide optical feedback for activation, for example by means of light diodes (LED) integrated in the switch.

An optional display 72 serves to inform the user about the device state and/or the setting state. The display 72 can be formed, for example, from a multitude of light diodes or as an LCD display. The information displayed can be, for example, the charging state of an optional battery or the current setting of the modulation pattern.

Furthermore, the control device 7 can have a memory, in which at least one modulation or stimulation pattern (these are explained in more detail below in the context of FIG. 40 *a*) to *c*)) is stored. The drive unit 6 can now be controlled in terms of its energisation depending on the choice of the user of the stimulation device 1 via the operating elements 71 to correspond to this pre-saved stimulation pattern. The stimulation patterns of the pressure field can optionally also be individually constructed and stored by the user via the operating elements.

A bushing (that is not shown in more detail) can serve the external current supply of the stimulation device 1 via an external plug, which is connected, for example, to an external network adaptor. In order to ensure the waterproofing of the stimulation device 1, a magnetic-inductive transformer can also be provided instead of the bushing, which enables a power transfer into the stimulation device 1 without an electric conductive contact. Preferably, the stimulation device 1 also has a battery, for example a nickel-metal hydride battery (NiMH) or a lithium ionic battery, for operation without cables. Alternatively, a (longer) current supply cable can also be guided out of the stimulation device.

Figure 40A:
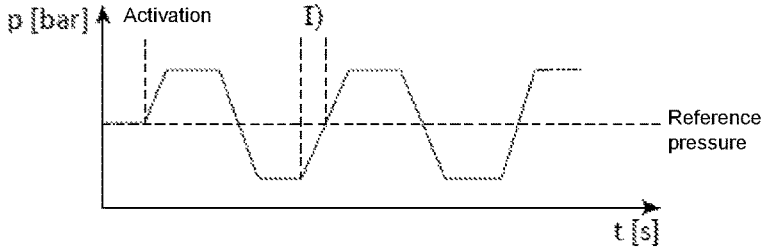
FIGS. 40 *a*) to *c*) diagrams of different patterns of the pressure modulations of the present invention.
Figure 40B:
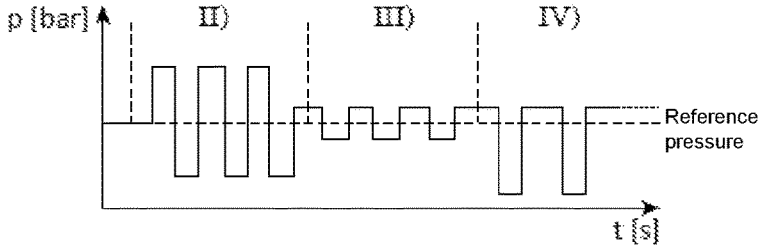
Figure 40C:
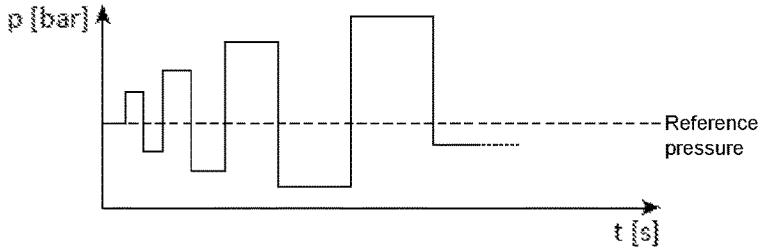

FIG. 40 *a*) shows the temporal course of a total pressure p in the pressure field generation device (2) when using this for stimulation. The dotted line states the reference pressure, for example the currently prevailing atmospheric (air) pressure, which is present outside the pressure field generation device (2). If the second chamber 4 is now placed on the body part 11 to be stimulated, this surrounding pressure prevailing at the start, which is also present in the hollow space 10 of the pressure field generation device (2), is somewhat maintained. From then on, it is assumed that the second chamber 4 is placed, in a largely sealing manner, on the body part to be stimulated. After activating the stimulation device, the drive unit 6 is controlled or energised by the control device 7 according to a pre-stored stimulation pattern. Correspondingly, the volume of the first chamber 3 and thus the pressure and the currents in the pressure field generation device 2 change, wherein the pressure changes are consequently modulated to the reference pressure prevailing at the start or the normal pressure. The pressure or stimulation pattern shown by way of example in FIG. 40 *a*) develops a pulsed, regular pressure field having temporally alternating negative and positive pressures. In phases of the increase of pressure, the erogenous zone to be stimulated is blown on or massaged, while at the time when a negative pressure prevails, the blood flow through the body part 11, for example the clitoris, is encouraged. Thus, time periods exist (labelled with I) in FIG. 40 *a*)) according to the invention, in which a negative pressure prevails, while, at the same time, the clitoris is indirectly stimulated.

FIG. 40 *b*) shows three examples of alternative stimulation patterns. Thus, a pulsed stimulation pattern having high amplitude is depicted in the region labelled with II) is depicted. In the region labelled with III), a pulsed stimulation pattern having low amplitude is depicted. Furthermore, in the region labelled with IV), a stimulation pattern is depicted that is irregular or asymmetric in terms of the temporal sequence and the amplitude. The patterns can be varied depending on bodily effect/use and according to individual wishes.

FIG. 40 *c*) shows a further example of an alternative stimulation pattern. Thus, the strength of the pressure can increase with time in order to adjust to the arousal state of the user.

Below, additional developments of the stimulation device 1 are presented. All presently disclosed features, embodiments, aspects and developments of the stimulation device 1 can be combined with one another in any combination, as long as this is technically feasible for the person skilled in the art.

The stimulation device 1 according to a further aspect of the invention can be provided, for example, in such a way that the connection element 5 is a channel whose opening 33 into the first chamber is oval; and wherein the opening 51 of the channel into the second chamber 4 is round.

The stimulation device 1 according to a further aspect of the invention can be provided, for example, in such a way that the connection element 5 is at least sectionally an individual straight running channel; and/or the channel of the connection element 5 is rigid; and/or the at least one connection element 5 is formed in terms of current in such a way that, when reducing the volume of the first chamber 3, the resulting current of the medium is aimed at the erogenous zone, preferably at the clitoris 12.

The stimulation device 1 according to a further aspect of the invention can be provided, for example, in such a way that the connection element 5 has the damping element 54.

The stimulation device 1 according to a further aspect of the invention can be provided, for example, in such a way that the at least one operating element 71 is provided that is provided on the backwards or rear end 91 of the housing 8.

The stimulation device 1 according to a further aspect of the invention can be provided, for example, in such a way that the pressure field generated in the second chamber 4 consists of a pattern of negative and positive pressures, which are modulated to a reference pressure, preferably to the normal pressure.

The stimulation device 1 according to a further aspect of the invention can be provided, for example, in such a way that the first chamber 3 is connected exclusively to the second chamber 4 in terms of current.

The stimulation device 1 according to a further aspect of the invention can be provided, for example, in such a way that the second chamber 4 is produced from a flexible material, preferably from silicone or rubber, and/or is produced from an at least partially transparent material and/or adjusted to the shape of the vaginal labia minora in such a way that it is completely covered by the opening 41 of the second chamber 4, or the opening 41 of the second chamber 4 can be inserted between the vaginal labia minora.

The stimulation device 1 according to a further aspect of the invention can be provided, for example, in such a way that the second chamber 4 having the connection element 5 and the first chamber 3 is formed to be one piece. The wall of the hollow space 10 can also be provided to be one piece.

The stimulation device 1 according to a further aspect of the invention can be provided, for example, in such a way that the second chamber 4 of the stimulation device 1 is arranged to be exchangeable.

The stimulation device 1 according to a further aspect of the invention can be provided, for example, in such a way that the second chamber 4 has a resting part 43 or a placing region 43, which enlarges the contact surface 43 of the second chamber 4 on the skin in order to improve a sealing effect of the second chamber 4.

The stimulation device 1 according to a further aspect of the invention can be provided, for example, in such a way that the stimulation device 1 has at least one operating element 71, by means of which the modulation of the pressure field can be set.

The stimulation device 1 according to a further aspect of the invention can be provided, for example, in such a way that the stimulation device 1 has a lighting device 9, preferably an LED lighting device for lighting the second chamber 4.

The stimulation device 1 according to a further aspect of the invention can be provided, for example, in such a way that the connection element 5 has an inner shaping and an opening to the second chamber 4 which is formed in such a way that the pressure field is modulated in direction and characteristic.

For example, a method for stimulating body parts, in particular the clitoris (12) can be provided, which has the following steps:

constructing a pressure field aimed at the body part (11), wherein the pressure field consists of a pattern of negative and positive pressures, which are modulated to a reference pressure, preferably to the normal pressure.

The method above can be continued by the stimulation device being individually influenced by a modulation of the pressure field.

Furthermore, the pressure field can be pulsed.

By means of the stimulation device according to the invention, a method can further be carried out, for example which has the following steps:

placing the second chamber (4) on the body part (11), preferably over the clitoris (12); and constructing a temporally changing pressure field, which consists of a pattern of negative and positive pressures, which are modulated to a reference pressure, preferably to the normal pressure; and taking the second chamber (4) off the body part (11).

Any methods explained in this description do not serve therapeutic or medical purposes, but are only for non-medical and non-therapeutic purposes. Thus, the present method serves for sexual pleasure.

Similarly, a use of the stimulation device 1 as a sex toy for stimulation of the female clitoris is provided.

The invention permits further design principles, along with the embodiments explained. Thus, different arrangements or constructions of the first chamber 3 can be combined in any way with different embodiments of the second chamber 5 or the connection element 5.

Although in all embodiments only one first chamber 3 is depicted, two or more first chambers 3 can also be present, which are then correspondingly driven in a simultaneous or time-delayed manner in such a way that these change their volume in order to construct a pressure field according to the invention.

Although in all embodiments only one opening from the first chamber 3 to the connection element 5 is depicted, several openings for one connection element 5 or even several openings for several connections elements in the first chamber 3 can thus also be present.

Although in all embodiments specific angles and angle regions are stated, these angles and angles regions can thus also be used in each case in different embodiments.

The stimulation patterns according to the invention can deviate from the patterns shown in FIGS. 40 *a*), *b*) an *c*), as long as these have a temporal sequence of negative and positive pressures. For example, at the start or after activation of the device, initially, a relatively prolonged negative pressure is constructed (for example, 3 minutes), in order to effectively increased the blood flow to the zone to be stimulated, from which then pulses of negative and positive pressures that slowly become larger in amplitude follow on.

The invention claimed is:

1. A stimulation device for a clitoris, comprising:

a housing;

a pressure field generation device having a drive unit which generates a pressure field from temporally alternating negative and positive pressures of a medium in a hollow space; and a control device which controls the drive unit;

wherein:

the housing has a longitudinal axis, which extends from a front end of the housing up to a back end of the housing, an opening for placing over the clitoris is provided in the front end of the housing with a center of the longitudinal axis passing through an opening plane of the opening, wherein the opening plane is defined by outer edges of the opening, the hollow space is arranged inside the housing and is connected to the opening of the housing, the pressure field generation device comprises a flexible wall which is configured to be displaced by the drive unit, and a direction of the displacement of the flexible wall is provided by the drive unit at an angle relative to an alignment axis that is defined by an alignment of currents of the medium in the hollow space when generating the positive pressures.

2. The stimulation device according to claim 1, wherein the center of the longitudinal axis passes through the opening plane at an angle greater than 30 degrees.

3. The stimulation device according to claim 1, wherein the hollow space is configured to be supplied with forces by the drive unit in such a way that the pressure field, which acts in a direction of the longitudinal axis of the housing, is generated in the hollow space, said pressure field being aimed at the clitoris for the stimulation thereof in the hollow space when the opening of the housing is placed over the clitoris.

4. The stimulation device according to claim 1, wherein the housing has a central section that is adjacent to the front end in a direction of the longitudinal axis and is formed for holding the stimulation device with a hand, said central section being formed and arranged to extend along the longitudinal axis and in a peripheral direction around the longitudinal axis.

5. The stimulation device according to claim 4, wherein the central section extends over at least 30% of an axial extension of the longitudinal axis and up to a maximum of 70% of the axial extension of the longitudinal axis.

6. The stimulation device according to claim 1, wherein the longitudinal axis substantially constitutes an axis of symmetry of the housing or the longitudinal axis corresponds to a direction of a greatest total extension of the housing.

7. The stimulation device according to claim 1, wherein a wall of the hollow space forms the opening of the housing and the hollow space, and the wall forms a part of an external wall of the housing on the front end.

8. The stimulation device according to claim 1, wherein the alignment axis forms an angle with the longitudinal axis which is less than or equal to 50 degrees or the alignment axis is arranged to be substantially parallel to the longitudinal axis.

9. The stimulation device according to claim 1, wherein a central section of the housing has an external contour which is formed to be one of round, oval, of equal thickness, or regularly n-cornered in a cross-sectional plane of the central section.

10. The stimulation device according to claim 1, wherein the front end of the housing comprises silicon or rubber, and is formed interchangeably as a head of the stimulation device.

11. The stimulation device according to claim 1, comprising:

a cap configured to be installed or inserted on the housing in such a way that the cap covers at least the opening of the housing.

12. The stimulation device according to claim 11, wherein the cap is dimensioned in such a way that it can be pulled over the stimulation device up to a stop such that the front end and a central section of the housing are covered by the cap.

13. The stimulation device according to claim 1, wherein the housing is waterproof; and the hollow space of the pressure field generation device is implemented to be waterproof in comparison to the inside of the stimulation device.

14. The stimulation device according to claim 1, wherein:

the hollow space of the pressure field generation device has at least one first chamber and at least one second chamber having the opening for placing over the clitoris and at least one connection element having at least one opening into the at least one second chamber, and the at least one connection element connects the at least one first chamber to the at least one second chamber; and the drive unit changes the volume of the at least one first chamber by displacement of the flexible wall in such a way that the pressure field is generated in the at least one second chamber via the at least one connection element, said pressure field facilitating the stimulation.

15. The stimulation device according to claim 1, wherein the pressure field generation device comprises at least one damping element.

16. The stimulation device according to claim 1, wherein the hollow space is substantially formed cylindrically.

17. The stimulation device according to claim 16, wherein the alignment axis is arranged to be parallel to a central axis of the hollow space.

18. The stimulation device according to claim 15, wherein the at least one damping element is arranged between the opening and an electric motor or the flexible wall of the pressure field generation device in such a way that vibrations and/or sounds that are generated inside the housing are damped in a direction of the opening.

19. The stimulation device according to claim 15, wherein the at least one damping element has a channel which runs in an S-shaped manner, and/or the channel is coated on its internal wall with a silencing material.

20. A system comprising:

a stimulation device comprising:

a housing, a pressure field generation device having a drive unit which generates a pressure field from temporally alternating negative and positive pressures of a medium in a hollow space, and a control device which controls the drive unit; and a bracket for storing and charging the stimulation device, wherein:

the housing has a longitudinal axis, which extends from a front end of the housing up to a back end of the housing, an opening for placing over a clitoris is provided in the front end of the housing with a center of the longitudinal axis passing through an opening plane of the opening, the pressure field generation device comprises a flexible wall which is configured to be displaced by the drive unit, a direction of the displacement of the flexible wall is provided by the drive unit at an angle relative to an alignment axis that is defined by an alignment of currents of the medium in the hollow space when generating the positive pressures, the bracket comprises a charging coil on a bracket side, the stimulation device has a complementary charging coil on a stimulation device side, a battery of the stimulation device is configured to be charged using an inductive coupling of the charging coil on the bracket side and the complementary charging coil on the stimulation device side when the stimulation device is deposited in or on the bracket, and the stimulation device does not have a bushing for supplying current.

21. The system according to claim 20, wherein the charging coil on the bracket side and the charging coil on the stimulation device side are adjacent to each other when the stimulation device is deposited in or on a loading bracket.

22. The stimulation device according to claim 20, wherein the longitudinal axis corresponds to a direction of a greatest total extension of the housing or the longitudinal axis is an axis of symmetry of the stimulation device or of the housing.

23. A stimulation device for a clitoris, comprising:

a housing;

a pressure field generation device having a drive unit which generates a pressure field from temporally alternating negative and positive pressures in a hollow space;

a control device which controls the drive unit; and a cap configured to be installed or inserted on the housing in such a way that the cap covers at least the opening of the housing;

wherein:

the housing has a longitudinal axis, which extends from a front end of the housing up to a back end of the housing, an opening for placing over the clitoris is provided in the front end of the housing with a center of the longitudinal axis passing through an opening plane of the opening, wherein the opening plane is defined by outer edges of the opening, the cap is dimensioned in such a way that it can be pulled over the stimulation device up to a stop such that the front end is covered by the cap, and the hollow space is arranged inside the housing and is connected to the opening of the housing.

24. The stimulation device according to claim 23, wherein the longitudinal axis substantially constitutes an axis of symmetry of the housing or the longitudinal axis corresponds to a direction of a greatest total extension of the housing.

25. The stimulation device according to claim 23, wherein the cap is dimensioned in such a way that it can be pulled over the stimulation device up to the stop such that a central section of the housing is covered by the cap.

26. The stimulation device according to claim 23, wherein the pressure field generation device comprises at least one damping element arranged between the drive unit and the opening to dampen vibrations and/or sounds.

27. The stimulation device according to claim 23, wherein the hollow space is substantially formed cylindrically.

28. A stimulation device for a clitoris, comprising:

a housing;

a pressure field generation device having a drive unit which generates a pressure field from temporally alternating negative and positive pressures in a hollow space; and a control device which controls the drive unit;

wherein:

the housing has a longitudinal axis, which extends from a front end of the housing up to a back end of the housing, an opening for placing over the clitoris is provided in the front end of the housing with a center of the longitudinal axis passing through an opening plane of the opening, wherein the opening plane is defined by outer edges of the opening, the hollow space is arranged inside the housing and is connected to the opening of the housing, the hollow space of the pressure field generation device has at least one first chamber and at least one second chamber having the opening for placing over the clitoris and at least one connection element having at least one opening into the at least one second chamber, the at least one connection element connects the at least one first chamber to the at least one second chamber, and the drive unit changes the volume of the at least one first chamber by displacement of a flexible wall in such a way that the pressure field is generated in the at least one second chamber via the at least one connection element, said pressure field facilitating stimulation of the clitoris.

29. The stimulation device according to claim 28, wherein the longitudinal axis substantially constitutes an axis of symmetry of the housing or the longitudinal axis corresponds to a direction of a greatest total extension of the housing.

30. The stimulation device according to claim 28, wherein the hollow space is substantially formed cylindrically.

* * * * *